US006695437B2

(12) United States Patent
Nakamura et al.

(10) Patent No.: US 6,695,437 B2
(45) Date of Patent: Feb. 24, 2004

(54) INKJET RECORDING HEAD AND METHOD FOR DRIVING AN INKJET RECORDING HEAD

(75) Inventors: Hirofumi Nakamura, Tokyo (JP); Masakazu Okuda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 10 days.

(21) Appl. No.: 10/152,361

(22) Filed: May 21, 2002

(65) Prior Publication Data

US 2002/0186278 A1 Dec. 12, 2002

(30) Foreign Application Priority Data

May 24, 2001 (JP) ..... 2001-154913
Aug. 31, 2001 (JP) ..... 2001-264453

(51) Int. Cl.[7] ..... B41J 2/045
(52) U.S. Cl. ..... 347/70; 347/68
(58) Field of Search ..... 347/70, 76, 75, 347/57, 68

(56) References Cited

U.S. PATENT DOCUMENTS 4,546,362 A * 10/1985 Koto ..... 347/68

FOREIGN PATENT DOCUMENTS

| | | |
|---|---|---|
| JP | 53-12138 | 4/1978 |
| JP | 55-17589 | 7/1980 |
| JP | 1-208146 | 8/1989 |
| JP | 10-193587 | 7/1998 |
| JP | 10-508808 | 9/1998 |

* cited by examiner

*Primary Examiner*—Thinh Nguyen
(74) *Attorney, Agent, or Firm*—Scully, Scott, Murphy & Presser

(57) ABSTRACT

An inkjet recording head includes a plurality of nozzles, a plurality of pressure chambers in communication with the respective nozzles, a diaphragm forming a part of the walls of the pressure chambers, and a plurality of piezoelectric actuators each coupled with a part of the diaphragm to form a vibrating member. The vibrating member deforms to generate a pressure wave in the ink filled within the pressure chamber, the acoustic capacitance of the vibrating member being set at $2.0\times10^{-20}$ $m^5/N$ or higher.

32 Claims, 41 Drawing Sheets

INKJET RECORDING HEAD AND METHOD FOR DRIVING AN INKJET RECORDING HEAD

BACKGROUND OF THE INVENTION

1. Field of the Invention

The present invention relates to an inkjet recording head for recording characters and images by ejection of ink droplets, and manufacturing and driving methods thereof, and an inkjet recording apparatus having such an inkjet recording head.

2. Description of the Related Art

In recent years, an impact recording process has attracted much attention for its small noise in recording and a high recording speed thereof. Among other impact recording processes, an inkjet recording process used in inkjet printers has been in wide use. The inkjet printer allows ink droplets to be ejected from the recording head and attached onto recording paper so that characters, figures and photographs are printed at a high speed. The inkjet printer is capable of recording the images onto plain paper without using a special fixation processing. According to a known inkjet recording process called drop-on-demand inkjet recording scheme, an electromechanical transducer such as a piezoelectric actuator is used to generate pressure waves (acoustic waves) in pressure chambers filled with ink, thereby allowing ink droplets to be ejected from the nozzles disposed in communication with the pressure chambers.

An inkjet recording head using the drop-on-demand inkjet scheme is described in JP Patent Publication No. Sho. 53-12138 and JP Patent Laid-Open Publication No. Hei. 10-193587. FIG. 34 is a sectional view of a recording head in an inkjet recording apparatus such as described in these publications. The inkjet recording apparatus includes a plurality of pressure chambers 51, a plurality of nozzles 52 each in communication with a corresponding one of the pressure chambers 51, a plurality of ink supply passage 54 for supplying ink from an ink reservoir through a common ink passage 53. A diaphragm 55 is fixed onto the bottom of the pressure chambers 51.

In the above inkjet recording apparatus, at the time of ink droplet ejection, the diaphragm 55 is displaced (or flexibly deformed) by a piezoelectric actuator 56 disposed outside the pressure chamber 51 to change the volume in the pressure chamber 51, thereby generating a pressure wave in the pressure chamber 51. The pressure wave causes part of the ink filled in the pressure chamber 51 to be ejected outside the pressure chamber 51 through the nozzle 52 as an ink droplet 57. The ejected ink droplets arrive at a recording medium such as a recording paper sheet to form recording dots (pixels) thereon. The process of forming the recording dots is iteratively performed based on image data so that characters or images are formed on the recording medium.

It is desired that the drop-on-demand inkjet recording apparatus achieve both high speed recording and high image quality recording. In the conventional inkjet recording apparatus, however, achieving both high speed recording and high image quality recording at the same time is in fact extremely difficult. If, for example, the resolution is degraded in order to achieve high speed recording, high image quality is not provided. On the other hand, if the resolution is increased in order to achieve high image quality recording, the high speed recording cannot be obtained. In other words, high speed recording and high image quality recording are tradeoff against each other.

The necessary conditions to achieve both "high speed recording" and "high image quality recording" in the inkjet recording apparatus will be described hereinafter. Two particularly important conditions to achieve the "high speed recording" are as follows:

(1) to lower the recording resolution, and (2) to increase the number of nozzles disposed (or to increase the nozzle density).

If the condition (1), i.e., to lower the resolution is satisfied, a unit area can be recorded with less ink droplets, and therefore the time required for recording can be reduced. When recording resolutions of 300 dpi (dots/inch) and 1200 dpi are compared against each other, the necessary number of ink dots for 300 dpi is 1/16 as many as that for the resolution of 1200 dpi to record the same area. It should be noted that, for the same frequency of ejected ink droplets (driving frequency), the recording speed obtained at 300 dpi resolution is about 16 times as high as that obtained at 1200 dpi resolution.

However, if the recording resolution is set to be lower, the image quality is lowered, and therefore there is a lower limit for the reduction in the recording resolution. In consideration of human eyesight, it is most suitable that the recording resolution be set in the range roughly from 300 to 600 dpi (1 dot/inch =39.37 dots/m) in order to achieve high speed recording without significantly lowering the image quality (character and line qualities). The recording resolution is preferably set to be lower than the usual resolution (700 to 2400 dpi) of typical inkjet recording apparatuses generally used heretofore, in view of improvement of the recording speed. It should be noted, however, that in order to set a lower recording resolution, ink droplets having a corresponding large size should be ejected.

More specifically, in order to form large ink dots in accordance with the high speed recording corresponding to the lower recording resolution, ink droplets having a corresponding large volume should be ejected. The relation between the recording resolution and a necessary droplet volume changes to some extent depending on the types of ink or recording paper used. With a typical ink and typical recording paper used in the conventional inkjet recording apparatus, an ink droplet volume in the range from 15 to 30 pl (1 pico-liter=$10^{-15}$ $m^3$) is generally adopted to provide a sufficient recording density together with a recording resolution in the range from 300 to 600 dpi. This is about 1.5 to 3 times as much as the ink droplet volume (about 10 pl) necessary for the resolution of 1200 dpi.

In order to increase the recording speed, the number of nozzles should be increased as in the above condition (2). A larger number of nozzles increases the number of dots formed per unit time length, which improves the recording speed. Therefore, in typical inkjet recording apparatuses, a multi-nozzle recording head is generally employed which includes a number of such ink ejecting mechanisms (ejectors) coupled together.

FIG. 35 shows the multi-nozzle recording head. In the recording head shown, an ink reservoir 67 is coupled with a common ink passage 63, to which a plurality of pressure chambers 61 are coupled through respective ink supply passages (not shown). Thus, in this head structure, by arranging ejectors 68 one-dimensionally along the common ink passage 63, the number of ejectors 68 (or the number of nozzles 62) is increased up to about 30 to 100.

Another inkjet recording head having ejectors arranged two-dimensionally in a matrix (hereinafter referred to as "matrix head") to further increase the number of ejectors is described in, for example, JP Patent Laid-Open Publication No. 1-208146 and JP National Phase PCT Publication No. 10-508808. FIG. 36 shows a matrix head such as described in these publications. In the matrix head, the common ink passage includes a main passage 73 and a plurality of branch passages 78, wherein a plurality of ejectors 79 are connected to a single branch passage 78. The matrix head structure is advantageous in increasing the number of ejectors 89 (or the number of nozzles 72). If, for example, there are 26 branch passages 78 disposed in the matrix head, and ten ejectors 79 are connected to each of the branch passages 78, then 260 ejectors can be arranged altogether. It should be noted that FIG. 36 shows only 36 ejectors among them.

As described above, the matrix head is advantageous for increasing the number of nozzles, while the dimensions of the recording head as a whole increases unless the density of the pressure chambers 71 arranged is not increased. This may increase the cost for manufacturing the recording head and the size of the recording apparatus, and increases the distance to transport the recording head, which lowers the recording speed.

More specifically, increase in the number of nozzles in the inkjet recording head means to arrange more nozzles in a specified area. In other words, the object can be interpreted as how to increase the nozzle density. In the matrix head as shown in FIG. 36, the dimensions of the pressure chamber 71 should be reduced in order to increase the density of the ejectors 79 arranged.

On the other hand, in order to achieve the "high image quality recording" in the inkjet recording apparatus, the size of ejected ink droplets is preferably reduced as much as possible. When a photographic image is output, in particular, the perceived granularity of a highlight part (lower density part) significantly affects the image quality, and therefore the highlight part is preferably recorded with extremely small ink droplets. Because of human eye resolution, the granularity perceived by a human eye significantly reduces at a dot size of 40 micrometers or less. At 30 micrometers or less, individual dots can no longer be perceived by the human eye as such, and therefore the image quality remarkably improves. As a result, the highlight part of an image preferably has dots having a diameter of 30 micrometers or less. Thus, very small ink droplets having a volume of about 2 to 4 pl should be preferably ejected.

A method of driving the inkjet recording head to eject very small droplets is described in, for example, JP Patent Laid-Open Publication No. 55-17589. According to the described driving technique, the pressure chamber is expanded immediately before ink ejection, and then an ink droplet is ejected from the nozzle in the state wherein the meniscus in the nozzle orifice is pulled toward the pressure chamber side. The driving waveform such as used in this driving technique is shown in FIG. 37. The driving waveform includes a first section or a first voltage change process 83 by which the pressure chamber is expanded, and a second section or a second voltage change process 84 by which the pressure chamber is compressed to eject the ink droplet.

FIGS. 38A to 38D are schematic sectional views for illustration of the movement of a meniscus 92 at the orifice of the nozzle 91 when a voltage having the driving waveform shown in FIG. 37 is applied. As shown in FIG. 38A, the surface of the meniscus 92 is flat in the initial state. After the pressure chamber starts to expand in response to the first voltage change section 83 shown in FIG. 37, the center of the meniscus 92 is retracted greatly from the peripheral part, so that the meniscus 92 has a concave shape as shown in FIG. 38B.

In response to the second voltage change section 84 shown in FIG. 37, after the state in which the concave meniscus 92 is formed, the pressure chamber starts to be compressed, and a small-diameter liquid column 93 is formed in the center of the meniscus 92 as shown in FIG. 38C. Then, as shown in FIG. 38D, the tip portion of the liquid column 93 is separated from the rest of the liquid column 93 to form an ink droplet 94. The size of the ink droplet 94 is substantially equal to the diameter of the liquid column 93, and thus smaller than the nozzle diameter. In short, an ink droplet 94 having a size smaller than the nozzle diameter can be ejected by this driving technique. In this text, the driving technique that controls the meniscus shape and ejects very small droplets, as described above, will be referred to as "meniscus control technique."

As described above, in order to achieve the "high speed recording" using the drop-on-demand inkjet recording head, large droplets should be ejected to achieve low resolution recording and the nozzle density should be increased to increase the number of nozzles disposed per unit area. On the other hand, in order to achieve high image quality recording, small droplets should be ejected to reduce the granularity of the highlight part. In order to achieve both "high speed recording" and "high image quality recording" using a single recording head, the three conditions, i.e., "ejection of large droplets," "increase in the nozzle density," and "ejection of small droplets" should be satisfied.

However, all the three objects i.e., "ejection of large droplets" and "increase in the nozzle density" for high speed recording and "ejection of small droplets" for high image quality recording can hardly be satisfied at a time using the conventional inkjet recording head.

Another disadvantage associated with the conventional inkjet recording head is abnormal vibration of the meniscus at the time of ink droplet ejection and instability caused by the vibration in the ejection of ink droplets. There had never been a detailed study disclosing the mechanism of how such abnormal meniscus vibration was caused, or of a method of preventing such a vibration. Now, the result of study conducted by the inventors will be described hereinafter.

FIGS. 39A and 39B are graphs for showing results of observing meniscus vibration by using laser Doppler velocimeter, wherein the volume velocity of the ink at the nozzle is plotted against the time. FIG. 39A showing a typical normal state conceived and FIG. 39B showing an abnormal state observed. More specifically, the meniscus vibration shown in FIG. 39A is normal and thus expected to be observed; however, as shown in FIG. 39B, the meniscus vibration actually observed had additional very small vibration superposed on the typical meniscus vibration. The small vibration superposed on the typical meniscus vibration causes much instability in the ejection of ink droplets. By the meniscus control technique described above, in particular, the liquid surface interference in the meniscus is utilized to eject very small droplets. If, therefore, such small vibration is superposed on the typical meniscus vibration, desired very small droplets cannot be ejected, or on the other hand, unwanted excess ink droplets may be ejected, whereby a normal ejection of small droplets cannot be expected any more.

SUMMARY OF THE INVENTION

In view of the above disadvantages in the conventional techniques, it is an object of the present invention to provide an inkjet recording head which is capable of allowing "large droplets" having desired diameters to be ejected from a single nozzle and achieving "increase in the nozzle density" to thereby improve the ink droplet ejection efficiency per unit area while preventing the head size and the cost from increasing.

It is also an object of the present invention to provide an inkjet recording apparatus including such an inkjet recording head, and to provide methods of manufacturing and driving such an inkjet recording head.

Another object of the present invention is to provide an inkjet recording head that allows both "large droplets" and "small droplets" each having a desired size to be selectively ejected from a single nozzle, thereby achieving both high speed recording and high image quality recording.

Yet another object of the invention is to provide an inkjet recording head having high ejection stability that can prevent abnormal vibration of a meniscus.

Thus, the present invention provides an inkjet recording head including a plurality of nozzles, a plurality of pressure chambers each disposed in communication with a corresponding one of the nozzles, at least one diaphragm disposed to form a part of the wall surfaces of the pressure chambers, and a plurality of piezoelectric actuators each disposed for a corresponding one of the pressure chambers in operative relationship with the diaphragm. A part of the diaphragm and each piezoelectric actuator in combination constitute a vibrating member which deforms to generate a pressure wave in the ink filled within the pressure chamber, thereby ejecting ink droplets from the nozzle. In the feature of the present invention, it is defined that acoustic capacitance of the vibrating member is set at $2.0\times10^{-20}$ $m^5/N$ or higher.

In accordance with the inkjet recording head of the present invention, large droplets each having a desired size can be ejected from the same nozzle. In addition, increase in the nozzle density can be achieved to improve the ink ejection efficiency per unit area while preventing the head size and the cost of the inkjet recording head from increasing.

A method of manufacturing an inkjet recording head according to the present invention includes the step of forming a pattern for the piezoelectric actuators by sandblast processing.

By the method of manufacturing the inkjet recording head according to the present invention, the pattern of the piezoelectric actuators formed by the sandblast processing allows the piezoelectric actuators having a complicated shape to be suitable for maximizing the ejection efficiency, and also the electric connection for the piezoelectric actuators can be achieved with high dimensional precision and with less cost.

An inkjet recording apparatus according to the present invention includes the inkjet recording head as described above. Use of the inkjet recording apparatus according to the present invention allows both high speed recording and high image quality recording.

A first method of driving an inkjet recording head according to the present invention is directed to the inkjet recording head which includes a plurality of nozzles, a plurality of pressure chambers each in communication with a corresponding one of the nozzles, a diaphragm forming a part of the wall surfaces of the pressure chambers, and a plurality of piezoelectric actuators each coupled to the diaphragm. A part of the diaphragm (or one of the plurality of diaphragms) and each piezoelectric actuator in combination form a vibrating member, which is deformed to compress the ink filled within a corresponding pressure chamber, to eject an ink droplet from the nozzle. The acoustic capacitance of the vibrating member is set at $2.0\times10^{20}$ $m^5/N$ or higher.

In the first method of the present invention, a driving voltage is applied to the vibrating member, wherein the waveform of the driving voltage includes a first voltage change process to be applied in the direction to compress the volume of the pressure chamber and allow an ink droplet to be ejected, and a second voltage change process to be applied in the direction to expand the volume of the pressure chamber. Thus, an ink droplet of at least 15 pl is ejected.

According to the first method of driving an inkjet recording head according to the invention, large ink droplets necessary for low resolution recording 600 dpi or less can be ejected from the inkjet recording head driven by the method.

A second method of driving an inkjet recording head according to the present invention is directed to the inkjet recording head which includes a plurality of nozzles, a plurality of pressure chambers each in communication with a corresponding one of the nozzles, a diaphragm forming a part of the wall surface of the pressure chambers, and a plurality of piezoelectric actuators each coupled to the diaphragm. A part of the diaphragm or one of the plurality of diaphragms and each piezoelectric actuator in combination form a vibrating member. The vibrating member is deformed to compress the ink filled within the pressure chamber, to eject an ink droplet from the nozzle. The acoustic capacitance of the vibrating member is set in the range from $2.0\times10^{-20}$ $m^5/N$ to $5.5\times10^{-19}$ $m^5/N$.

In the second method, a driving voltage is applied to the vibrating member, wherein the waveform of the driving voltage includes a first voltage change process to be applied in the direction to expand the volume of the pressure chamber, and a second voltage change process to be applied in the direction to compress the volume of the pressure chamber, to form a liquid column of ink having a diameter smaller than the nozzle size of the nozzle, and separate and eject a very small ink droplet from the tip of the liquid column. Thus, an ink droplet of 4 pl or more is ejected.

By the second method of driving an inkjet recording head according to the present invention, image recording with low granularity and high image quality can be achieved.

The above and other objects, features and advantages of the present invention will be more apparent from the following description, referring to the accompanying drawings.

BRIEF DESCRIPTION OF THE DRAWINGS

FIGS. 3A to 3C are graphs showing the relation between the ejection volume and the acoustic parameters when a step-wise pressure is applied, wherein FIG. 3A shows the relation between the ejection volume and the inertance, FIG. 3B shows the relation between the ejection volume and the acoustic capacitance, and FIG. 3C shows the relation between the ejection volume and the acoustic resistance;

PREFERRED EMBODIMENTS OF THE INVENTION

Before describing the preferred embodiments of the present invention, the principle of the present invention will be described for a better understanding of the present invention.

It is known in a conventional inkjet recording head that it is difficult to satisfy at a time the three conditions as described before, i.e., "ejection of large droplets" and "ejection small droplets" from a single nozzle, and "increase in the nozzle density." The reasons which we found will be detailed with reference to a specific example.

As for the "ejection of large droplets," the volume of the maximum ink droplet that can be ejected by an inkjet recording head is substantially equal to a volume change (or ejection volume) $\Delta V$ generated in the pressure chamber as will be described hereinafter (see the expression (2)). The volume change to be generated in the pressure chamber should be substantially equal to the ink droplet to be ejected. Therefore, in order to obtain a large droplet volume, the driving area of the piezoelectric actuator (or the bottom area of the pressure chamber) should be increased to increase the volume change $\Delta V$ of the pressure chamber.

When, for example, the displacement of the piezoelectric actuator is 0.1 micrometers, a droplet volume of 10 pl can be ejected by a driving area of about $1\times10^{-7}$ $m^2$. When the droplet volume is increased to 20 pl, the driving area twice as large ($2\times10^{-7}$ $m^2$) is necessary. As a result, the number of nozzles per unit area (nozzle density) is reduced to about ½. More generally, to achieve low resolution recording and increase the droplet volume for high speed recording, the dimensions of the pressure chamber should be increased, which lowers the nozzle density however. In other words, high speed recording and high image quality recording are tradeoff against each other and it may be extremely difficult to achieve low resolution recording and increase of the number of nozzles (or increase of the nozzle density) at a time in the conventional technique.

As for the "ejection of small droplets," in order to eject a very small droplet by the meniscus control technique, the natural period $T_c$ of a pressure wave generated in the pressure chamber should be short because of the following reason. As described with reference to FIGS. 38A to 38D in conjunction with the meniscus control technique, the meniscus 92 is first retracted toward the pressure chamber side to be formed in a concave shape, and is then pressed outwardly through the nozzle, thereby forming a small-diameter liquid column 93. The inventors have studied in details the mechanism as to how the liquid column 93 is formed, and found that the diameter of the liquid column depends on the liquid surface speed (speeds of the liquid in the direction normal to the surface) at the time when the meniscus is pressed out.

Figure 32A:
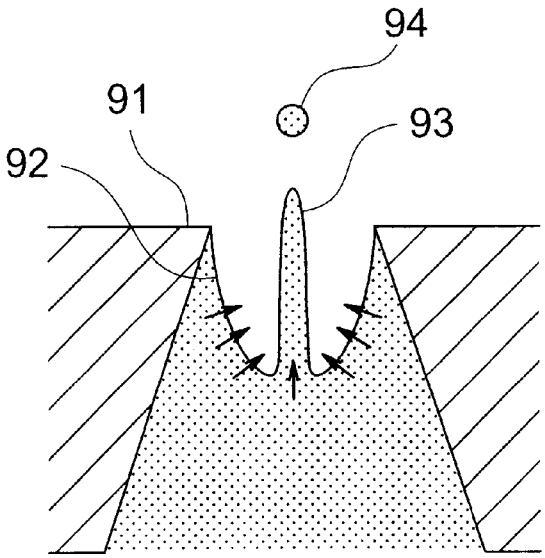
FIGS. 32A and 32B are schematic sectional views for illustration of the behavior of a meniscus controlled by the meniscus control technique.
Figure 32B:
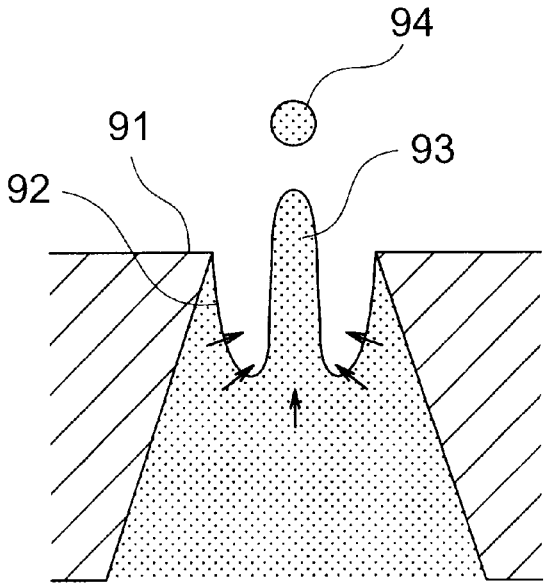

FIGS. 32A and 32B are sectional views showing the behavior of the meniscus in the meniscus control technique. When a higher pressure is applied to the retracted meniscus 92 in the direction to press out the meniscus, each part of the meniscus 92 is caused to move in the direction normal to the liquid surface as shown in FIG. 32A. As a result, a large amount of ink concentrates in the center of the nozzle, and the local volume increase causes the liquid column 93 to form in the center of the nozzle 91. In this case, since a higher liquid surface speed increases the rate of volume increase in the center of the nozzle, a small-diameter liquid column 93 is formed at a higher growth rate, as shown in FIG. 32A. Conversely, as shown in FIG. 32B, if the liquid surface speed is lower due to a lower pressure applied to the liquid surface, the rate of volume increase is reduced, whereby the liquid column 93 has a larger diameter and a lower growth rate.

The size of the ink droplet 94 ejected by the meniscus control technique is substantially equal to the diameter of the liquid column 93. The speed (droplet speed) of the ejected ink droplet is substantially equal to the growth rate of the liquid column 93. Therefore, in order to allow very small ink droplet 94 to be ejected at a high speed, the liquid surface speed should be increased to cause an abrupt increase of the volume in the center of the nozzle, which is a crucial condition. It should be noted that the term which controls the liquid surface speed is the natural period $T_c$ of the pressure wave.

In other words, the vibrating speed of the meniscus 92 at the time of ink droplet ejection depends on the natural period $T_c$ of the pressure wave. As the natural period $T_c$ is reduced, the vibrating speed of the meniscus, i.e., the liquid surface speed is increased. As a result, a shorter natural period $T_c$ of the pressure wave is more advantageous in order to eject very small droplets by using the meniscus control technique.

Figure 33:
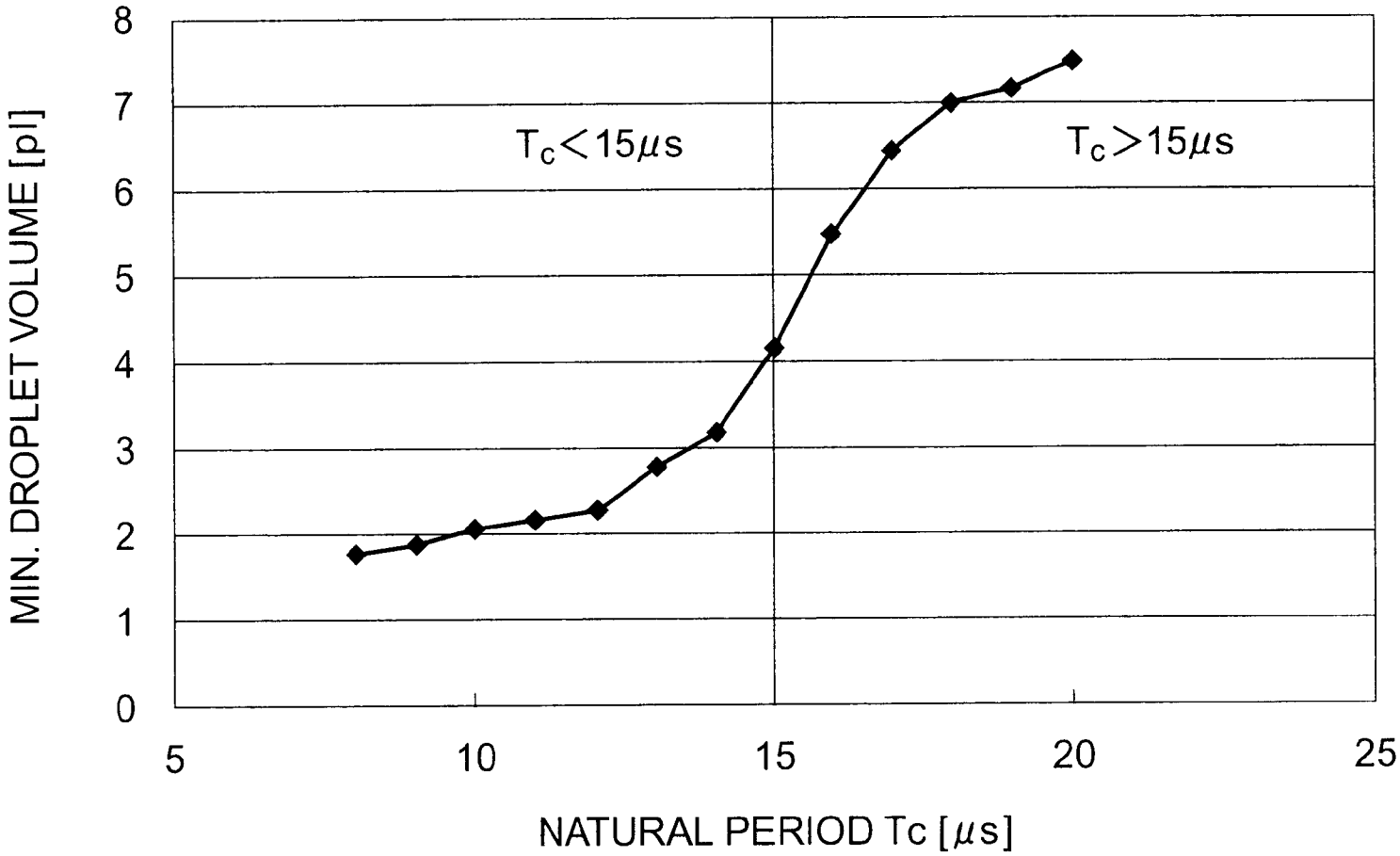
FIG. 33 is a graph showing the relation between the natural period of a pressure wave and the minimum droplet diameter that can be ejected.

FIG. 33 is a graph showing the result of examining the relation between the minimum droplet diameter by the meniscus control technique and the natural period $T_c$ of the pressure wave. As can be seen from the graph, a shorter natural period decreases the minimum droplet diameter. The minimum possible ink droplet volume depends on the nozzle size and the ink viscosity. In a typical inkjet recording head in which the nozzle diameter is in the range from 20 to 30 micrometers and the ink viscosity is in the range from 2 to 5 cps, the natural period $T_c$ should be 15 microseconds or lower, and more preferably 12 microseconds or lower, in order to allow a small droplet volume of 2 to 4 pl to be ejected for achieving high image quality recording.

To reduce the natural period $T_c$ is however inconsistent with the "ejection of large droplets" as described before. If the size of the pressure chamber is increased to "eject large droplets," the natural period of the pressure wave is extremely prolonged. This is because the natural period $T_c$ of the pressure wave depends on the sum $(c_0+c_1)$ of the acoustic capacitance $c_0$ of the vibrating member (including the diaphragm and the piezoelectric actuator) and the acoustic capacitance $c_1$ of the pressure chamber, and the natural period $T_c$ is longer for a larger-size pressure chamber and a larger-size vibrating member suitable for "ejecting large droplets." For example, an inkjet recording head ejecting an ink droplet having a large droplet volume of 10 pl and having a natural period of 10 microseconds can be provided with ease, whereas if the droplet volume is increased up to 20 pl then the natural period $T_c$ is also doubled up to about 20 microseconds, which is difficult to achieve.

According to the conventional techniques, a number of parameters related to the head structure are combined together in a trial-and-error manner to adjust the droplet volume and the natural period $T_c$ accordingly.

The inventors has found based on the result of various experiments that, in an inkjet recording head using a flexibly deforming piezoelectric actuator, the acoustic capacitance of the vibrating member is substantially only the parameter that can control the droplet volume and the natural period $T_c$. This finding led to the present invention, which is directed to achieving ejection of both "large droplets" and "small droplets" each having a prescribed size, and "increase in the nozzle density."

The thickness ($t_p$) of the piezoelectric actuator, the thickness ($t_v$) of the diaphragm, and the width (W) of the pressure chamber were experimentally varied for evaluating characteristics of the inkjet recording head. As a result, in the condition that satisfies $c_0 \geqq 2.0\times10^{-20}$ $m^5/N$, "large droplets" of at least 15 pl were ejected. On the other hand, in the condition that $c_0 < 2.0\times10^{-20}$ $m^5/N$ holds, such "large droplets" of at least 15 pl were not ejected, and a sufficient image density could not be provided.

According to the present invention, the acoustic capacitance $c_0$ of the vibrating member is defined to be $2.0\times10^{-20}$ $m^5/N$ or higher, and an ejection volume of at least 15 pl can be provided by the vibrating member, whereby large droplets each having a volume of at least 15 pl can be ejected from a single nozzle.

In a preferable inkjet recording head according to the present invention, the upper limit for the acoustic capacitance $c_0$ of the vibrating member is preferably set at $5.5\times10^{-19}$ $m^5/N$. The inventors have confirmed that when the acoustic capacitance $c_0$ is set at $2.0\times10^{-20}$ $m^5/N$ or higher, the "ejection of large droplets" can be achieved. On the other hand, if the acoustic capacitance $c_0$ is excessively large, the natural period of the pressure wave generated in the pressure chamber is increased, whereby a problem may occur in which the "ejection of small droplets" cannot be achieved. Based on the results of various experiments as will be described, the inventors have conceived that setting the upper limit for the acoustic capacitance $c_0$ at $5.5\times10^{-19}$ $m^5/N$ can prevent this problem.

When ejection was executed as an experiment under the condition that the acoustic capacitance $c_0$ is larger than $5.5\times10^{-19}$ $m^5/N$, large droplets of 15 pl or more were ejected, whereas small droplets of 4 pl or lower could not be obtained. As a result, it was confirmed by the inventors that in order to secure a large droplet volume of 15 pl or more and still secure a small droplet volume of 4 pl or smaller, it was optimum that the acoustic capacitance $c_0$ of the vibrating member was set in the range from $2.0\times10^{-20}$ $m^5/N$ to $5.5\times10^{-19}$ $m^5/N$.

In a preferable configuration of the inkjet recording head according to the present invention, the droplet volume of ink droplets ejected from the nozzle changes among a plurality of volumes in response to the control of the waveform of the driving voltage applied to the vibrating member. In this case, both of the low resolution recording together with large droplets and high image quality recording together with small droplets can be effectively achieved.

The maximum droplet volume of the ink droplets ejected from the nozzle is preferably 15 pl or more. In this case, the recording resolution can be set at 600 dpi or lower, and therefore the recording speed can be increased as well. The waveform of the driving voltage to be applied for ejecting an ink droplet of at least 15 pl preferably includes a first voltage change process to be applied in the direction to compress the volume of the pressure chamber and allow an ink droplet to be ejected, and a second voltage change process to be applied in the direction to expand the volume of the pressure chamber.

Alternatively, it is also preferable that the minimum droplet volume of ink droplets ejected from the nozzle be 4 pl or less. In this case, smooth image recording together with low granularity may be achieved in the highlight portion, which allows high image quality recording. The waveform of the driving voltage to be applied for ejecting an ink droplet of 4 pl or less preferably includes a first voltage change process to be applied in the direction to expand the volume of the pressure chamber, and a second voltage change process to be applied in the direction to compress the volume of the pressure chamber, thereby forming a liquid column of ink having a diameter smaller than the nozzle size, and ejecting a very small ink droplet from the tip of the liquid column.

The aspect ratios of the pressure chamber and the piezoelectric actuator as viewed in the thickness-wise direction of the diaphragm are each preferably set at about 1. The term "aspect ratio" as used herein refers to the ratio of the longest width to the shortest width of the vibrating member in the planar shape thereof. The aspect ratio set at about 1 allows the ejection efficiency per unit area to be maximized, whereby the inkjet recording head having a higher nozzle density can be provided. The planar shape of the vibrating member as viewed in the thickness-wise direction of the diaphragm can be any shape including a roughly regular triangle, a roughly square, a roughly regular hexagon and a roughly circular shape.

The planar area of each pressure chamber is preferably set in the range from 0.09 to 0.5 $mm^2$, and the thicknesses of the diaphragm and the piezoelectric actuator are preferably set in the ranges from 5 to 20 micrometers and 15 to 40 micrometers, respectively. In such as case, in an inkjet recording head having a pressure chamber with an aspect ratio of about 1, the acoustic capacitance $c_0$ of the vibrating member can be set in the range from $2.0\times10^{-20}$ $m^5/N$ to $5.5\times10^{-19}$ $m^5/N$. Therefore, the "ejection of large droplets" and the "ejection of small droplets" can both be achieved from a single nozzle.

The acoustic capacitance of the vibrating member is preferably set to be larger than the acoustic capacitance of the pressure chamber. In this case, the possibility of the abnormal meniscus vibration can be reduced. In other words, the meniscus vibration can be normalized, and the stability in ejection of ink droplets can be improved.

It is also preferable that the following expression be satisfied:

$$m_0<2.5\times10^{-4}T_c^2/c_c(kg/m^4)$$

wherein $T_c$ represents the natural period of the pressure wave generated in the pressure chamber, $c_c$ represents the composite acoustic capacitance of the vibrating member and the pressure chamber, and $m_0$ represents the inertance of the vibrating member. In this case, excitation of a vibrating system inherently residing in the inkjet recording head can be reduced, which in turn can reduce the influence by the meniscus abnormal vibration. Thus, an inkjet recording head having high ejection stability can be provided.

It is also preferable that the following expression be satisfied:

$$W_p\leqq(W-2\delta)$$

or $$W_p>(W+2\delta)$$

wherein W represents the width of the pressure chamber, δ represents the positional deviation of the center of the pressure chamber with respect to the center of the driving portion of the piezoelectric actuator, and $W_p$ represents the width of the piezoelectric actuator. In this case, the condition for supporting the edges of the piezoelectric actuator is constant, and therefore the robustness (insensitivity) of the piezoelectric actuator with respect to the positional deviation can be improved.

It is also preferable that the following expression be satisfied:

$$0.9(W-2\delta)\leqq W_p\leqq(W-2\delta)$$

wherein W represents the width of the pressure chamber, δ represents the positional deviation between the center of the pressure chamber and the center of the driving portion of the piezoelectric actuator, and $W_p$ represents the width of the piezoelectric actuator. In this case, even if a positional deviation is caused at the time of coupling the piezoelectric actuator with the pressure chamber, a change in the ejection efficiency can be significantly reduced to secure a further higher ejection efficiency.

Ink droplets ejected from the nozzle preferably attach onto a recording medium while achieving a recording resolution of 600 dpi or lower. In this case, the number of dots necessary for recording can be reduced, which is advantageous for high speed recording, and the printing quality of characters can be assured. Thus, both high speed recording and high image quality recording can be achieved. It is also preferable that the natural period of the pressure wave generated in the pressure chamber be set at 15 microseconds or lower. In this case, ink droplets having a small diameter can be ejected by using the meniscus control technique, whereby the image quality can be improved in outputting, for example, photographic images.

It is preferable that the piezoelectric actuator include a driving portion provided in a region corresponding to the pressure chamber, an electrode pad portion provided in a region corresponding to the outer wall of the pressure chamber and a bridge portion coupling together the driving portion and the electrode pad portion. In this case, the electrode pad portion does not prevent the piezoelectric actuator from deforming, whereby an inkjet recording head having high ejection efficiency can be provided. The bridge portion coupled to the driving portion in a position apart from the center of the driving portion reduces the restriction on the deformation of the driving portion, thereby increasing the ejection efficiency of the recording head.

It is also preferable that the nozzles be arranged two-dimensionally in a matrix. In this case, the number of nozzles in the head can be increased, thereby increasing the recording speed.

A dummy pattern is preferably provided to surround the outer periphery of the area for the piezoelectric actuators arranged. In this case, when the piezoelectric actuators are processed by sandblast processing in a fabrication process, the deterioration in the processing precision caused by side etching can be prevented. Thus, an inkjet recording head having an equal ejection efficiency can be provided. The dummy pattern may be also provided in the gap between the piezoelectric actuators arranged in the area. In this case, the effect of the side etching can be further reduced.

In a preferred embodiment of the inkjet recording head according to the present invention, a printed circuit board having therein a plurality of signal lines is provided. The printed circuit board is positioned to cover the top of the piezoelectric actuators two-dimensionally arranged in a matrix, and the piezoelectric actuator and the printed circuit board are electrically connected together by using bumps. In this case, in a high density matrix head, accurate electric connections can be provided to individual piezoelectric actuators. In other words, signal lines provided in a plane different from the plane of the vibrating member allows the arrangement of the signal lines not to degrade the high density arrangement of the pressure chambers.

The bumps are preferably made of a conductive core material and a bond material, wherein the outer periphery of the core material is coated with the bond material. In this case, since a gap is formed between the piezoelectric actuator and the printed circuit board, failures in the electric characteristic of the piezoelectric actuator caused by the contact of the piezoelectric actuator and the printed circuit board can be prevented. Thus, a highly reliable inkjet recording head can be provided. The core material is preferably formed into a semi-spherical shape. In this case, the contacted state of the piezoelectric actuators and the bumps can be equalized, stable electric connection is enabled, and the piezoelectric actuators can be prevented from being damaged at the time of the electric connection. The printed circuit board preferably includes a resin material and a metal conductor. In this case, the contacted state of the piezoelectric actuators and the bumps can be even more equalized.

Now, the relation between the performance characteristics of the vibrating member and the droplet volume will be described.

The vibrating member generates physical vibration in phenomenal terms and should therefore be a mechanical system. On the other hand, the inkjet recording head is considered as a combination system including an acoustic system for an ink flow passage and an electrical system for a driving circuit in addition to the mechanical system. These three systems can equivalently be converted into one another, because they can be expressed in the same form of differential equation. Therefore, these systems are all expressed in the form of the acoustic system, and the operation of the recording head is considered as the operation of a single acoustic circuit.

The performance characteristics of the vibrating member including the diaphragm and the piezoelectric actuator can be expressed simply by three parameters for the mechanical system, i.e., mass (kg), compliance (m/N), and damping coefficient (Ns/m). They may be equivalently converted into three acoustic parameters, i.e., inertance $m_0$ (kg/m$^4$), acoustic capacitance $c_0$ (m$^5$/N), and acoustic resistance $r_0$ (Ns/m$^5$).

Figure 1:
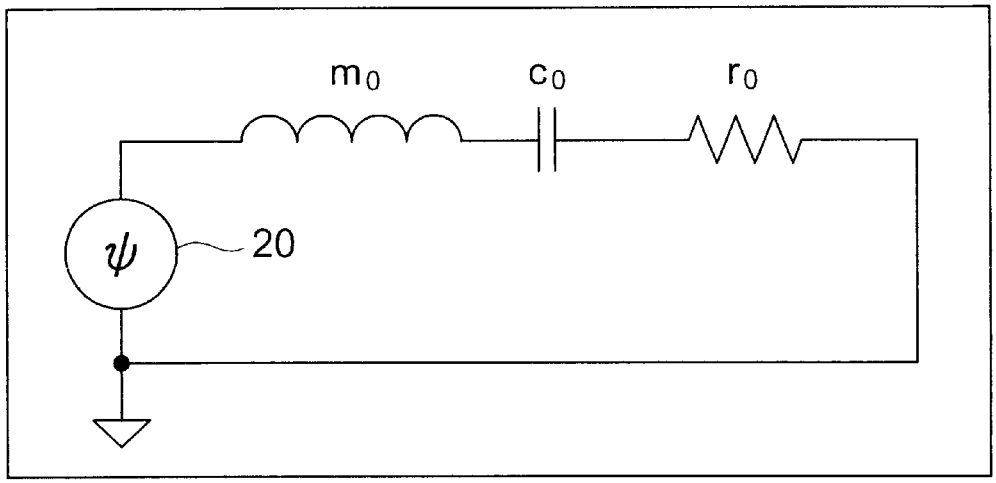
FIG. 1 is a diagram of an acoustic circuit of a vibrating member used in an inkjet recording head according to an embodiment of the present invention.
Figure 2A:
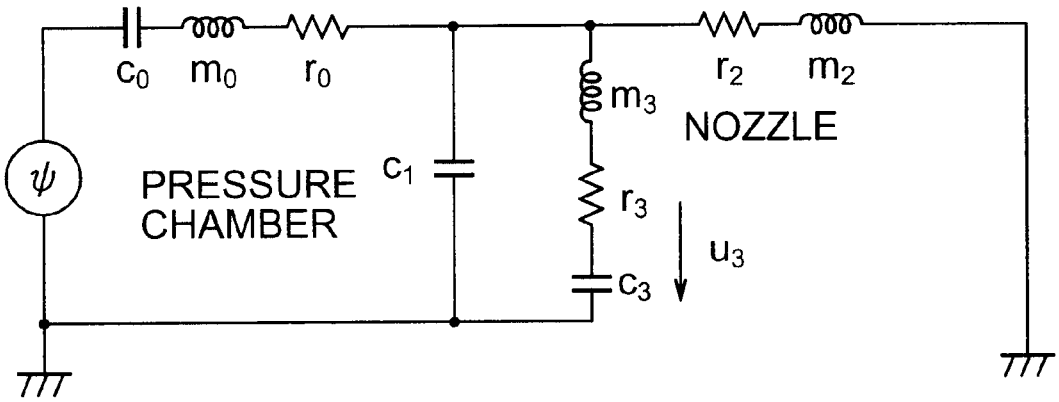
FIGS. 2A and 2B are equivalent electrical circuit diagrams for a single ejector.
Figure 34:
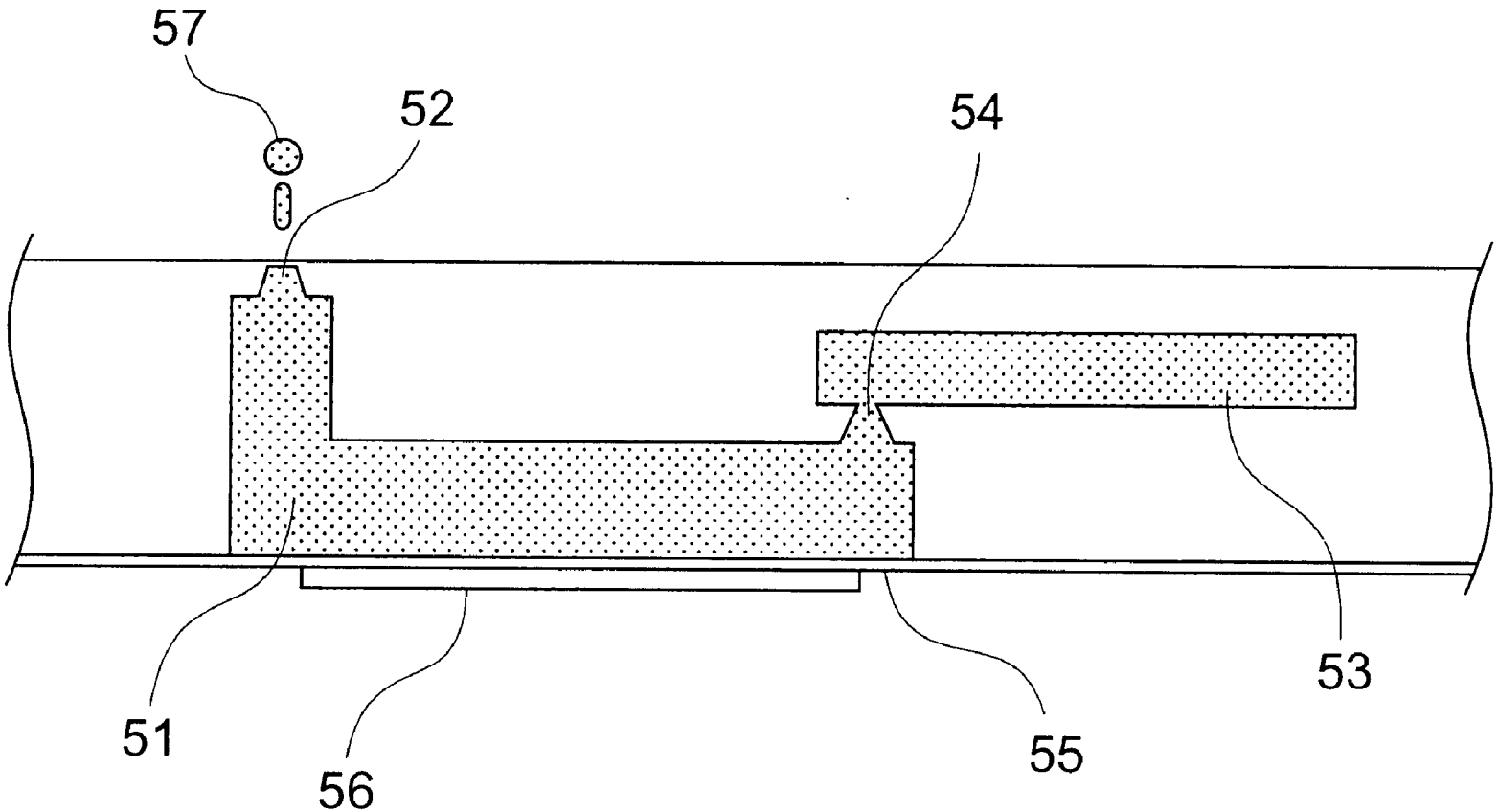
FIG. 34 is a sectional view showing the basic structure of a conventional inkjet recording head.

Using the acoustic parameters as described above, one vibrating member can be represented as an equivalent circuit (acoustic circuit) shown in FIG. 1, wherein $\phi$ represents pressure (Pa). FIG. 2A shows an equivalent circuit in which a vibrating member and a flow passage system are coupled together and the inkjet recording head shown in FIG. 34 is replaced by the equivalent circuit.

In the drawing, u represents the volume velocity (m$^3$/s), and the suffix 0 means "of the vibrating member", 1 "of the pressure chamber", 2 "of the ink supply passage", and 3 "of the nozzle". The circuit is analyzed using a circuit simulator or the like and changes in the volume velocity $u_3$ of the nozzle portion are examined, whereby the head characteristic including the ink droplet volume, the droplet speed and the natural period of the pressure wave can be obtained.

Figure 3A:
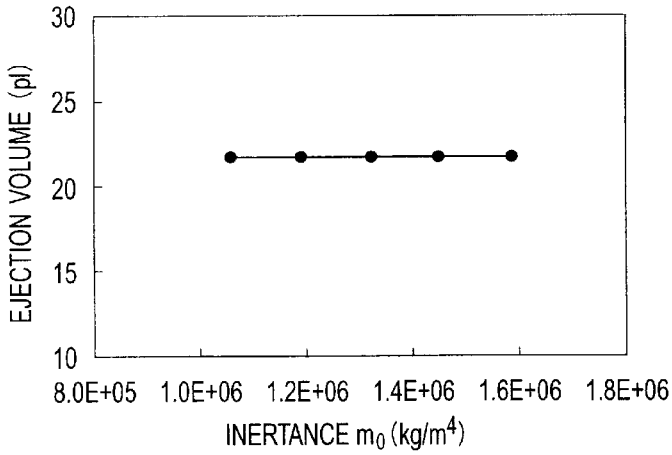
Figure 3B:
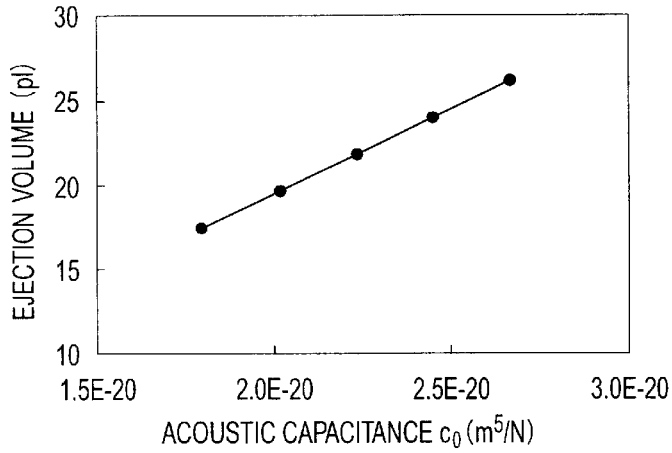
Figure 3C:
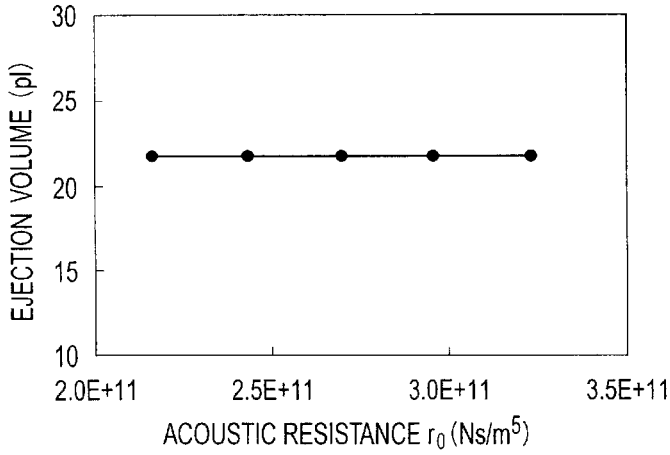

FIGS. 3A to 3C show results of examining the relation between the acoustic capacitance $c_0$, inertance $m_0$ and acoustic resistance $r_0$ of the vibrating member and the ejection volume $\delta V$ using the equivalent circuit shown in FIG. 2A. It should be noted that the ejection volume $\delta V$ is a parameter substantially in coincidence with the droplet volume q as will be described later. As can be seen from the results, $m_0$ and $r_0$ have little effect on the ejection volume $\delta V$ (droplet volume q), whereas $c_0$ greatly affects $\delta V$ and $\delta V$ increases with the increase of $c_0$. In this situation, it was confirmed that among the acoustic capacitance $c_0$, inertance $m_0$ and acoustic resistance $r_0$ of the vibrating member, only $c_0$ affected the ejection characteristic (or droplet volume q).

Figure 2B:
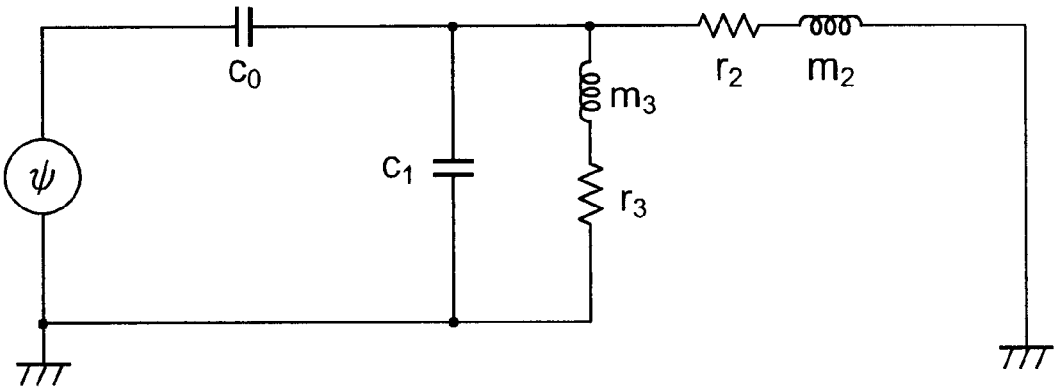

The inertance $m_0$ and the acoustic resistance $r_0$ of the vibrating member do not significantly affect the ejection characteristic (droplet volume), and the acoustic capacitance $C_3$ of the nozzle can be neglected compared to the acoustic capacitance $c_0$ of the vibrating member and the acoustic capacitance $c_1$ of the pressure chamber. Therefore, the circuit shown in FIG. 2A can be simplified and expressed by the circuit in FIG. 2B. In the expression, it is assumed that the following relation is established for the inertance and acoustic resistance at the nozzle and supply passage:

$$m_2 = k \cdot m_3$$

and $$r_2 = k \cdot r_3$$

Then, according to theoretical analysis, the volume velocity $u_3$ at the nozzle is expressed as follows when step-function-wise pressure $\phi$ is input:

$$u3(t) = \frac{c_o \psi}{\mathrm{cm}_3 Ec} \exp(-Dc \cdot t) \sin(Ec \cdot t) \tag{1}$$

$$c = c_0 + c_1$$

$$Ec = \sqrt{\frac{1 + \frac{1}{k}}{\mathrm{cm}_3} - Dc^2}$$

$$DC = \frac{r_3}{2m_3}$$

Figure 39A:
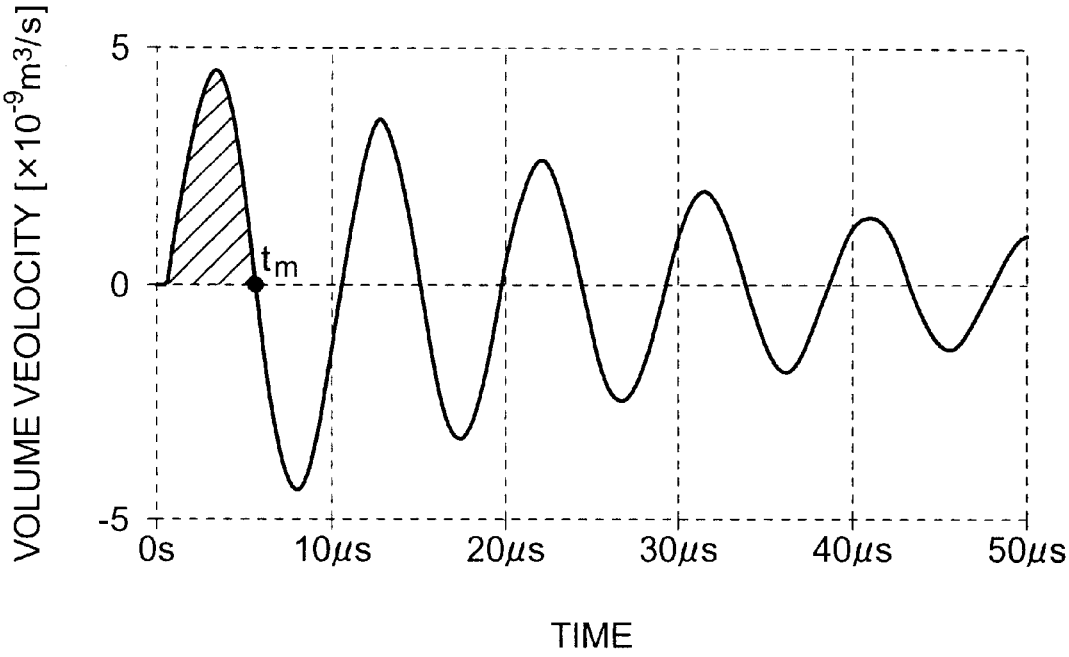
FIGS. 39A and 39B are graphs showing results of observing meniscus vibration (in normal and abnormal states)

The volume q(m$^3$) of an ink droplet (large droplet) to be ejected from the nozzle is substantially equal to the volume expressed by the shadowed area shown in FIG. 39A and therefore expressed as follows:

$$q = \int_0^{tm} u_3 \, dt \tag{2}$$

$$\approx 2 \frac{m_2}{m_2 + m_3} \cdot V \cdot \phi \cdot c_0$$

$$\approx 2 \frac{m_2}{m_2 + m_3} \cdot \Delta V$$

$\phi$[Pa/V] is an electro-acoustic conversion coefficient (=$\phi$/V) and a parameter representing the magnitude of the pressure generated per unit voltage. In the inkjet recording head using a flexibly deforming piezoelectric actuator, the electro-acoustic conversion coefficient $\phi$ is a very important parameter that affects the droplet volume (ejection efficiency). The relation between the head structure and $\phi$, however, had never been examined into details in the past. Thus, the inventors examined the relation between the head structure and $\phi$ through structural analysis using the finite element method.

In order to obtain $\phi$ by structural analysis, the following method may be employed. The vibrating member is modeled, and the deformed state of the modeled vibrating member in response to applied voltage V is produced. Then, the vibrating member is applied with pressure, and the pressure p necessary to nullify the deformation of the vibrating member is produced. Based on the value of p, the value of $\phi$ is produced from $\phi=p/V$. The ejection volume $\delta V$ at the time of the deformation of the vibrating member in response to the pressure p thus applied is produced. Then, the acoustic capacitance $c_0$ is calculated from $c_0=\delta V/p$.

Figure 4A:
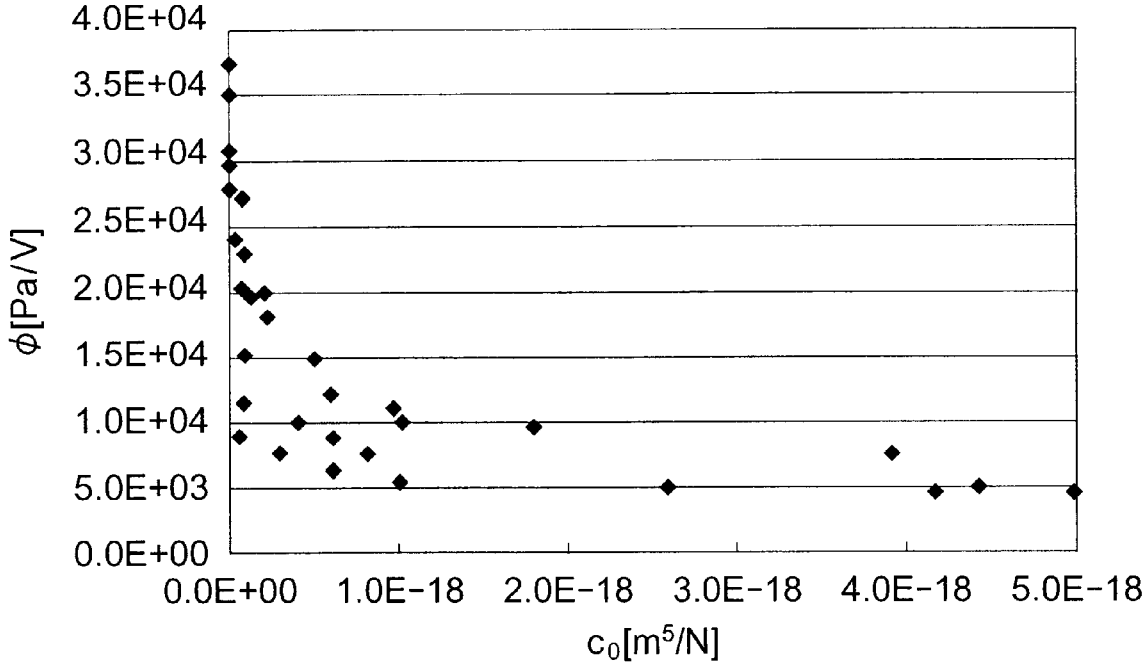
FIGS. 4A to 4B are graphs each showing the relation between $c_0$ and $\phi\cdot c_0$.

FIG. 4A is a graph showing the values of $c_0$ and $\phi$ produced by structural analysis depending on the parameters related to the head structure while the parameters were varied in a wide range. More specifically, the areas of the pressure chamber and the piezoelectric actuator in the planar view thereof were changed in the range from $9\times10^{-8}$ to $1\times10^{-6}$ $m^2$. The aspect ratios of the pressure chamber and the piezoelectric actuator in the shapes as viewed in the planar view (hereinafter referred to as planar shapes) were changed in the range from 1 to 20. As for the thickness of the diaphragm, the range was from 5 to 20 micrometers for a metal plate such as a stainless steel plate and 20 to 100 micrometers for a polyimide film. While changing the thickness of the piezoelectric actuator in the range from 10 to 50 micrometers and the piezoelectric constant in the range from $1\times10^{-10}$ to $3\times10^{-10}$ m/V, the structural analysis was performed to various combinations, and the values of $\phi$ and $c_0$ were produced. As a result, the acoustic capacitance $c_0$ varied in the range from $1\times10^{-21}$ to $5\times10^{-18}$ $m^5/N$ and $\phi$ varied in the range from $4\times10^3$ to $4\times10^4$ Pa/V.

Figure 4B:
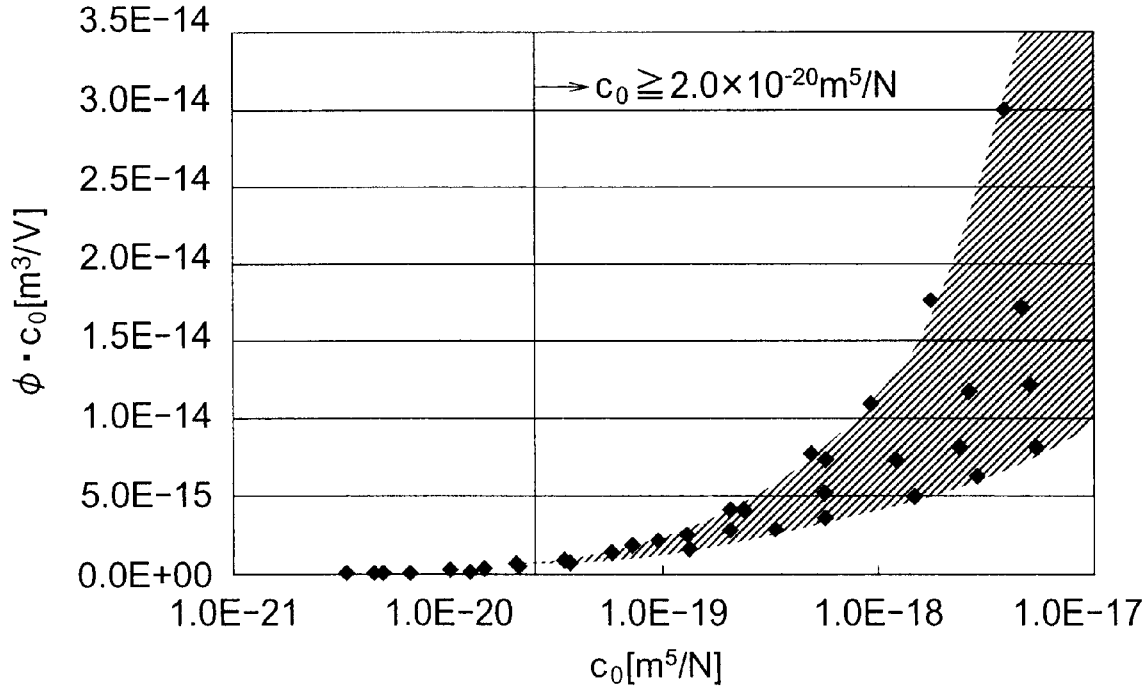

Based on the results of analysis as described above, the relation between $c_0$ and $\phi\cdot c_0$ (parameter to determine the droplet volume per unit voltage, see the expression (2)) was examined and the result is given in FIG. 4B. It was clearly established based on the result that in order to obtain a large droplet volume (large $\phi\cdot c_0$ value), the relation between $c_0$ and $\phi\cdot c_0$ should, in general, satisfy the following expression:

$$c_0 \geqq 2.0\times10^{-20}\ m^5/N$$

although the range was spread in the shadowed area in the graph.

In more detail, in the inkjet recording head using the flexibly deforming piezoelectric actuator, the condition expressed by the following expression is important in order to secure a large droplet volume (ejection efficiency):

$$c_0 \geqq 2.0\times10^{-20}\ m^5/N$$

The acoustic capacitance $c_0$ is a parameter to represent the rigidity of the vibrating member, and a large $c_0$ value means that the vibrating member easily bends, which also means that a large ejection volume $\delta V$ is easily generated. The value $2.0\times10^{-20}$ $m^5/N$ may be suitable as the lower limit for the acoustic capacitance $c_0$ in order to obtain a large droplet of 15 pl or more that allows recording at a low resolution of 600 dpi or lower, as will be described below.

Figure 5:
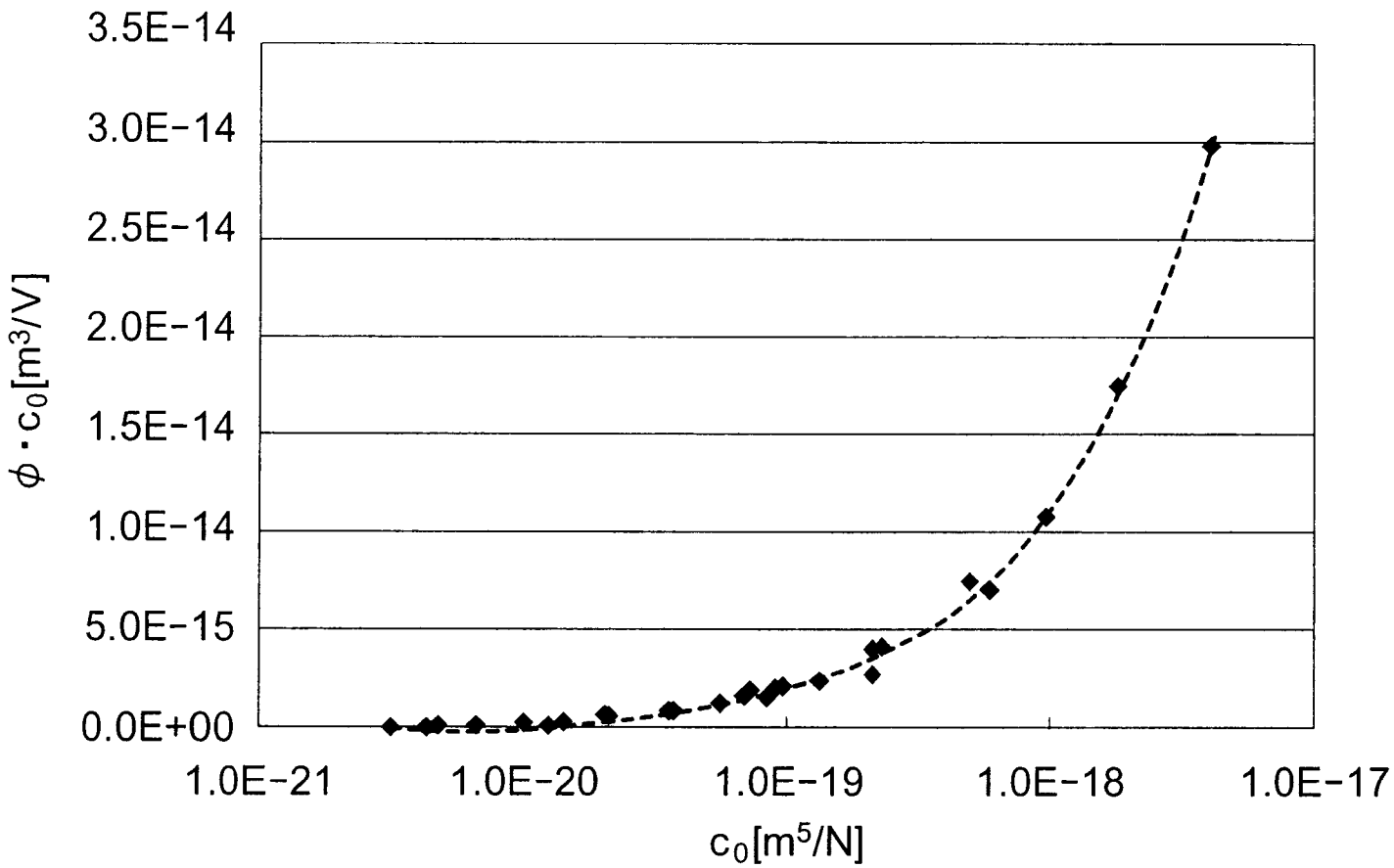
FIG. 5 is a graph showing the relation between $c_0$ and $\phi_{\cdot c0}$.
Figure 6:
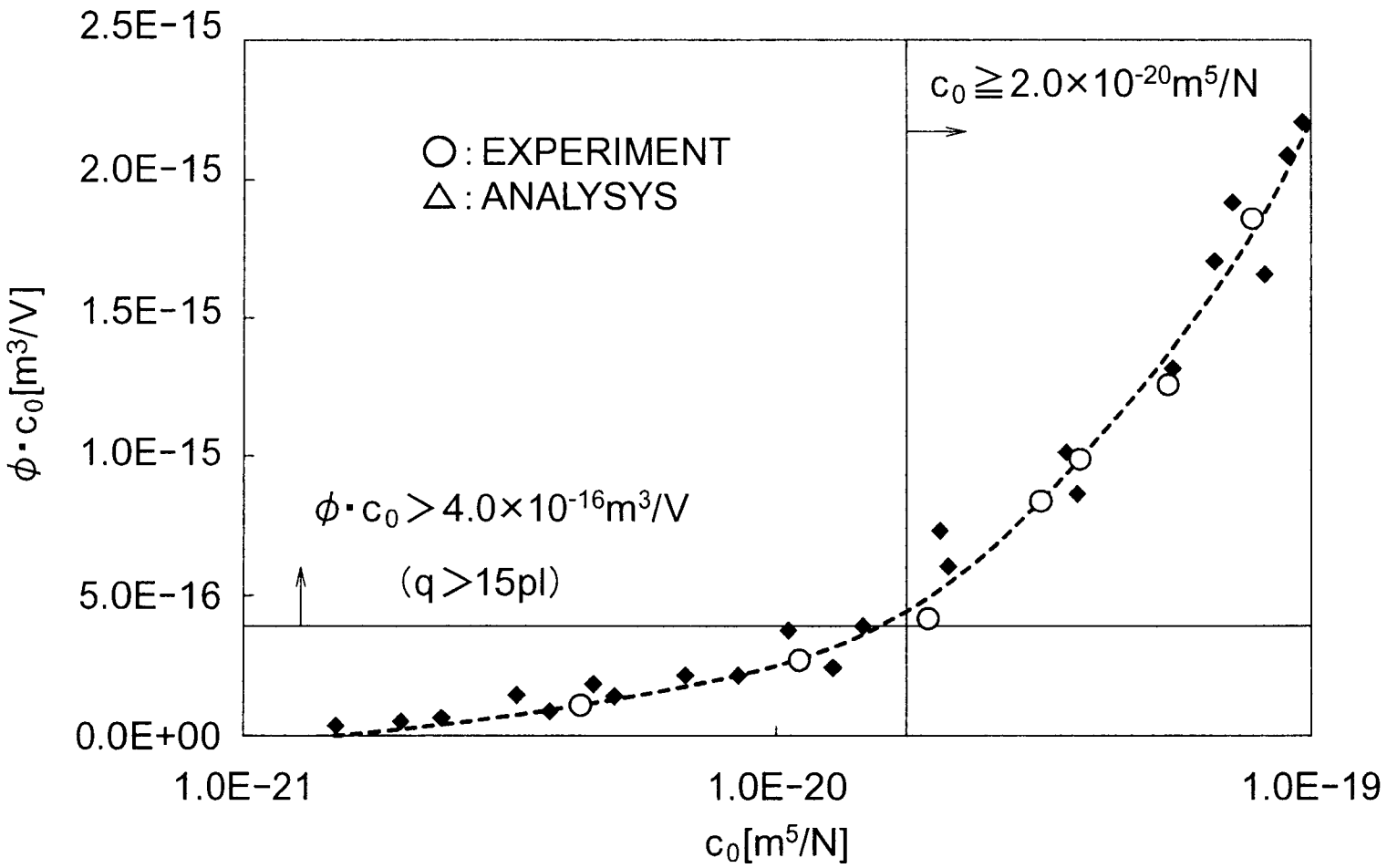
FIG. 6 is a graph showing the relation between $c_0$ and $\phi\cdot c_0$.

As the optimum and general conditions for fabricating an inkjet recording head in practice, the diaphragm is made of a metallic material (such as stainless steel and nickel), and the piezoelectric constant is set at about $3\times10^{-10}$ m/V, whereby the relation between $c_0$ and $\phi\cdot c_0$ is such as shown in FIGS. 5 and 6.

FIG. 5 is another graph representing the relation between $c_0$ and $\phi\cdot c_0$, and FIG. 6 is a graph showing a part of FIG. 5 in an enlarged state. It was clearly established that for the fixed diaphragm material and piezoelectric constant, the relation between $c_0$ and $\phi\cdot c_0$ was substantially plotted on a single curve if the diaphragm thickness, the piezoelectric actuator thickness and the aspect ratio are varied. This means that, among the parameters controlling the droplet volume q, $\phi$ can be expressed as a function of $c_0$.

In a general inkjet recording head, $m_2\approx m_3$ holds for $m_2$ and $m_3$ shown in the above expression (2) as will be described. In view of the driving circuit and the power supply cost, the upper limit for the applied voltage V is about 40 volts. Therefore, among the parameters in the expression (2), $m_2/(m_2+m_3)$ and the applied voltage V cannot arbitrarily be changed in practice and $\phi$ depends on $c_0$. As a result, it is concluded that $c_0$ is substantially the only parameter for controlling the droplet volume q.

Now, the acoustic capacitance $c_0$ necessary for obtaining a droplet volume of at least 15 pl is produced from the result in FIG. 6. As described above, since $m_2/(m_2+m_3)\approx1/2$ and $V\leqq40$ V hold, $\phi\cdot c_0$ should be at least $4\times10^{-16}$ $m^3/V$ in order to secure a droplet volume of at least 15 pl. When this is applied to the graph in FIG. 6, $c_0>2.0\times10^{-20}$ $m^5/N$ results. More specifically, in order to obtain a droplet volume of at least 15 pl suitable for low resolution recording using the inkjet recording head having the flexibly deforming piezoelectric actuator, $c_0>2.0\times10^{-20}$ $m^5/N$ is an important condition.

As described in the foregoing, the present invention is based on the finding that in the inkjet recording head using the flexibly deforming piezoelectric actuator, $c_0$ is substantially the only parameter that controls the droplet volume and thus defines the lower limit suitable for $c_0$. According to the conventional techniques, various parameters related to the head structure are randomly combined in a trial-and-error manner to control the droplet volume. On the other hand, the controlling parameter $c_0$ was singled out, and the optimum range therefor was clearly defined. This is significantly effective in optimum head designing.

Now, the shape of the pressure chamber to achieve both "ejection of large droplets" and "increase in the nozzle density" will be considered. As described above, $c_0$ is substantially the only parameter controlling the droplet volume, and therefore $c_0$ per unit area should be maximized in order to achieve both "ejection of large droplets" and "increase in the nozzle density."

Figure 7:
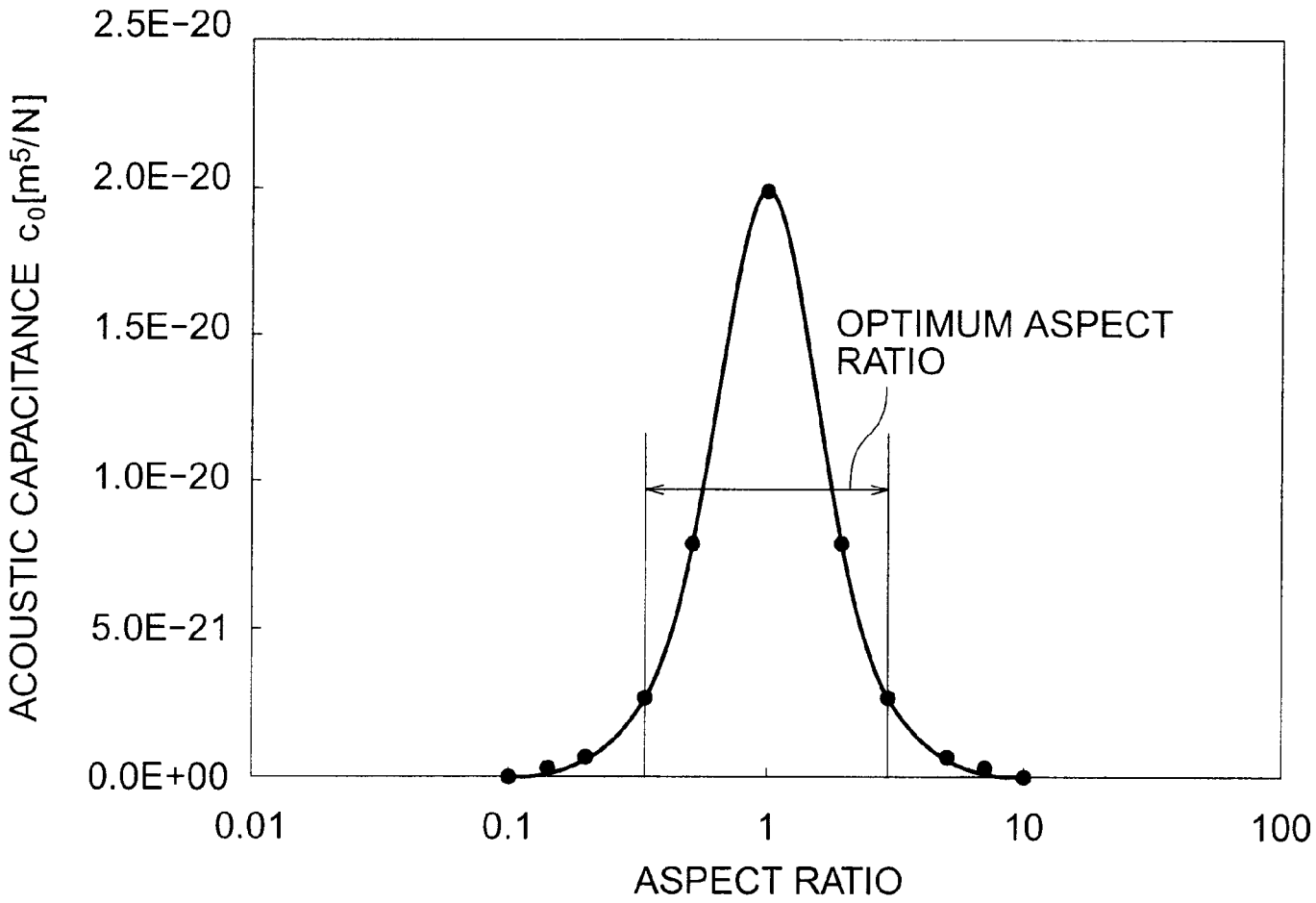
FIG. 7 is a graph showing the effect of the aspect ratio of a pressure chamber.
Figure 8A:
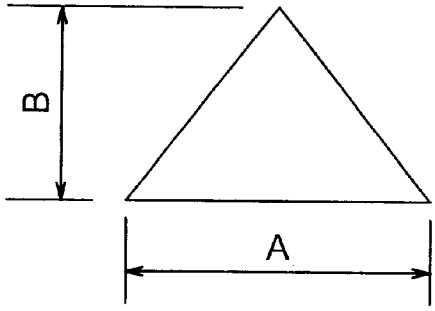
FIGS. 8A to 8D are diagrams for illustration of the definition of the aspect ratio A/B.
Figure 8B:
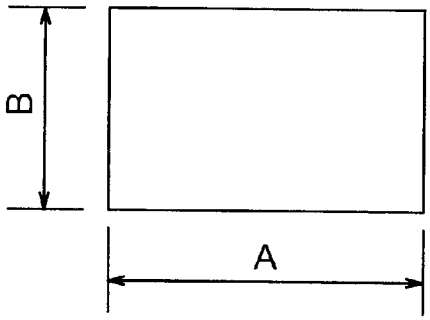
Figure 8C:
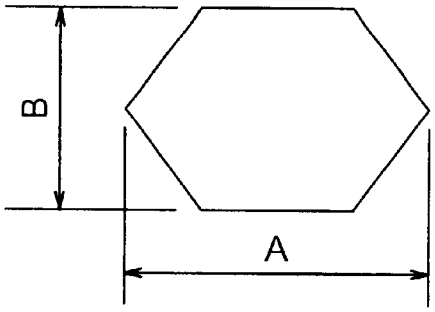
Figure 8D:
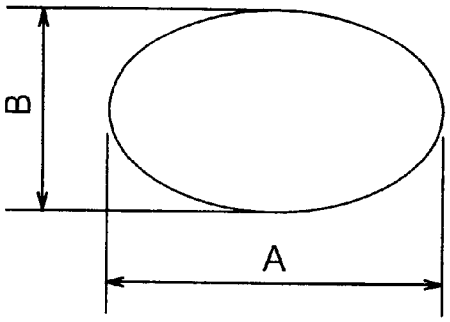

The acoustic capacitance $c_0$ greatly depends on the shape of the vibrating member. The shape of the vibrating member that allows $c_0$ per unit area to be maximized was examined. FIG. 7 shows the values of $c_0$ obtained for quadrangle pressure chambers in different shapes that have the same area and different aspect ratios. As can be seen from FIG. 7, when the aspect ratio of the planar shape of the pressure chamber is close to 1, i.e., when the shape is more approximated to square, the acoustic capacitance $c_0$ is larger. When a pressure chamber having a planar shape with an aspect ratio close to 1 is used, a large acoustic capacitance $c_0$ can be obtained for a small occupied area, which is advantageous in improving the nozzle density.

As in the results shown in FIG. 7, in order to increase the ejection efficiency per unit area, the aspect ratio of the pressure chamber should be at least in the range from 0.3 to 3. The aspect ratio is preferably set in the range from 0.8 to 1.2. In this case, the reduction in the ejection efficiency can be at most 30% of the optimum condition when the aspect ratio is equal to 1.

The term "aspect ratio" refers to the ratio (B/A) between the longest width (A) and the shortest width (B) in the planar shapes of the pressure chambers as shown in FIGS. 8A to 8D, which are used for illustration of the definition of the aspect ratio. When the aspect ratio of the planar shape of a pressure chamber is approximately 1, the aspect ratio of the vibrating member is also 1. The vibrating member includes a diaphragm and the driving part of the piezoelectric actuator (which will be described later), which has a shape substantially the same as the planar shape of the pressure chamber. Therefore, the aspect ratio of the vibrating member is also about 1.

FIG. 7 shows the result of examination of a quadrangle pressure chamber including square. For the quadrangle shapes, and for other polygonal shapes such as a triangle, a pentagon, and a hexagon and an ellipse, it was confirmed that $c_0$ was maximized when the aspect ratio=1. The optimum condition that the aspect ratio=1 can be applied to general pressure chambers having planar shapes other than the quadrangle.

Figure 9:
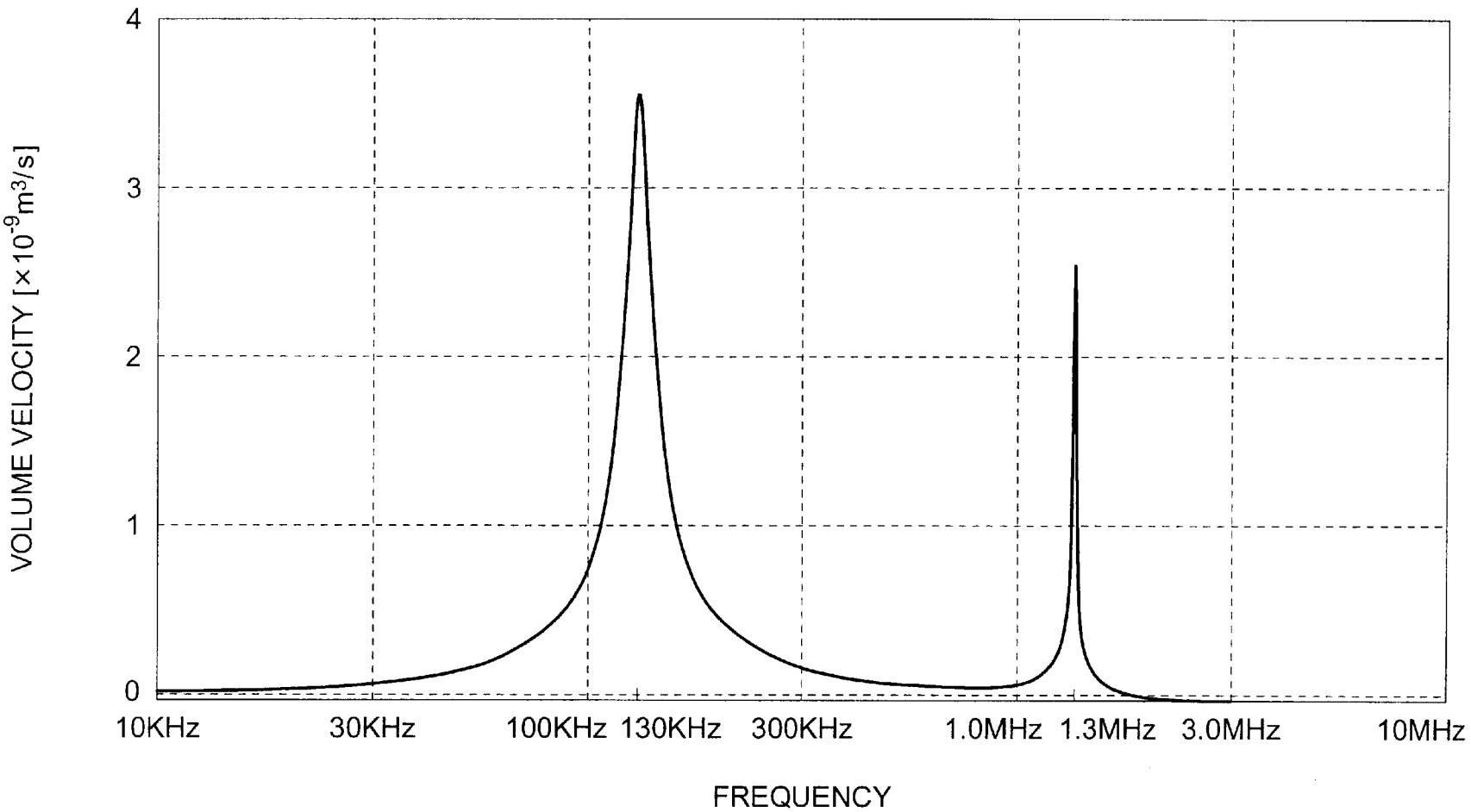
FIG. 9 is a graph showing the frequency response of the equivalent circuit shown in FIG. 2A.
Figure 10:
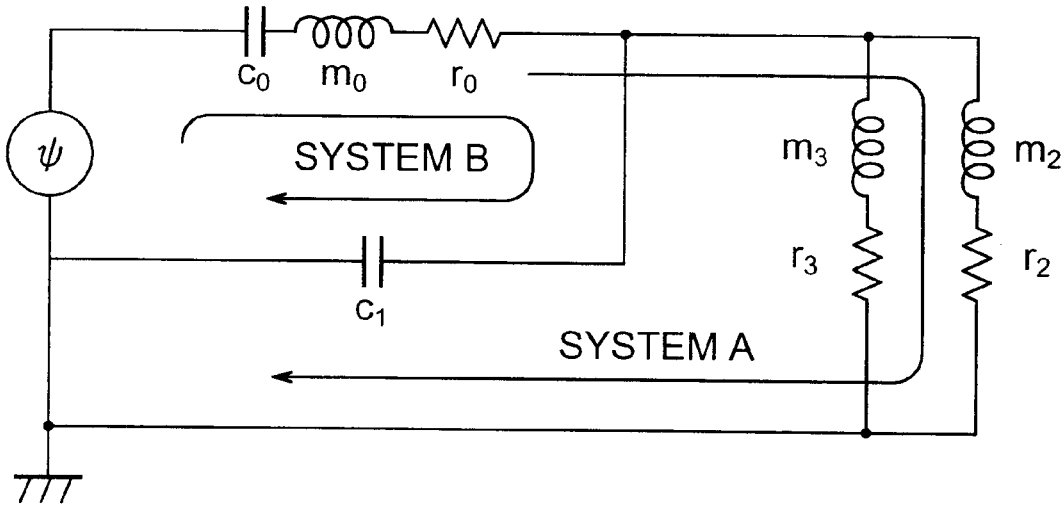
FIG. 10 is a diagram of an equivalent electrical circuit for a single ejector.

The cause for abnormal meniscus vibration shown in FIG. 39A will now be described. FIG. 9 is a graph showing the result of examining the frequency response of the equivalent electrical circuit in FIG. 2A. In the graph, there are peaks at 130 kHz and 1.3 MHz, and therefore the circuit has two resonance frequencies. FIG. 10 shows an equivalent electrical circuit of a single ejector, converted from the equivalent electrical circuit in FIG. 2A. When the circuit is expressed differently in this manner, it is clearly shown that there are two vibrating systems A and B.

Figure 39B:
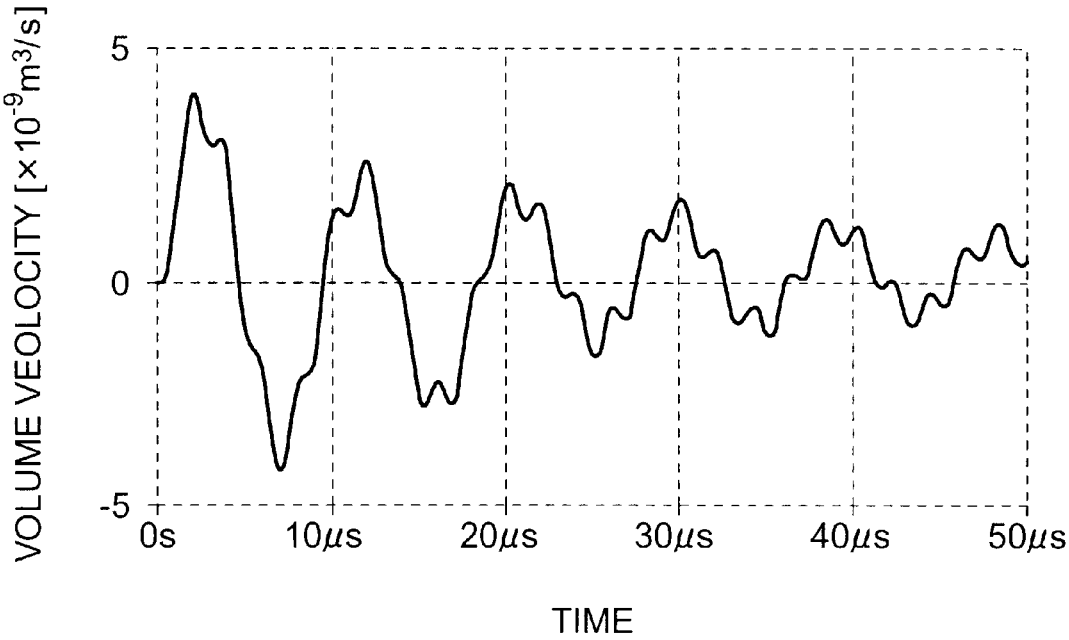

It is considered that those two resonance frequencies in FIG. 9 correspond to the resonance frequencies of the vibrating systems A and B in FIG. 10. It is assumed therein that the normal meniscus vibration used for ink droplet ejection is caused by the vibrating system A, on which short-cycle vibration caused by the vibrating system B is superposed. Thus, it will be understood how the meniscus vibration as shown in FIG. 39B is generated. The natural period $T_c$ of the vibrating system A can be expressed as follows:

$$Tc = 2\pi\sqrt{\frac{m_2 m_3}{m_2 + m_3}\cdot(c_0 + c)_1} \tag{3}$$

In the vibrating system A, acoustic capacitances $c_0$ and $c_1$ are connected in parallel, which allows the natural period $T_c$ of the meniscus vibration to be controlled by $c(=c_0+c_1)$.

On the other hand, the natural period $T_B$ of the vibrating system B can be expressed as follows:

$$T_B=2\pi\sqrt{\text{im}_{0+i\cdot c_c}} \tag{4}$$

In the expression (4), $c_c$ is the composite acoustic capacitance resulting from connecting in series the acoustic capacitance $c_0$ of the vibrating member and the acoustic capacitance $c_1$ of the pressure chamber, and is expressed as follows:

$$c_c = \frac{1}{\frac{1}{c_0} + \frac{1}{c_1}} \tag{5}$$

More specifically, the vibrating system B is controlled based on the composite acoustic capacitance $c_c$ of the serially connected $c_0$ and $c_1$. The vibration of vibrating system B is different from the normal mode vibration of the vibrating member itself generated in the inkjet recording head with the vertical-vibrating-type piezoelectric actuator described in JP Patent Laid-Open Publication No. Hei. 6-171080. The vibrating system B is one of the vibrating systems formed only when the vibrating member and the passage system (pressure chamber) are coupled together rather than a normal vibration system formed by the vibrating member itself.

As described above, for the flexibly deforming piezoelectric actuator, there are two vibrating systems in the recording head. Therefore, in order to provide normal meniscus vibration, the effect of the vibrating system B should be reduced. To this end, the vibrating amplitude of the vibrating system B should be small (condition 1), and $T_B \ll T_C$ should hold (condition 2). In the following description, how to satisfy these two conditions will be detailed.

The response of the vibrating system B to input of step-function-wise pressure $\phi$ can be expressed as follows:

$$\begin{aligned} uB(t) &= \frac{\psi}{m_0 E_0}\exp(-D_B\cdot t)\cdot\sin(E_B\cdot t) \\ &\approx \psi\cdot\sqrt{\frac{c_c}{m_0}}\exp(-D_B\cdot t)\sin(E_B\cdot t) \\ E_B &= \psi\sqrt{\frac{1}{c_c m_0} - D_B^2} \\ D_B &= \frac{r_0}{2m_0} \end{aligned} \tag{6}$$

In other words, the amplitude of the volume velocity $u_B$ generated by the vibrating system B is in proportion to $c_c^{1/2}$, and therefore in order to reduce the amplitude of the vibrating system B (condition 1), $c_c$ should be set to be small. It should be noted, however, that this should not affect the amplitude and natural period of the primary meniscus vibration (vibrating system A), and therefore $c(=c_0+c_1)$ should be minimized in prescribed conditions.

Figure 11:
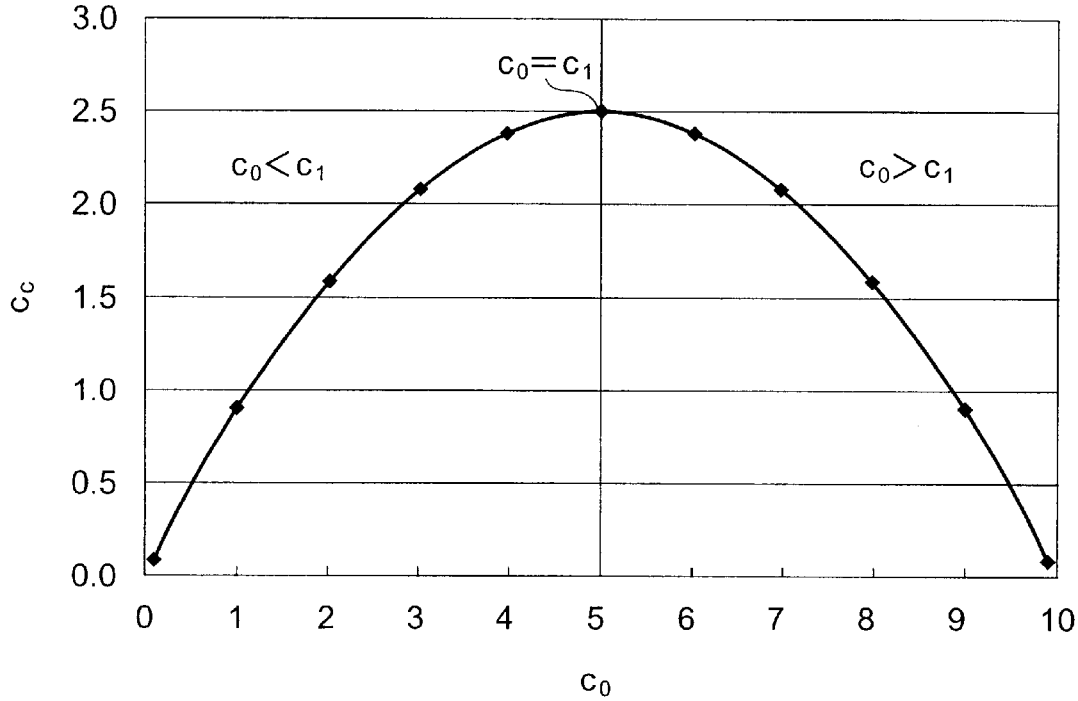
FIG. 11 is a graph for illustration of suitable balance between the acoustic capacitance $c_0$ of the vibrating member and the acoustic capacitance $c_1$ of the pressure chamber.

FIG. 11 is a graph showing changes in $c_c$ based on the value of $c_0$. The graph is produced by calculation based on the relation $c_0+c_1=10$. As can be seen from the graph, in order to reduce $c_c$, the relation between $c_0$ and $c_1$ should be unbalanced, in other words, $c_0>c_1$ or $c_1<c_0$ should hold. It should be noted, however, that when $c_0$ is reduced, the droplet volume q is reduced, and therefore $c_0>c_1$ should hold in order to secure an enough droplet volume and still reduce the amplitude of the vibrating system B.

The acoustic capacitance $c_1$ of the pressure chamber is in proportion to the volume $W_1$ of the pressure chamber as in the following expression:

$$c_1 = \frac{W_1}{\kappa\cdot\alpha} \tag{7}$$

where $\kappa$ is the bulk modulus (Pa) of ink, and $\alpha$ is a correction factor ($0<\alpha<1$).

In an inkjet recording head that ejects a droplet volume of at least 15 pl, the lower limit for the bottom area of the pressure chamber should be about $9\times10^{-8}$ $m^2$, and the lower limit for the height of the pressure chamber should be about 50 micrometers in order to secure the fluidity of the ink. Therefore, the acoustic capacitance $c_1$ of the pressure chamber is at least $2\times10^{20}$ $m^5/N$. As a result, in order to reduce the vibration amplitude of the vibrating system B, $c_0 \geqq 2\times10^{-20}$ $m^5/N$ should be established. Thus, it is concluded that, for the purpose of preventing the effect of the vibrating system B and obtaining stable meniscus vibration, $c_0 \geqq 2\times10^{-20}$ $m^5/N$ is an important condition.

In order to reduce the influence by the vibrating system B on the vibrating system A, to establish the relation $T_B << T_c$ (condition 2) is also important. More specifically, if the natural period $T_B$ of the vibrating system B is sufficiently smaller than $T_c$, the substantial influence upon the meniscus behavior can be kept small. The natural period $T_B$ of the vibrating system B is expressed by the expression (4), and therefore $c_c$ and $m_0$ should be small in order to reduce $T_B$.

Based on the results of fluid simulation and actual ejection experiments, it was found that $T_B < T/10$ was preferable. Therefore, $m_0$ should be set so that the following condition holds:

$$m_0 < \frac{1}{c_c}\left(\frac{Tc}{20\pi}\right)^2 = 2.53\times10^{-4}\frac{Tc^2}{c_c} \tag{8}$$

As described in the foregoing, the present invention is based on the finding that the abnormal meniscus vibration shown in FIG. 39B is caused by the effect of the second vibrating system (vibrating system B) included in the head and that the adverse effect of the vibrating system B can be suppressed in certain conditions. It should be noted that to the inventors' knowledge, there has been no reference to or description about the presence of such vibrating system B and its influence in an inkjet recording head having a flexibly deforming piezoelectric actuator.

As in the foregoing, in view of the "ejecting large droplets" and "normalizing meniscus vibration (reducing the effect of the vibrating system B)", a larger acoustic capacitance $c_0$ provides more advantage. On the other hand, as can be seen from the expression (3), the natural period $T_c$ increases with the increase of $c_0$. As described above, in order to eject very small droplets by using the meniscus control technique, the natural period $T_c$ should not be more than a specified value. In more detail, $T_c$ should be 15 microseconds or less. Then, in view of setting the natural period $T_c$ to a small value, the upper limit for $c_0$ will be considered hereinafter.

As in the expression (3), $T_c$ is in proportion to $m_2 \cdot m_3/(m_2+m_3)^{1/2}$. The inertance m is a parameter determined based on the sectional area A ($m^2$) and the length "1" (m) of the tube as in the following expression:

$$m = \frac{\rho \cdot l}{A} \tag{9}$$

wherein ρ represents the density of ink ($kg/m^3$).

In a typical inkjet recording head, the inertance $m_3$ of the nozzle and the inertance $m_2$ of the supply passage are set to be substantially equal. This is because if $m_3 >> m_2$, then the refill speed, i.e., the speed at which ink is supplemented after droplets are ejected, is high whereas the ejection efficiency is lowered (see the expression (2)). On the other hand, if $m_3 << m_2$, then the ejection efficiency increases whereas the refill speed is lowered. Therefore, in a typical inkjet recording head, $m_2 \approx m_3$ holds in order to secure a suitable ejection efficiency and increase the refill speed.

When the nozzle has a diameter of 30 micrometers or less, a length of 20 micrometers or more, and a taper angle of 15 degrees or less, it follows that $m_3$ is $2\times10^7$ $kg/m^4$ or more. Therefore, the lower limit for $m_2 \cdot m_3/(m_2+m_3)$ is about $1\times10^7$ $kg/m^4$.

As described above, the lower limit for the acoustic capacitance $c_1$ of the pressure chamber is $2\times10^{-20}$ $m^5/N$. Therefore, from the expression (3), in order to obtain a natural period $T_c$ of 15 microseconds or less, the acoustic capacitance $c_0$ should be $5.5\times10^{-19}$ $m^5$ or less. In more detail, for the natural period $T_c$, there are various determination factors (parameters) similarly to the case of droplet volume q, whereas in order to set $T_c$ to be small, $c_0$ is substantially the only controlling parameter. In order to obtain a natural period $T_c$ of 15 microseconds suitable for small droplet ejection, the acoustic capacitance $c_0$ should be $5.5\times10^{-19}$ $m^5/N$ or less.

Consequently, in the inkjet recording head using the flexibly deforming piezoelectric actuator, the droplet volume q and the natural period $T_c$ are controlled by the acoustic capacitance $c_0$ of the vibrating member, and in view of the upper and lower limits for the other parameters, there is an optimum range for $c_0$. In more detail, when the acoustic capacitance $c_0$ satisfies the following condition, both "ejection of large droplets" and "ejection of small droplets" can be achieved.

$$2.0\times10^{-20} \leqq c_0 \leqq 5.5\times10^{-19} (m^5/N) \tag{10}$$

When $c_0 > c_1$ holds and the condition represented by the expression (8) is satisfied, the effect of the second vibrating system (vibrating system B) formed in the head can be reduced, and accordingly an inkjet recording head having higher ejection stability and reliability can be provided. Furthermore, by setting the aspect ratio of the pressure chamber at about 1 so that the $c_0$ per unit area can be maximized, an inkjet recording head having a high nozzle density can be provided.

Now, the present invention is more specifically described based on the preferred embodiments thereof with reference to accompanying drawings, wherein similar constituent elements are designated by similar reference numerals.

First Embodiment

Figure 12:
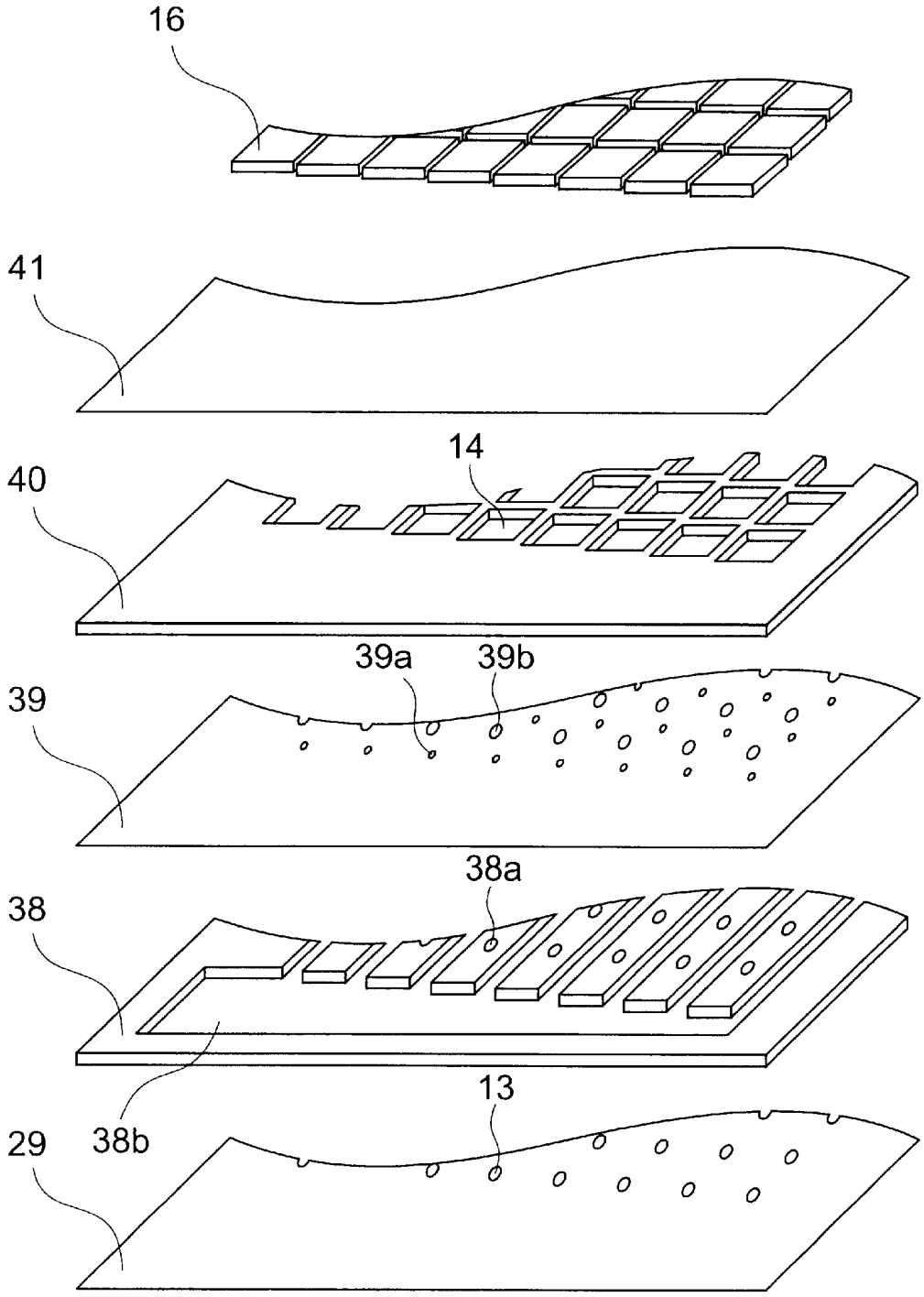
FIG. 12 is a perspective view of an inkjet recording head according to a first embodiment of the invention in an exploded manner.

FIG. 12 is a perspective view showing an inkjet recording head according to the present embodiment in an exploded manner. According to the present embodiment, specific structures of a vibrating member to fulfill the condition expressed as $c \geqq 2.0\times10^{-20}$ $m^5/N$ were examined, modeled and experimented.

In the inkjet recording head, there is a nozzle plate 29 having a plurality of nozzles 13 formed in a matrix of rows and columns. On the nozzle plate 29, there are an ink pool plate 38, an ink supply plate 39, a pressure chamber plate 40 having a plurality of pressure chambers 14, and a diaphragm 41 forming a part of the wall surfaces of the pressure chambers 14. A plurality of piezoelectric actuators 16 are coupled to the diaphragm 41 to oppose the respective pressure chambers 14.

Figure 13:
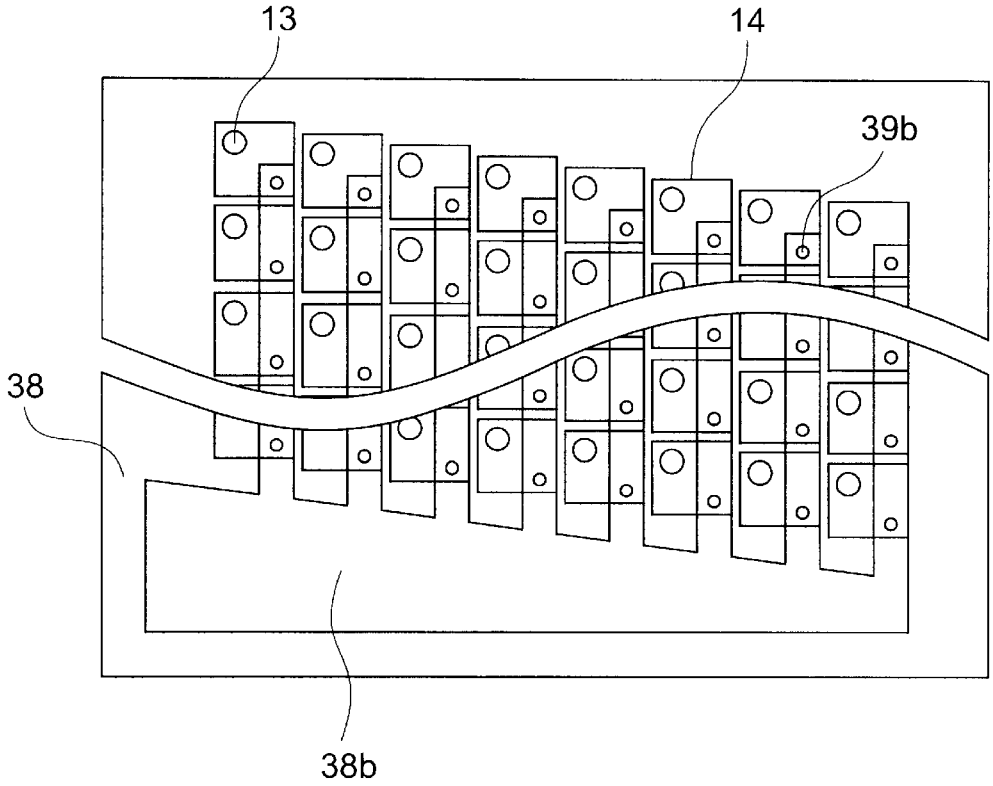
FIG. 13 is a partly phantom, top plan view of the structure shown in FIG. 12.

FIG. 13 is a top plan view of the structure shown in FIG. 12 in a partly phantom state. The nozzles 13 are arranged in a matrix of eight rows and eight columns in this example. The nozzle pitch in the row direction is 42.3 micrometers which corresponds to a resolution of 600 dpi. Therefore, the row pitch of the pressure chambers is 338 micrometers (=42.3 micrometers×8 columns). The width of the pressure chamber 14 in the row direction is 328 micrometers which is not larger than this pitch.

The column pitch of the pressure chamber 14 is also 338 micrometers, and the width of the pressure chamber 14 in the column direction is 328 micrometers which is not larger than this pitch. In other words, the planar shape of the pressure chamber 14 is square. The vibrating member has a planar shape similar to the planar shape of the pressure chamber 14, and has a planar area of 0.108 $mm^2$ which is significantly smaller than that in the conventional structure. Once the planar size of the vibrating member is determined, the structural parameters to determine the acoustic capacitance are only those of the material and thickness of the diaphragm 41 and the piezoelectric actuator 16 forming the vibrating member. In the present embodiment, the diaphragm 41 is made of stainless steel (SUS304), and the piezoelectric actuator 16 is made of lead zirconate titanate based ceramic. Therefore, the structural parameter yet to be determined is the thicknesses of these two members.

In order to determine the thicknesses, the relation between the thicknesses of these two members and the acoustic capacitance $c_0$ was examined. The acoustic capacitance $c_0$ was calculated by the finite element method based on the following expression:

$$c_0=\Delta v/p$$

wherein Δv is an ejection volume when a uniform pressure p is applied on the vibrating member in a structural model.

Figure 14:
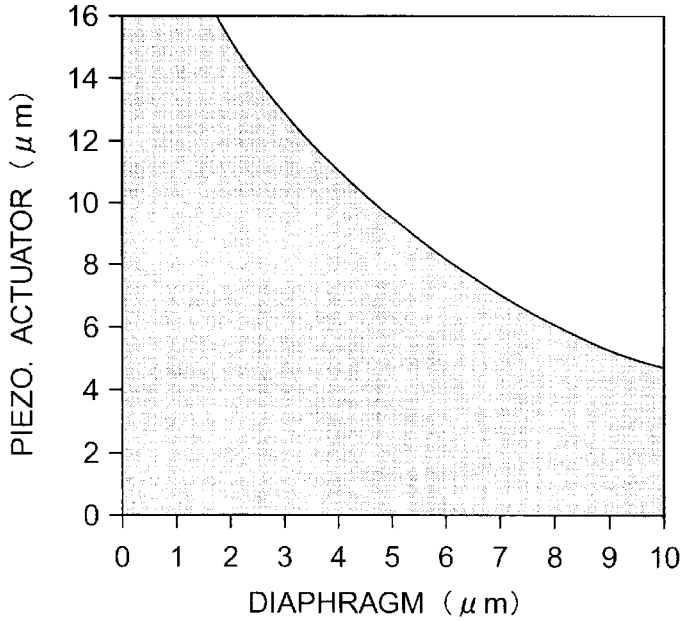
FIG. 14 is a graph showing the suitable relation between the thickness of a diaphragm and a piezoelectric actuator, to obtain a suitable acoustic capacitance of the vibrating member.

FIG. 14 is a graph showing the results. In the graph, the abscissa represents the thickness of the diaphragm 41 whereas the ordinate represents the thickness of the piezoelectric actuator 16. The acoustic capacitances $c_0$ corresponding to combinations of them were analyzed and examined, and the range of combinations satisfying the condition represented by the following expression was shown in solid:

$$C_0 \geq 2.0\times10^{-20}\ m^5/N$$

The ejection volume by the vibrating member can be at least 15 pl with any of the thickness combinations in the range. Thus, the inkjet recording head using this element can eject an ink droplet of at least 15 pl.

The present embodiment was modeled as one solution, in which the thickness of the diaphragm 41 was 5 micrometers, and the thickness of the piezoelectric actuator 16 was 10 micrometers. In combination with the ink flow passage, ink droplet ejection experiment was conducted. A specific example will be described hereinafter.

The nozzle plate 29, the ink pool plate 38, the supply passage plate 39, the pressure chamber plate 40, and the diaphragm 41 have substantially the same outer size. The width in the head scanning direction is 4 mm, and the width in the direction normal to the head scanning direction is 4 mm. All of these plates and the diaphragm are made of stainless steel (SUS304).

The nozzle plate 29 has a thickness of 50 micrometers and defines therein a plurality of nozzles 13 having a diameter of 25 micrometers arranged in a matrix based on the above layout. The nozzles are perforated by a press-forming process. The ink pool plate 38 as thick as 200 micrometers has holes 38*a* having a diameter of 28 micrometers and in communication with the nozzles 13. The holes 38*a* are formed by a press-forming process and the ink pool 38*b* is formed by an etching process.

The supply passage plate 39 as thick as 50 micrometers has communication holes 39*a* having a diameter of 28 micrometers, formed by press-forming and in communication with the nozzles 13. The supply passage plate 39 also has ink supply passages 39*b* having a diameter of 25 micrometers and in communication with the ink pool 38*b*. The pressure chamber plate 40 having a thickness of 80 micrometers defines a plurality of pressure chambers 14 formed by etching based on the above planar shape. The diaphragm 41 as thick as 5 micrometers, as described above, has a suitable electric conductivity and serves as a common electrode for applying driving waveform voltage supplied from the piezoelectric actuator 16. These five species of plates are provided with respective alignment markers (not shown) for registration and coupling with one another.

The piezoelectric actuator 16 has a thickness of 10 micrometers as described above. The piezoelectric actuators 16 are provided separately on the diaphragm 41 corresponding to the pressure chambers 14 and have a planar shape in coincidence with the outer shape of the pressure chamber 14.

The piezoelectric actuator 16 has an electrode film on both the surfaces thereof. A plurality of flexible wires (not shown) having an electric interconnection function and an electrode film having a corresponding electrode pattern on the free surface of the piezoelectric actuator 16 are electrically connected together by wire bonding.

Figure 15A:
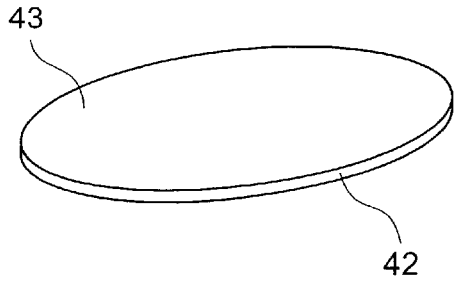
FIGS. 15A to 15D are perspective views consecutively showing the steps of a method of manufacturing the inkjet recording head according to the first embodiment.

A method of manufacturing the inkjet recording head according to the present embodiment will now be described. FIGS. 15A to 15D are perspective views showing consecutive steps of the manufacturing process thereof. As shown in FIG. 15A, a columnar block of a piezoelectric material (not shown) is polished by lapping to thereby form a piezoelectric plate 42. The polishing step is performed until the thickness of the piezoelectric plate 42 becomes the designed thickness of the piezoelectric actuator 16. An electrode film 43 is formed on both surfaces of the piezoelectric plate 42 by a sputtering technique. In the present embodiment, Au is used as the electrode material of the electrode film 43.

Figure 15B:
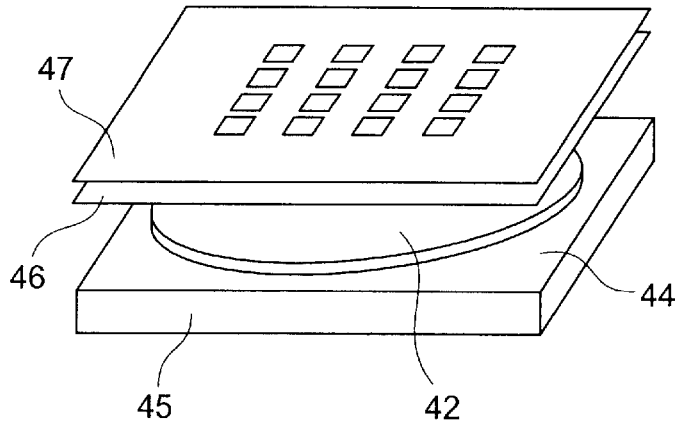

Subsequently, as shown in FIG. 15B, the piezoelectric plate 42 after the sputtering is provisionally secured to a securing plate 45 through a cellular adhesive tape 44, which loses the adhesive function thereof at a high temperature. The securing plate 45 is provided with alignment markers (not shown) used for registration and coupling with the SUS plates such as the nozzle plate 29, the pressure chamber plate 40 and the diaphragm 41.

Figure 15C:
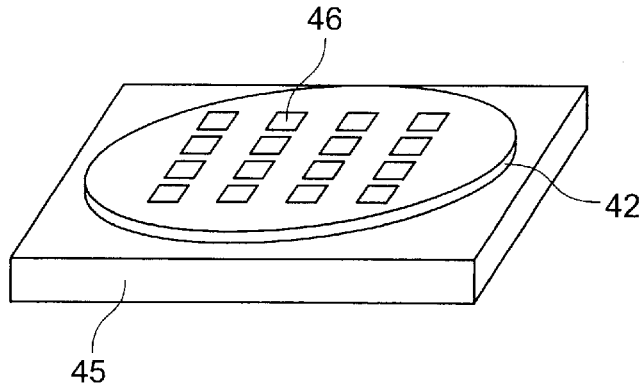

Thereafter, as shown in FIG. 15C, a photosensitive film mask 46 is attached onto the provisionally secured piezoelectric plate 42. In the present embodiment, a urethane-based film mask as thick as 10 micrometers is used as the film mask 46. Then, an exposure mask 47 is separately prepared by patterning to transmit ultraviolet (UV) ray only at the part to be left as the piezoelectric actuators 16. The film mask 46 is patterned with reference to the alignment markers on the securing plate 45.

Subsequently, using the exposure mask 47, the piezoelectric plate 42 covered with the film mask 46 is exposed to UV ray and the film mask 46 is then etched. The etchant should be of a kind to remove the film mask 46 except for the part irradiated with the UV ray. In this example, a sodium carbonate solution is used as the etchant.

By the above process, the film mask 46 covers the part which remains to be the piezoelectric actuators 16, and the other part is removed of the film mask 46. Then, the structure is subjected to sandblast processing. The sandblast processing is performed so that the piezoelectric plate 42 at the part exposed from the film mask 46 is polished and thus removed away, and the part covered with the remaining portion of the film mask 46 is not polished.

Figure 15D:
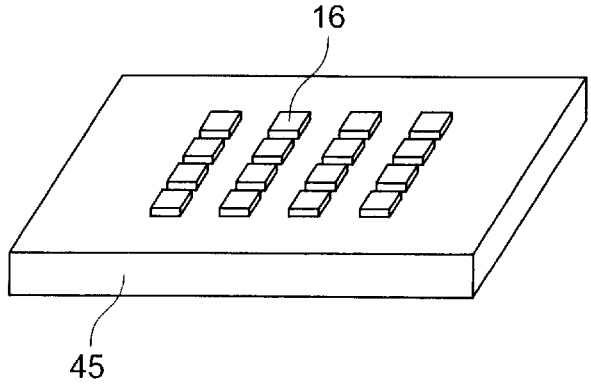

Then, the film mask 46 remaining on the surface of the piezoelectric plate 42 is removed away, followed by cleaning on the remaining part of the piezoelectric plate 42. By the above process, as shown in FIG. 15D, a piezoelectric composite having an electrode film 31 on both surfaces and having piezoelectric actuators 16 in pieces attached onto the securing plate 45 with the cellular adhesive tape 44 can be provided.

Then, the step of attaching the piezoelectric material onto the diaphragm 41 is performed. An adhesive (not shown) is applied on the surface of the piezoelectric composite shown in FIG. 15D. According to the embodiment, the diaphragm 41 also serves as a common electrode, and therefore the conductive adhesive is applied thereto. After the application of the adhesive, with reference to the alignment markers on the diaphragm 41 and the securing plate 45 for registration, the piezoelectric composite and the diaphragm 41 are placed on one another and thrust at a pressure of 2 kg/cm$^2$. Thus, the thermosetting adhesive is cured at a temperature of 200° C., and these elements are coupled together. The cellular adhesive tape 44 used to provisionally fix the piezoelectric composite and the securing plate 45 together at the time of heating becomes non-adhesive by the heat, and thus is easily removed.

By the above process, an actuator unit including the piezoelectric actuators 16 in small pieces and the diaphragm 41 serving as a common electrode for the piezoelectric actuators 16 is provided, the piezoelectric actuators 16 mounting thereon separate electrodes. The actuator unit is coupled by adhesive to a separate plate unit produced by coupling the plates altogether except for the diaphragm 41, i.e., the nozzle plate 29, the ink pool plate 38, the supply passage plate 39 and the pressure chamber plate 40. Thus, structure of the inkjet recording head according to the present embodiment is provided.

Finally in the fabrication process, electric connection to apply driving waveform voltage to the piezoelectric actuators 16 is provided. According to the embodiment, an FPC cable (not shown) is used as the flexible cable which is attached at the outer periphery of the inkjet recording head, and the electrode terminal thereof and the separate electrode of each piezoelectric actuator 16 are connected by wire-bonding.

The operation of the embodiment will now be described. In the inkjet recording head produced in the manner described above, ink is filled within the pressure chambers 14 through the ink supply passages 39*b* from the ink pool 38*b* as shown in FIG. 12. Subsequently, a driving voltage is applied between the separate electrode of each piezoelectric actuator 16 and the diaphragm 41 (common electrode), whereby the vibrating member formed by a combination of the diaphragm 41 and the piezoelectric actuator 16 flexibly deforms to compress the ink filled in the pressure chamber 14, and an ink droplet is ejected from the corresponding nozzle 13.

Figure 16:
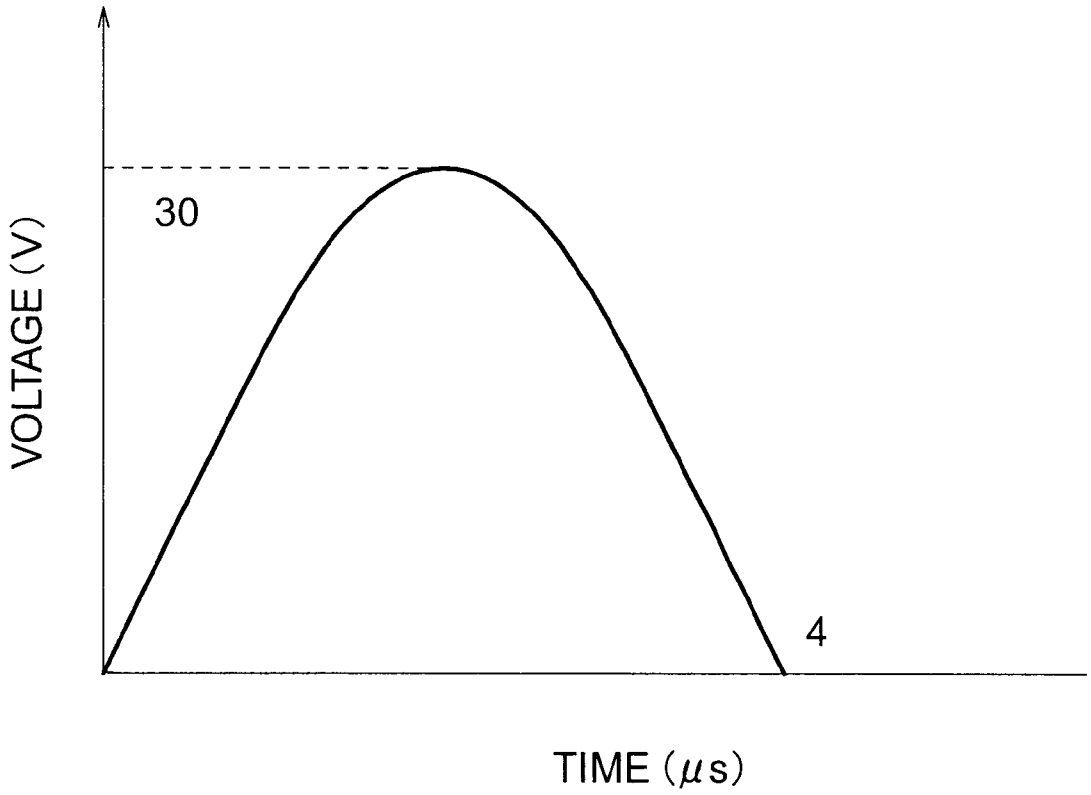
FIG. 16 is a graph showing the waveform of a driving voltage used in an experiment on the ink droplet ejection.

Using the inkjet recording head described above, ink droplets were ejected as an experiment. FIG. 16 is a graph showing the waveform of the driving voltage used in the experiment. In the graph, the ordinate represents voltage (volts) and the abscissa represents time (microseconds).

Voltage in the driving waveform shown in FIG. 16 was separately input to each vibrating member. As a result, it was confirmed that 20 pl ink droplets were stably ejected from each nozzle 13. Furthermore, in another similar experiment, the number of vibrating members to drive at a time was varied. As a result, it was confirmed that regardless of the number of vibrating members applied with the driving voltage, ink droplets of equal amounts could be stably ejected. There was substantially no difference in the ejection characteristic (the volume and speed of ejected droplets, the direction of ejection) among different driving locations.

In the inkjet recording head according to the embodiment, the acoustic capacitance $c_0$ of the vibrating member was designed at $3.2\times10^{-20}$ m$^5$/N by using structural analysis based on the finite element method and actual measurement. Thus, the inkjet recording head according to the present embodiment satisfies the relation as follows:

$$c_0 \geqq 2.0\times10^{-20}\ m^5/N$$

Thus, it was confirmed by the experiments according to the embodiment that if the above relation $c_0 \geqq 2.0\times10^{-20}$ m$^5$/N was satisfied, large droplets of 15 pl or more could be ejected.

Second Embodiment

Figure 17:
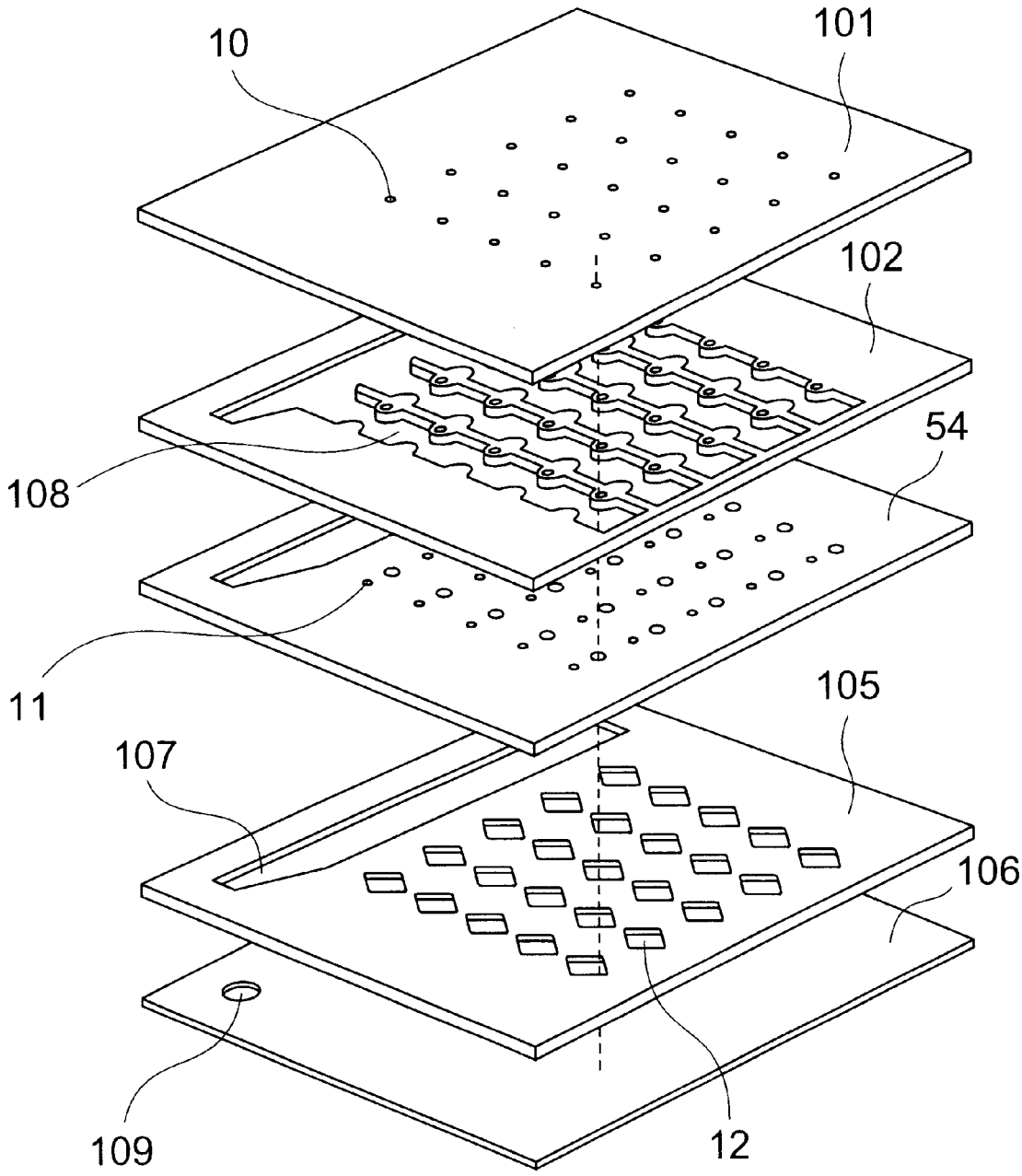
FIG. 17 is a perspective view of the arrangement of plates in an inkjet recording head according to a second embodiment of the present invention.

FIG. 17 is a perspective view of an inkjet recording head according to a second embodiment in an exploded manner. In the inkjet recording head of the present embodiment, the ink flow passage is formed by placing five plates on each other and coupling the plates altogether with an adhesive, the five plate including a nozzle plate 101, a common ink passage plate 102, a supply passage plate 104, a pressure chamber plate 105, and a diaphragm 106.

The common ink passage includes a single main flow passage 107 and a plurality of (26) branch passages 108 (only five of which are shown in FIG. 17). The main flow passage 107 is in communication with an ink reservoir (not shown) through the inlet port 109 and serves to supply ink to the branch passages 108. The branch passages 108 are each coupled with ten pressure chambers 12 (only five of which are shown in FIG. 17). In these configurations, the inkjet recording head according to the embodiment is formed as a matrix head having 260 ejectors.

Figure 18:
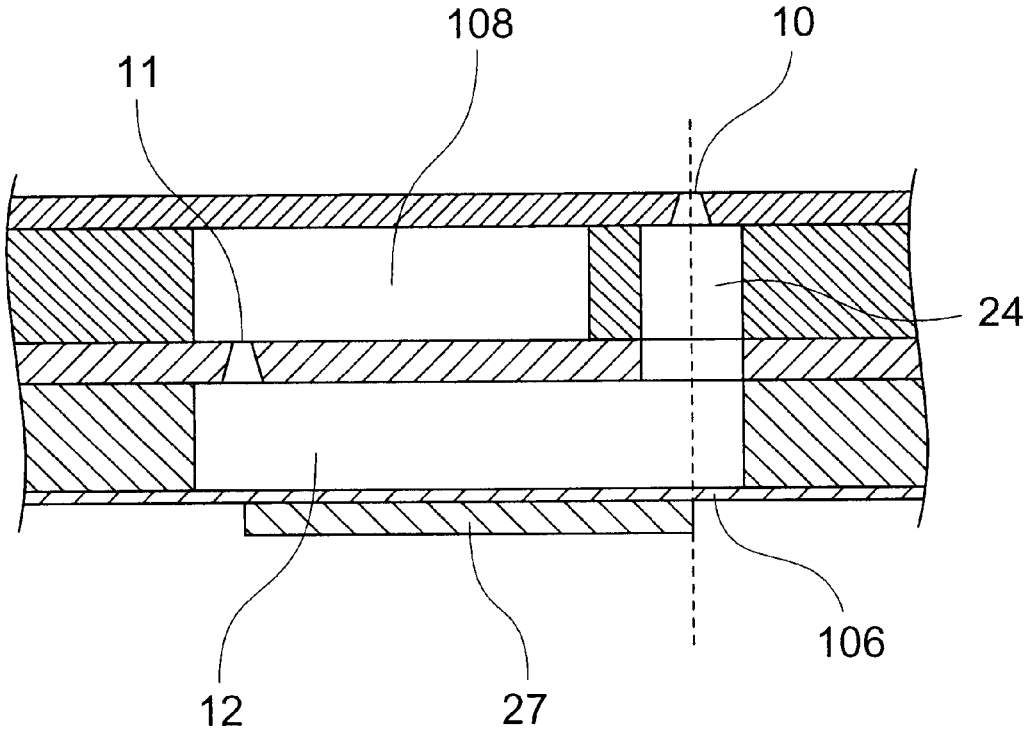
FIG. 18 is a sectional view of an inkjet recording head according to the second embodiment.

FIG. 18 is a sectional view of a single ejector. The pressure chamber 12 is coupled to the branch passage 108 through an ink supply hole 11, and ink is filled within the pressure chamber 12. The pressure chambers 12 are each coupled with a nozzle 10 to eject ink droplets. A diaphragm 106 is disposed as the bottom wall of the pressure chamber 12. The diaphragm 106 is attached with a piezoelectric actuator 27. The piezoelectric actuator 27 flexibly deforms in response to driving waveform voltage, which expands or compresses the pressure chamber 12. The change in the volume of the pressure chamber 12 causes the pressure wave in the pressure chamber 12. This pressure wave allows the ink in the nozzle part to move and be ejected outside through the nozzle 10, while forming an ink droplet. The reference number 24 indicates a communication passage formed between the nozzle 10 and the pressure chamber 12.

According to the embodiment, a polyimide film having a thickness of 25 micrometers is used for the nozzle plate 101 and the film is subjected to excimer laser processing to form a nozzle 10 having a nozzle diameter of 25 micrometers. In the present embodiment, a resin film used as the member for implementing the nozzle (nozzle plate 101) has also a function of air damper for the branch passage 108, which can improve the ejection stability when ink is ejected from a plurality of nozzles at a time. In more detail, in the head structure as shown in FIG. 18, since the nozzle plate defining the nozzles 10 is made of a resin film, a part of the wall surface (top surface) of the branch passage 108 is also made of the resin film. The wall surface of the branch passage made of the resin film having low rigidity can significantly increase the acoustic capacitance of the branch passage, which can prevent acoustic waves from being propagated through the branch passage. Thus, crosstalk can be prevented. This also improves the ejection stability when ink is ejected from multiple nozzles at a time. It should be noted that, in order to secure sufficient acoustic capacitance for the branch passage and still allow the nozzle portion to have a nozzle function (such as improving the ejection directivity and preventing air bubbles from being entrained), the resin film has preferably a thickness in the range from 20 to 70 micrometers. Without this range, however, some similar function and effect may be provided if not sufficient.

In a sample manufactured, the supply passage plate 104 was made of a stainless steel plate as thick as 75 micrometers, and ink supply holes 11 having a size of 26 micrometers were formed by press-forming.

Figure 19A:
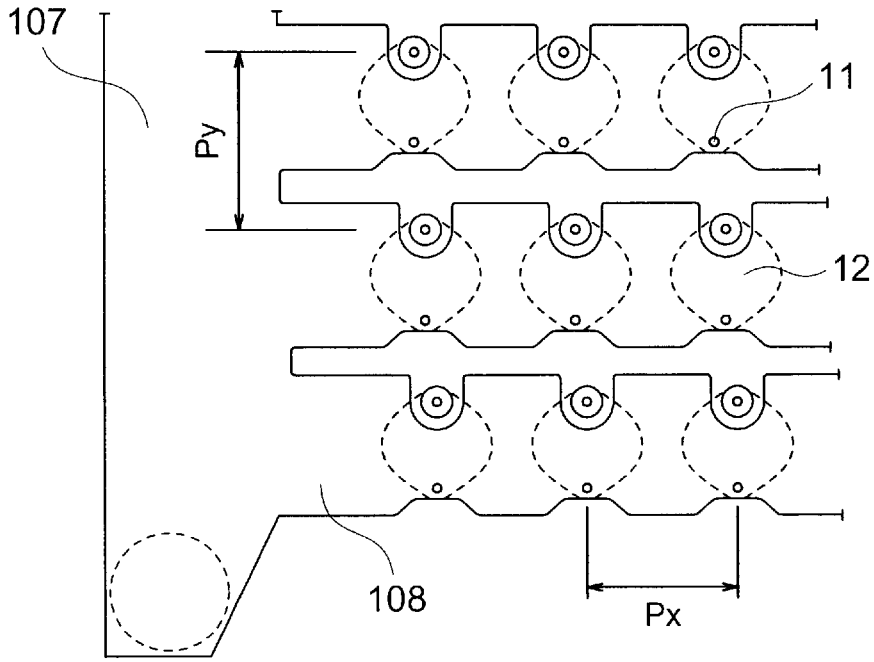
FIGS. 19A and 19B are top plan views of the inkjet recording head according to the second embodiment.

Stainless steel plate as thick as 100 micrometers were used for the common ink passage plate 102 and for the pressure chamber plate 105, and a flow passage pattern was formed by wet etching. The pressure chamber 12 was formed in a square shape one side of which was as long as 500 micrometers and the aspect ratio of which was 1. The corners of the chamber 12 were rounded as shown in FIG. 19A in order to prevent ink from stagnating. The diaphragm 106 was made of a stainless steel plate (Ev=197 GPa) as thick as 10 micrometers. In FIG. 19A, Px represents the nozzle pitch in the main scanning direction 428 (see FIG. 42), and Py is the nozzle pitch in the sub-scanning direction 429.

Figure 19B:
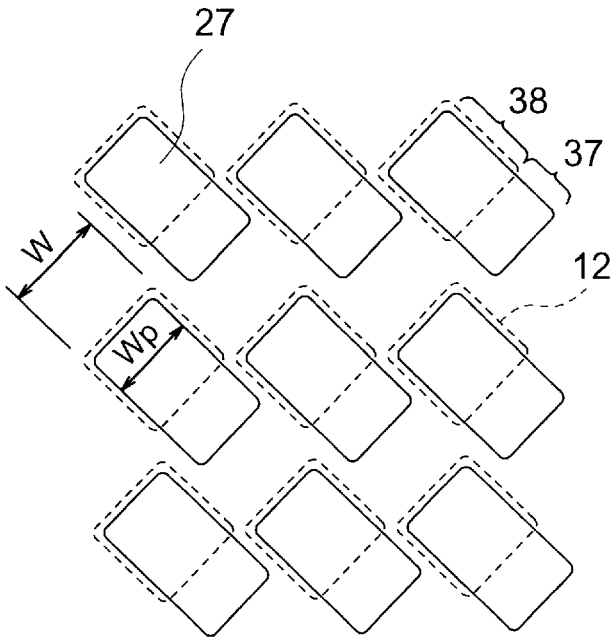
Figure 20:
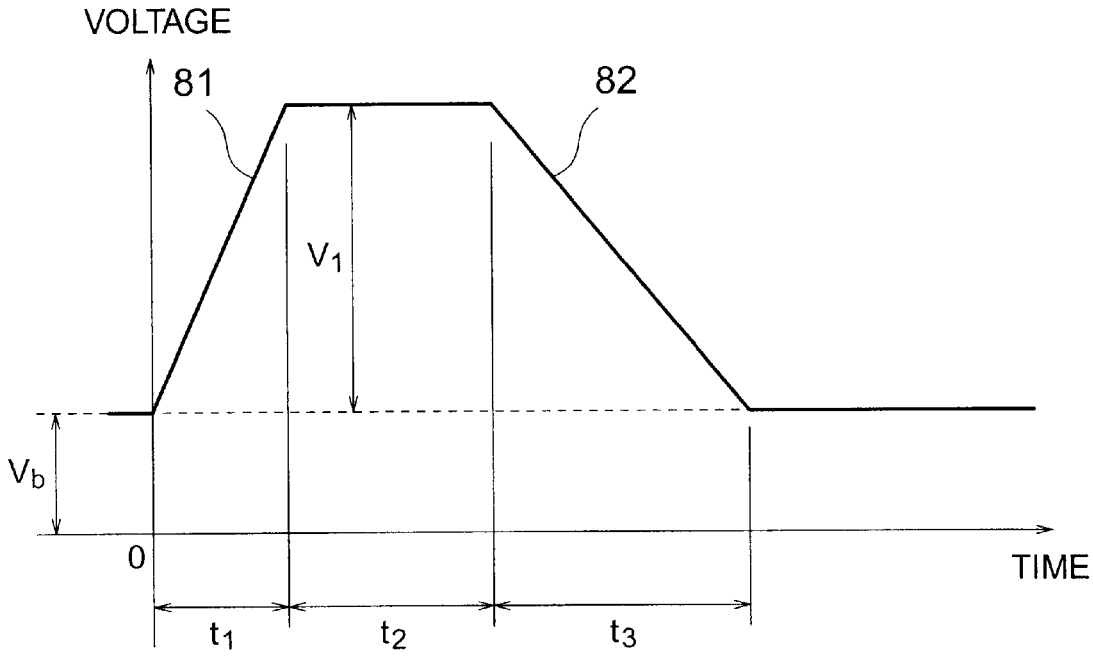
FIG. 20 is a waveform chart showing a driving waveform for ejecting large droplets.

FIG. 19B shows the shape of piezoelectric actuators 27 according to the embodiment. The piezoelectric actuator 27 was made of a single piezoelectric ceramic plate (lead zirconate titanate based ceramic having an Ep equal to 200 GPa) as thick as 30 micrometers. The width $W_p$ of the piezoelectric actuator was about 490 micrometers, which was substantially equal to the width W of the pressure chamber, and sandblast processing was employed. The reference numbers 37 and 38 shown in FIG. 19B represent an electrode pad portion and a driving portion, respectively, of the piezoelectric actuator 27.

As a result of structural analysis by the finite element method and actual measurement, in the inkjet recording head according to the embodiment, the acoustic capacitance $c_0$ was $3.2\times10^{-20}$ $m^5/N$, and the inertance $m_0$ was $1.3\times10^6$ $kg/m^4$. The acoustic capacitance $c_1$ of the pressure chamber 12 was $2.0\times10\ 20$ $m^5/N$, whereby $c_c=1.2\times10^{-20}$ $m^5/N$. Thus, the inkjet recording head according to the embodiment satisfies the conditions represented by the expressions (8) and (10).

Figure 40A:
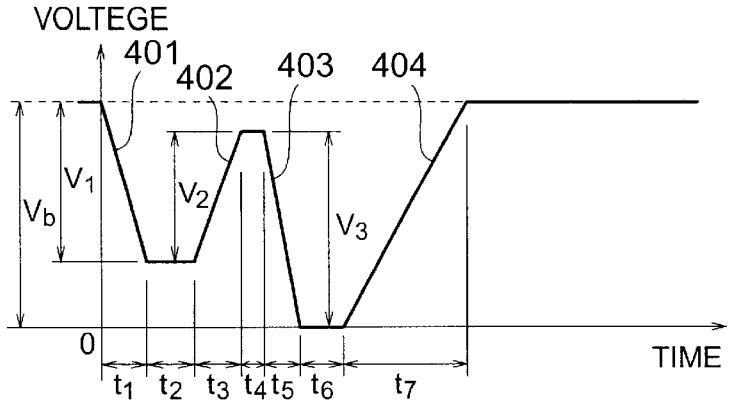
FIGS. 40A to 40C are charts showing the waveforms of the driving voltage used in the embodiments of the present invention.
Figure 40B:
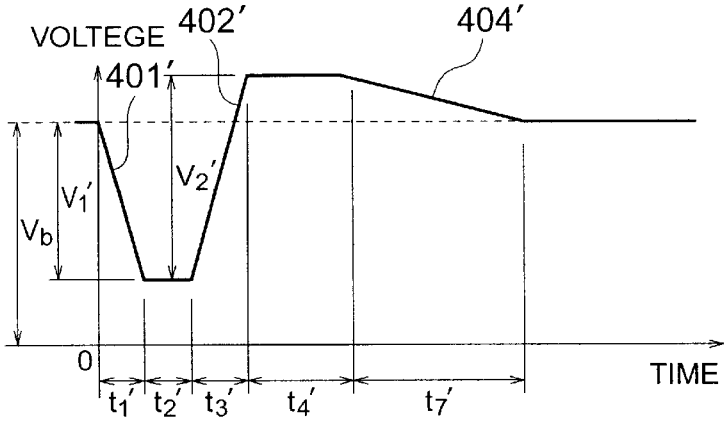
Figure 40C:
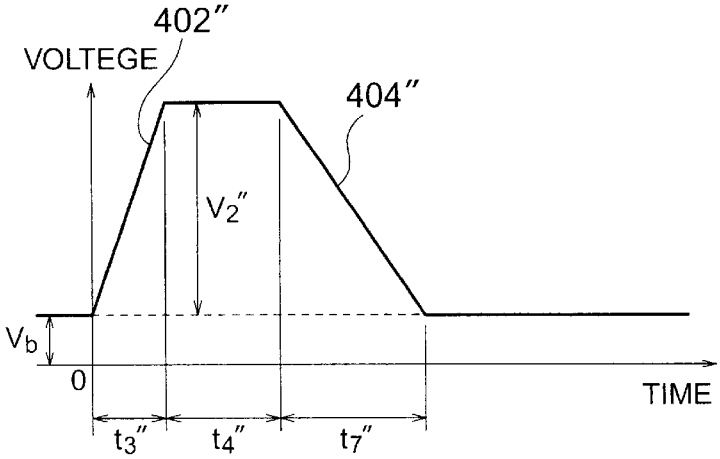

FIGS. 40A to 40C are waveform diagrams of the driving voltage used according to the embodiment. The driving voltage waveform, for use in ejecting large droplets, shown in FIG. 40C includes a first voltage change section 402" used to compress the pressure chamber in a relatively mild rising time, a constant voltage section used to hold the level of the applied voltage for a prescribed time period, and a second voltage change section 404" for recovering the original voltage level (or offset voltage $V_b$). In response to the voltage in this driving waveform applied to the piezoelectric actuator, large pressure is caused in the pressure chamber at the timing of application of the first voltage change section 402", which causes ink in the pressure chamber to be ejected through the nozzle toward recording paper. These periods are such that the period $t_3$"=5 microseconds, the period $t_4$"=10 microseconds, and the period $t_7$"=15 microseconds. The voltage change is $V_2$"=30V and the bias voltage is $V_b$=20V.

On the other hand, the driving voltage waveform, for use in ejecting small droplets, shown in FIG. 40A includes a first voltage change section 401 to expand the pressure chamber immediately before ejection, a second voltage change section 402 used to abruptly compress the pressure chamber, a third voltage change section 403 used to abruptly expand the pressure chamber, and a fourth voltage change section 404 used to return the applied voltage level to the original voltage level, with an interval of constant voltage level being disposed between each two of the voltage change sections. In response to application of the voltage in the driving waveform to the piezoelectric actuator, the first voltage change section 401 causes the meniscus at the nozzle orifice to be drawn into the side of a pressure chamber so that a retracted or recessed meniscus is formed.

Then, in response to the second voltage change section 402, a small-diameter liquid column is formed in the center of the nozzle, and this liquid column is separated in response to the third voltage change section 403 in an early stage. Thus, an ink droplet smaller than the nozzle diameter is ejected. In more detail, the driving voltage waveform used to eject very small droplets by the meniscus control technique uses specific periods such that the period $t_1$=2 microseconds, the period $t_2$=2 microseconds, the period $t_3$=2 microseconds, the period $t_4$=0.5 microseconds, the period $t_5$=2 microseconds, the period $t_6$=5 microseconds and the period $t_7$=15 microseconds. The voltage change $V_1$=15 V and bias voltage $V_2$=12 V, whereas the voltage change $V_3$=17 V and bias voltage $V_b$=20V.

The driving voltage waveform, for use in ejecting medium size droplets, shown in FIG. 40B uses the meniscus control technique similarly to the waveform for small droplets and includes a first voltage change section 401' to expand the pressure chamber immediately before ejection, a second voltage change section 402' used to abruptly compress the pressure chamber, and a third voltage change section 404' used to return the applied voltage level to the original voltage level, with an interval for a constant voltage level being disposed between each two of the voltage change sections. There is no such part as the third voltage change section 403 used to separate the liquid column in an early stage as in the driving voltage waveform for small droplets.

A prescribed period is provided after the second voltage change section 402' so that an ink droplet slightly larger than small droplets is ejected. The period $t_1$'=2 microseconds, $t_2$'=2 microseconds, $t_3$'=2 microseconds, $t_4$'=10 microseconds, and $t_7$=15 microseconds. The voltage change $V_1$'=15 V, and $V_2$'=20 V. The bias voltage $V_b$=20 V.

It should be noted that the driving waveform shown in FIGS. 40A to 40C are mere examples used for a method of driving the inkjet recording head according to the present invention, whereas other driving waveforms may be used. In the driving voltage, the waveform for large droplet ejection should include at least a first voltage change section to apply voltage in the direction to compress the volume of the pressure chamber and allow an ink droplet to be ejected, and a second voltage change section to apply voltage in the direction to expand the volume of the pressure chamber. As long as these voltage change sections are included, any driving waveform other than that in FIG. 40C may be used.

Figure 41:
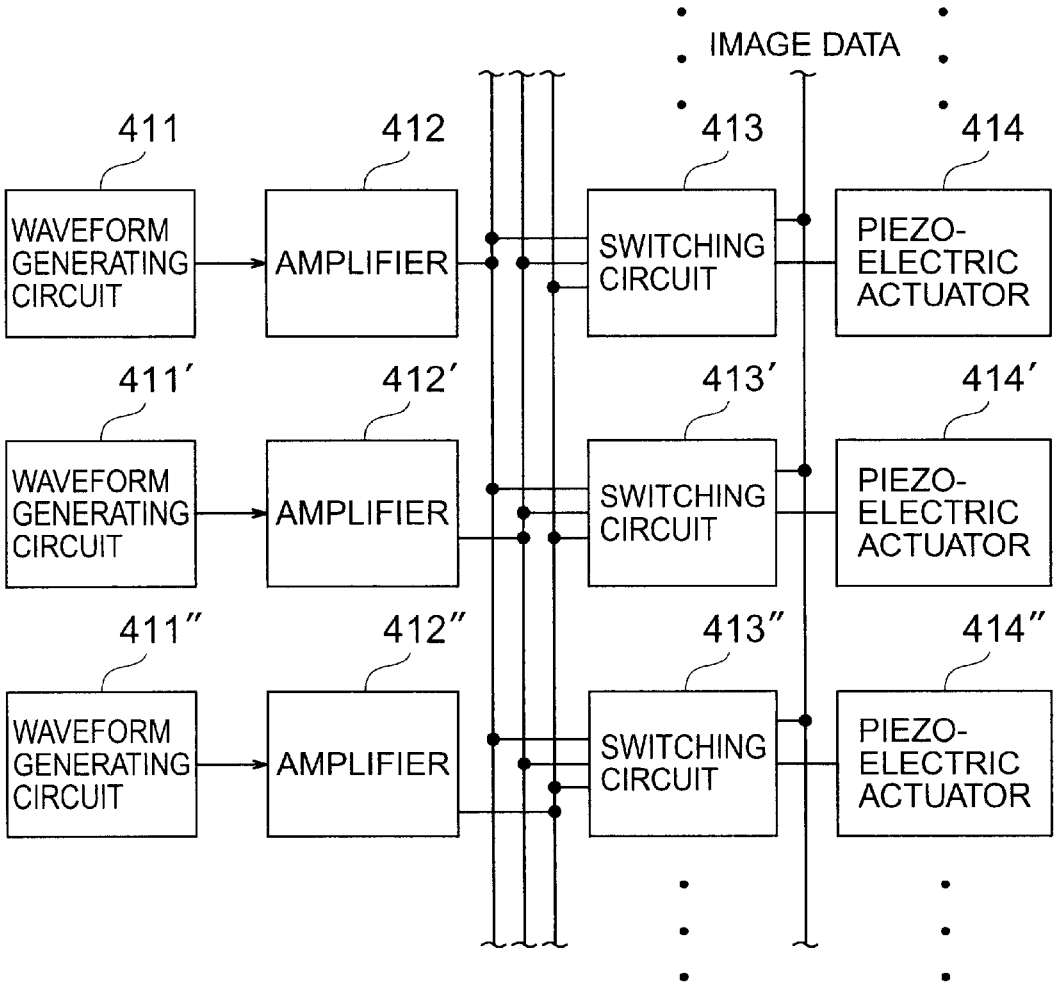
FIG. 41 is a block diagram showing the configuration of a driving circuit used in embodiments of the present invention.

There may be an additional voltage change section in FIG. 40C to slightly draw the meniscus toward inside the nozzle immediately before the first voltage change section 402" or an additional voltage change section after the second voltage change section 404". Similarly, so long as the waveform for small droplet ejection includes at least a first voltage change section 401 to apply voltage in the direction to expand the volume of the pressure chamber and a second voltage change section 402 to apply voltage in the direction to compress the volume of the pressure chamber, any driving waveform other than that shown in FIG. 40A may be used. The waveform may be without the third and fourth voltage change sections 403 and 404, or there may be an additional voltage change section to control the initial state of the meniscus immediately before the first voltage change section 401. FIG. 41 is a block diagram of the basic configuration of the driving circuit used according to the embodiment. For recording images by using a droplet size modulation method, voltage is applied to the piezoelectric actuator corresponding to each pressure chamber while switching among the driving waveforms shown in FIGS. 40A to 40C for each pressure chamber to change the droplet size of ink droplets to be ejected. According to the embodiment, there are three waveform generating circuits 411, 411' and 411" used for generating three different driving voltage waveforms as shown in FIGS. 40A to 40C. These waveforms are amplified by respective amplification circuits 412, 412' and 412". At the time of recording, the driving waveform voltage applied to the piezoelectric actuators 414, 414' and 414" is switched based on the image data by using switching circuits 413, 413' and 413" so that ink droplets in desired sizes are ejected.

Using the inkjet recording head according to the embodiment, ink droplets were ejected in an experiment. When voltage in a driving waveform ($V_1$"=30V) as shown in FIG. 40C was applied to the piezoelectric actuator 27, ink droplets having a droplet volume of 20 pl were stably ejected from the nozzles 10. In more detail, it was confirmed from the experiment that using the piezoelectric actuator 27 satisfying the condition that the acoustic capacitance satisfies $c_0 \geqq 2.0\times10^{-20}$ $m^5/N$, large droplets having a volume larger than 15 pl could be ejected. The time required for refilling was about as short as 40 microseconds, and high speed driving operation at 18 kHz was obtained.

Using the inkjet recording head according to the present embodiment, images were recorded on recording paper, and a sufficient image density (OD value: 1.3) was obtained at a low recording resolution of 600 dpi. In more detail, in the inkjet recording head, large droplets having a droplet volume of 20 pl could be ejected, a sufficient image density may be obtained at a resolution as low as 600 dpi, and therefore the inkjet recording head of the present embodiment revealed remarkable advantages in high speed recording. It should be noted that when the driving waveform voltage $V_1$" was raised to 40 V, a droplet volume of 27 pl was obtained, thereby providing a sufficient density (OD value: 1.2) even at a low recording resolution of 300 dpi.

Figure 21:
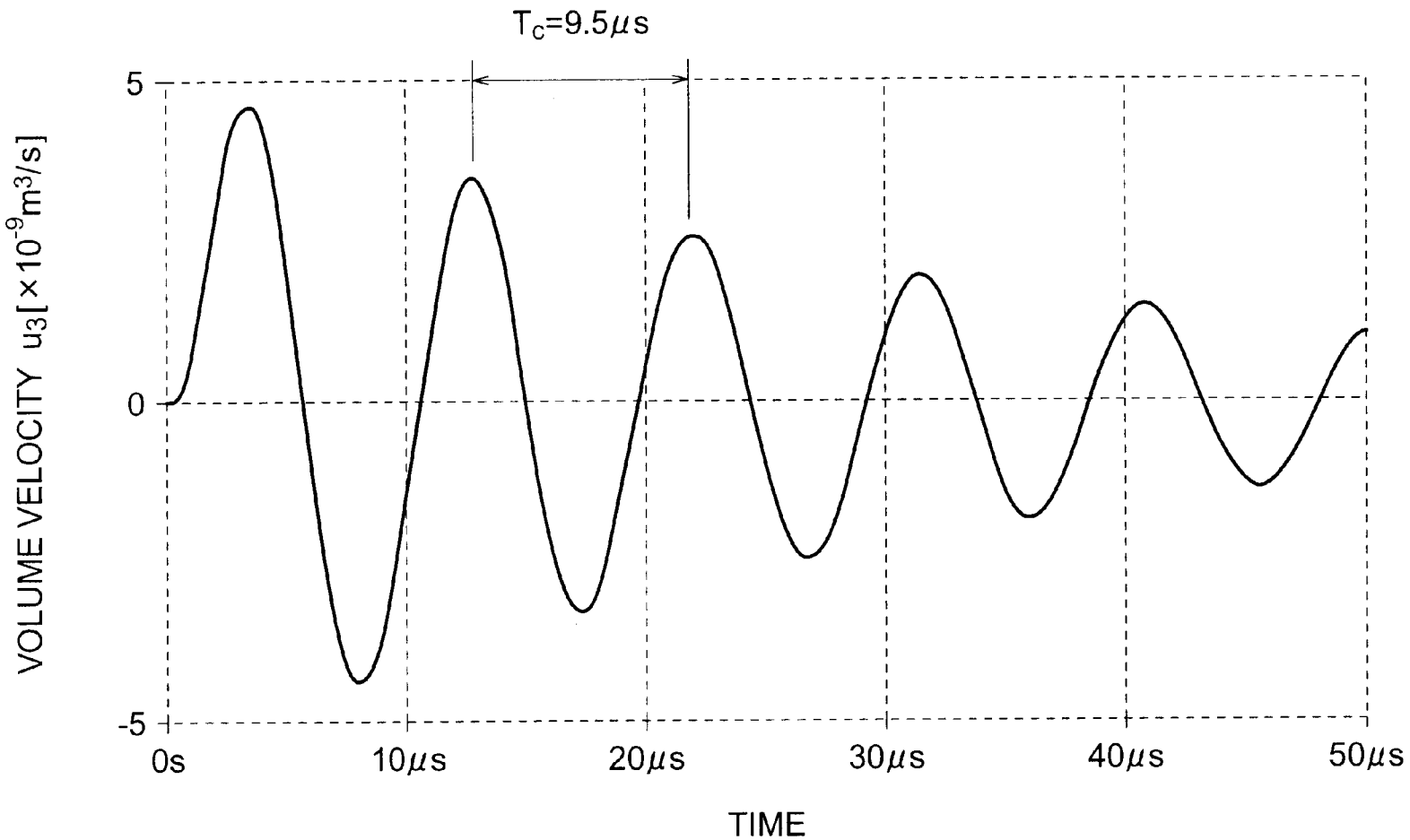
FIG. 21 is a chart showing meniscus vibration in an inkjet recording head.

FIG. 21 shows a result of observing the meniscus vibration in the inkjet recording head according to the embodiment by using a laser Doppler velocimeter. It was found that the natural period $T_c$ of the pressure wave was kept at a level as small as 9.5 microseconds. More specifically, using the vibrating member satisfying the condition that the acoustic capacitance $c_0$ satisfies $c_0 \leqq 5.5\times10^{-19}$ $m^5/N$, a natural period $T_c$ of 15 or shorter microseconds suitable for ejecting very small droplets was provided.

As can be seen from the meniscus vibration waveform shown in FIG. 21, in the inkjet recording head according to the embodiment, the basic meniscus vibration was not superposed with small vibration, and extremely excellent meniscus vibration was provided. This is because the inkjet recording head according to the embodiment satisfies the condition represented by the expression (8) and $c_0>c_1$, and the amplitude of the vibration by the vibration system B described above can be kept small. The meniscus vibration was so stable that extremely high ejection stability was provided using the inkjet recording head.

When small droplets were ejected in response to the driving waveform as shown in FIG. 40A, it was confirmed that very small droplets having a droplet volume of 2 pl could be stably ejected. In more detail, in the inkjet recording head according to the embodiment, the natural period was as short as 9.5 microseconds, and abnormal vibration of the meniscus is suppressed so that the very small droplets were successfully ejected by the meniscus control technique. Thus, in the inkjet recording head according to the embodiment, both "large droplets" and "small droplets" can be ejected, and voltage can be applied to each piezoelectric actuator while switching between the driving waveforms shown in FIGS. 40A to 40C based on an image pattern. The droplet-size-modulated recording was performed in a wide droplet size range from 2 to 20 pl.

As a comparative example, the head was similarly evaluated for the performance characteristic while the thickness of the piezoelectric actuator $t_p$, the thickness of the vibration plate $t_v$ and the width W of the pressure chamber were varied. As plotted with small circles in FIG. 6, the droplet volume was well matched with the results of structural analysis denoted by solid squares. In more detail, in the condition that $c_0>2.0\times10^{-20}$ $m^5/N$, a droplet volume of 15 pl or more was obtained, whereas in the condition that $c_0<2.0\times10^{-20}$ $m^5/N$, only a droplet volume less than 15 pl was obtained, and thus a sufficient image density was not provided. It should be noted that $c_0<2.0\times10^{-20}$ $m^5/N$ is established, for example, when W=500 micrometers, $t_v$=10 micrometers, and $t_p$=45 micrometers or when W=400 micrometers, $t_v$=5 micrometers, and $t_p$=35 micrometers.

For the acoustic capacitance $c_0$ satisfying $c_0>5.5\times10^{-19}$ $m^5/N$, a droplet volume of 15 pl or more was obtained, whereas the natural period $T_c$ was 15 microseconds or more, and small droplets of 4 pl or less could not be ejected. The condition that $c_0>5.5\times10^{-19}$ $m^5/N$ is satisfied, for example, when W=700 micrometers, $t_v$=10 micrometers, and $t_p$=15 micrometers or when W=1000 micrometers, $t_v$=10 micrometers, and $t_p$=35 micrometers.

As can be understood from the above results, it was confirmed by the experiments that the expression (10) was correct for assuring a droplet volume of 15 pl or more and obtaining a natural period $T_c$ of 15 microseconds or less. It should be noted that when a pressure chamber having an aspect ratio of about 1 is used, in order to allow $c_0$ to satisfy $2.0\times10^{-20} \leqq c_0 \leqq 5.5\times10^{-19}$ $m^5/N$ ($c_0$: the acoustic capacitance of the vibrating member), the pressure chamber width should be in the range from 300 to 700 micrometers (from 0.09 to 0.05 $mm^2$ in the planar area), and the thicknesses of the diaphragm and the piezoelectric actuator are preferably set in the ranges from 5 to 20 micrometers and 15 to 40 micrometers, respectively.

A head having quadrangle pressure chambers having an aspect ratio other than about 1 was manufactured and evaluated. As a result, it was confirmed that in the quadrangle pressure chamber, a droplet volume of at least 15 pl or a natural period of 15 microseconds or less were secured when the condition represented by the expression (10) was satisfied. It should be noted, however, that for obtaining the same droplet volume, a driving area (the bottom area of the pressure chamber) should have an area as large as twice to five times that of the square pressure chamber.

In order to secure the same droplet volume (20 pl) as that of the inkjet recording head according to the embodiment, a pressure chamber having a size of 300×1500 $micrometers^2$ was necessary in an inkjet recording head having an aspect ratio of 5. This is about twice as large as the pressure chamber area of the inkjet recording head according to the embodiment, and therefore the nozzle arrangement density is lowered to ½. In more detail, it was confirmed that the target characteristic could be obtained using a quadrangle pressure chamber so long as the expression (10) was satisfied, whereas in order to achieve a high nozzle density as well, the optimum aspect ratio of the pressure chamber was about 1.

As described above, in the inkjet recording head according to the embodiment, although the planar shape of the vibrating member can be roughly a regular triangle, a square, or a regular hexagon, these shapes preferably have a curved side adjacent to the side of the adjacent vibrating member. More specifically, as shown in FIG. 19A, the corners of the pressure chamber 12 may be rounded. This is for the purpose of preventing ink from stagnating in the pressure chamber and for better removing air bubbles.

In more detail, in the inkjet recording head, ink droplets are ejected by pressure waves generated in the pressure chamber, whereas air bubbles remaining in the pressure chamber lowers the efficiency of pressure generation, thereby lowering the ink droplet volume or droplet speed. In the case of larger remaining air bubbles, the air bubbles may prevent droplets from being ejected. Therefore, in a typical inkjet recording apparatus, ink is suctioned from the nozzle to remove air bubbles in the pressure chamber. However, if the aspect ratio of the planar shape of the pressure chamber is close to 1 and there are sharp corners, the ink stagnates in the pressure chamber at some points where the flow rate is low, which impedes removal of the air bubbles.

Thus, in the inkjet recording head according to the present embodiment, the corners of the pressure chamber are rounded so that stagnating points are not generated and air bubbles are better removed. The air bubble remaining ratio in the pressure chamber, after the ink suction for 5 seconds under a pressure of 200 mmHg from the nozzle, was actually examined. In the inkjet recording head according to the embodiment provided with the rounded (curved) corners, the air bubble remaining ratio was substantially zero, whereas 15% of the air bubbles was observed as remaining in the pressure chamber having no rounded corners.

Figure 35:
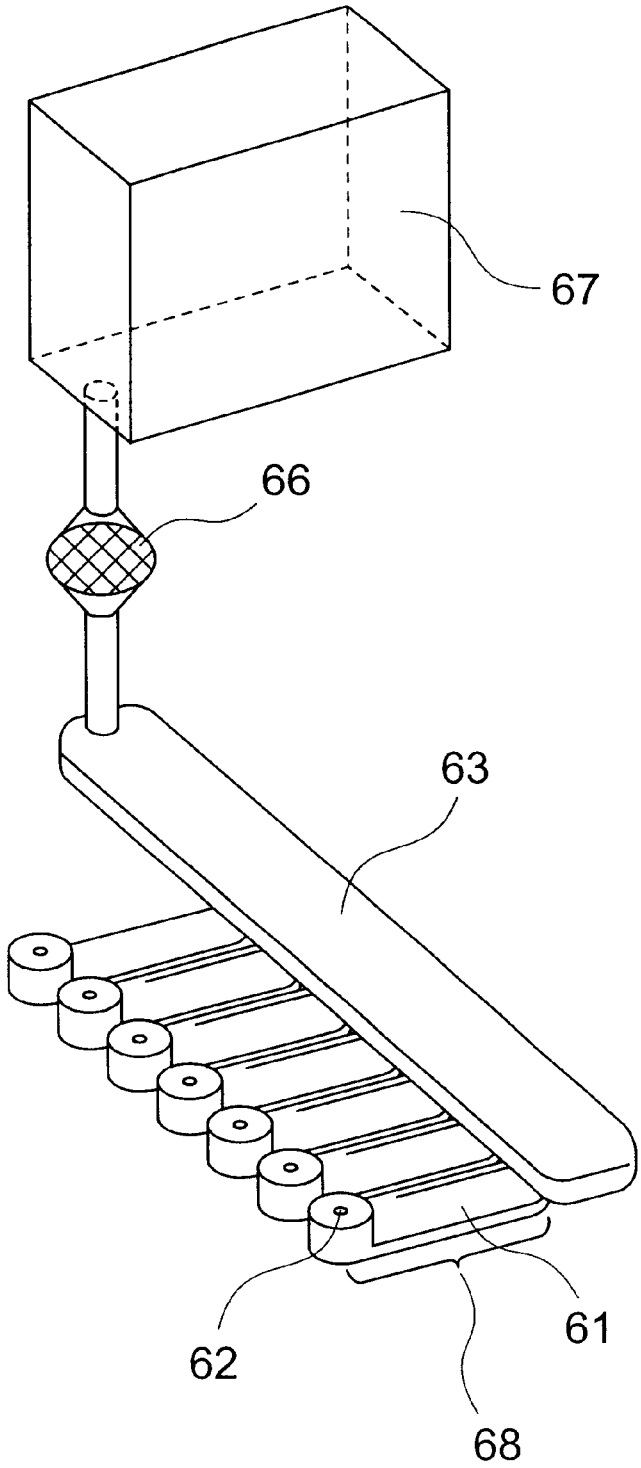
FIG. 35 is a perspective view showing the basic structure of a multi-nozzle inkjet recording head.
Figure 36:
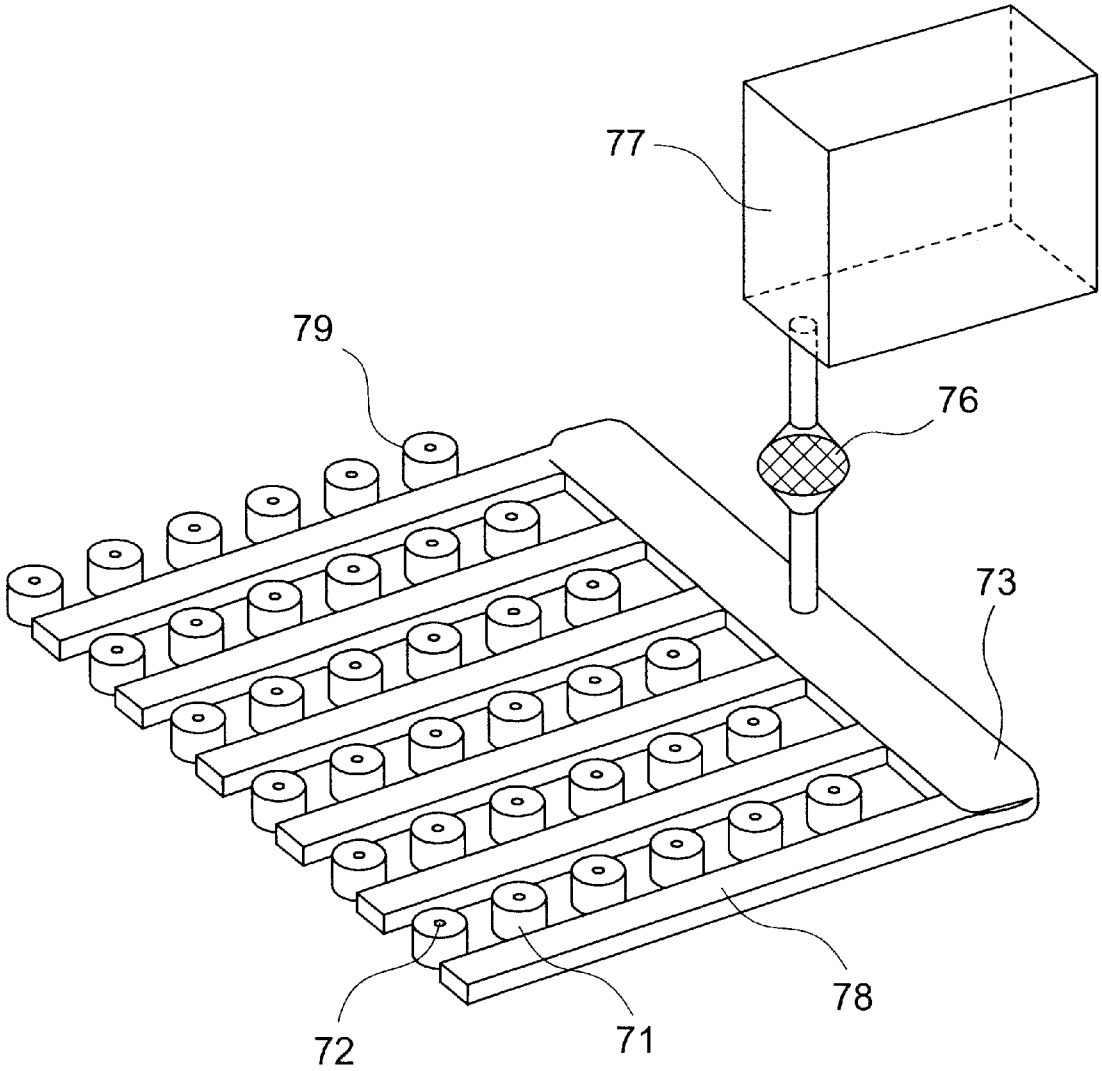
FIG. 36 is a perspective view showing the basic structure of a matrix-arrangement inkjet recording head.
Figure 37:
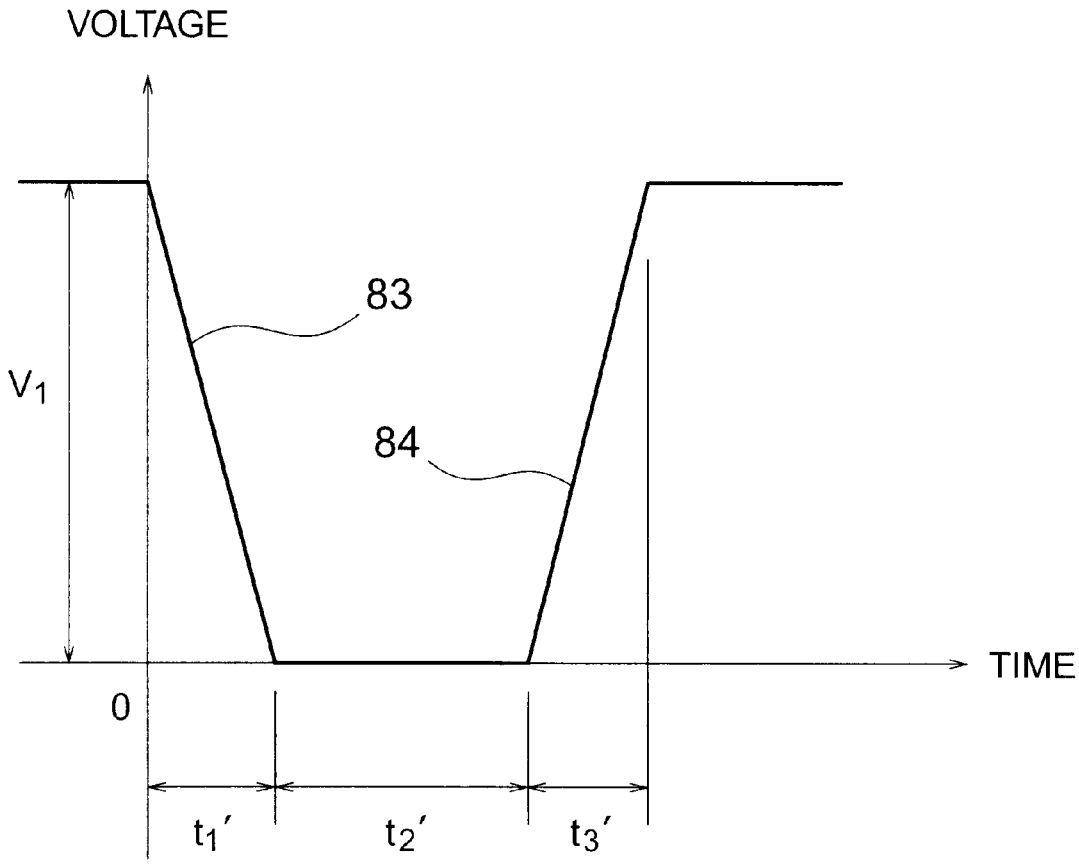
FIG. 37 is a chart showing a driving waveform for ejecting small droplets.
Figure 38A:
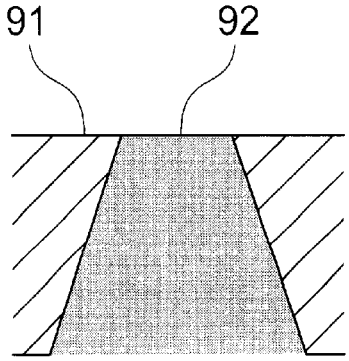
FIGS. 38A to 38D are schematic sectional views for illustration of the behavior of a meniscus controlled by the meniscus control technique.
Figure 38B:
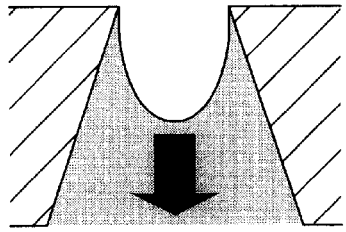
Figure 38C:
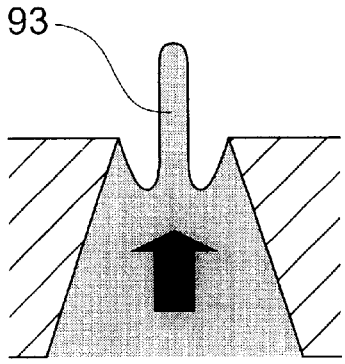
Figure 38D:
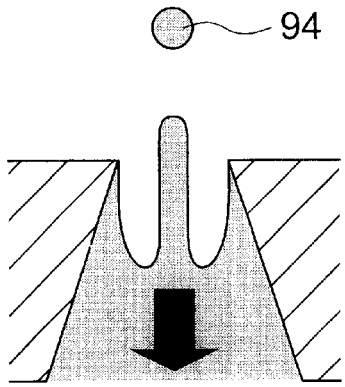

In the inkjet recording head according to the present embodiment, there are many pressure chambers and piezoelectric actuators highly densely arranged in a matrix, and therefore it is extremely difficult to make electric connection to each of the piezoelectric actuators. In more detail, as shown in FIG. 35, if the pressure chambers are arranged one-dimensionally, or if the number of pressure chambers is small although they are arranged two-dimensionally as in the first embodiment, electric connection can readily be made by a conventional electric connection technique (such as wire-bonding). On the other hand, when a large number of pressure chambers are densely and two-dimensionally arranged as in this embodiment, the conventional electric connection technique is hard to be applied.

Figure 22A:
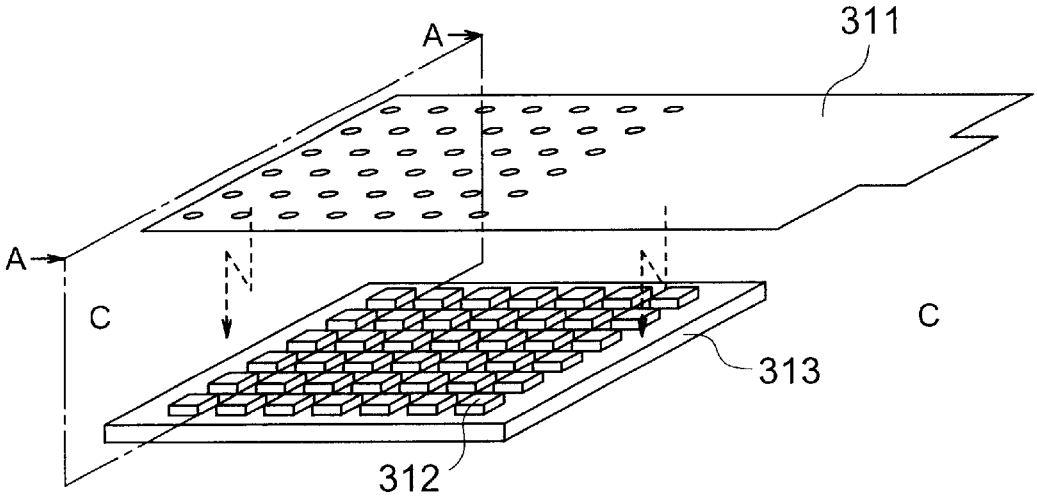
FIGS. 22A and 22B are perspective views for illustration of an electric connection process for an inkjet recording head according to an embodiment of the present invention.
Figure 22B:
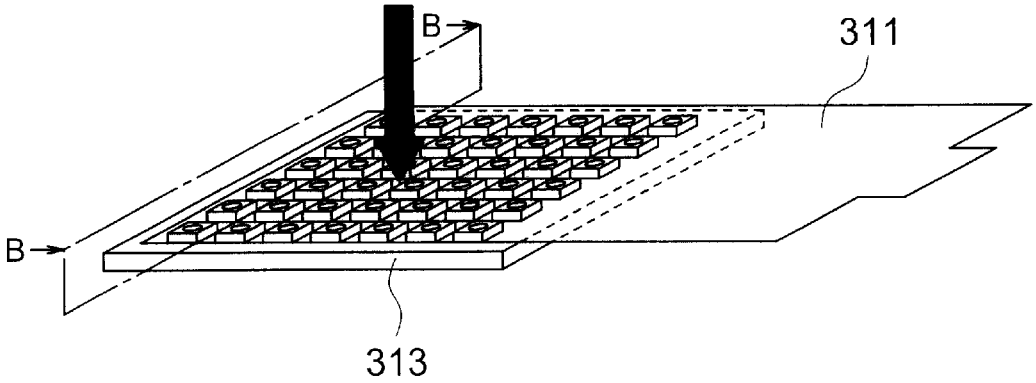

Therefore, according to the present embodiment, the electric connection technique such as illustrated in FIGS. 22A, 22B and 23A and 23B is employed. In more detail, as described before, the piezoelectric actuator is provided with an electrode pad portion 37 (see FIG. 19B). Thus, as shown in FIGS. 22A and 22B, the electrode pad portion is electrically connected to a printed circuit board (FPC board) 311 via solder bumps, through which voltage is applied to the piezoelectric actuators. The method of electric connection according to the embodiment will now be described in further more detail.

Figure 23A:
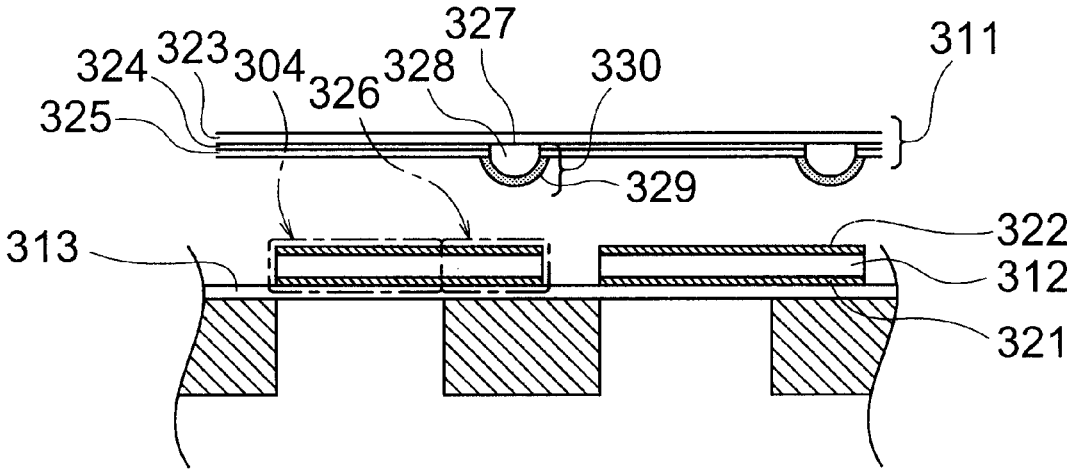
FIGS. 23A and 23B are sectional views for illustration of the electric connection process for the inkjet recording head.
Figure 23B:
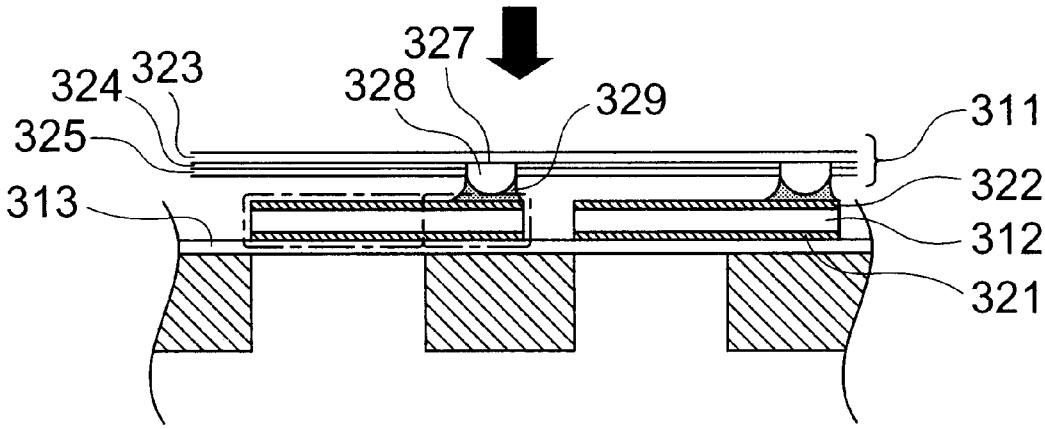

FIGS. 22A and 22B are perspective views before and after electric connection, respectively. FIG. 23A is a sectional view taken along line A—A in FIG. 22A and FIG. 23B is a sectional view taken along line B—B in FIG. 22B. The two opposing surfaces of each of the piezoelectric actuators 312 arranged in a matrix are provided with a common signal electrode 321 and an individual signal electrode 322. The common signal electrode 321 is electrically and mechanically coupled to a conductive diaphragm 313. The common signal electrode 321 includes two layers, a Cr layer (0.2 micrometers thick) and an Au layer (0.2 micrometers thick). The individual signal electrode 322 includes three layers, a Cr layer (0.2 micrometers thick), a Ni layer (0.6 $\mu$n thick), and an Au layer (0.2 micrometers thick).

The flexible printed circuit board (FPC board) 311 has individual signal lines. The flexible printed circuit board includes three layers, a base film 323 of a resin film, an interconnection pattern 324 of a metal conductor, and an overcoat layer 325. An individual signal electrode 327 is formed in a position corresponding to the electrode pad portion 326 of the piezoelectric actuator, and there is a semi-spherical bump 330 made of a conductive core member 328 and a conductive bond material 329 on the electrode 327. According to the embodiment, Cu is used for the core member 328, on the surface of which a solder bump is formed as a bond material by electrolytic plating. According to the embodiment, the bump diameter is set at $\phi$ 150 micrometers, and the height is set at 60 micrometers.

When the electric connection is to be made, the FPC board 311 and the piezoelectric actuator 312 are opposed to one another for alignment so that the positions of the electrode pad portion and the bump are matched. The aligned structure is pressed and heated, the bond material is fused and made to flow, whereby the electrode pad portion and the bump 330 are electrically and mechanically coupled. The diaphragm 313 and the pad 327 for electric connection on the FPC board 311 are connected with a control circuit (not shown), and driving voltage is applied to the piezoelectric actuator 312 through an individual signal line.

In the inkjet recording head according to the embodiment, the bump 330 is formed into a semi-spherical shape. This is for the purpose of ensuring and equalizing the contacted state between the electrode pad portions and the bumps. More specifically, if the FPC board 311 and the piezoelectric actuators 312 are not completely parallel to each other, the electrode pad portions and the semi-spherical bumps 330 can equally be contacted. Therefore, stable electric connection is enabled, and the piezoelectric actuators 312 can be prevented from being destroyed at the time of the electric connection.

The inkjet recording head according to the embodiment uses the FPC board 311 which is highly flexible as a printed circuit board, which is also for the purpose of securing sure contact between the electrode pad portion and the bump 330. In more detail, if a rigid material having less flexibility is used for the printed circuit board, the deflection of the flow passage board coupled to the piezoelectric actuator or the uneven thickness of the piezoelectric actuator tends to cause a contact failure between the electrode pad portions and the bumps 330. On the other hand, if the printed circuit board is made of a highly flexible material, the board deforms and therefore the deflection and the unevenness in thickness can be absorbed, whereby a uniform contact can be secured at all the electrically connected parts.

The use of the highly flexible material for the printed circuit board can reduce a stress caused between the bumps 330 and the printed circuit board 311 when the piezoelectric actuator 312 is driven. In more detail, when the piezoelectric actuator 312 is driven, the electrode pad portion is displaced to some extent, and therefore the bump 330 on the electrode pad portion is displaced accordingly. In this case, the use of a highly rigid printed circuit board causes a large stress among the electrode pad portion, the bump and the printed circuit board, which may damage the electrically connected parts and lead to significant degradation in the reliability of the parts. In contrast, the printed circuit board of a highly flexible material as in the present embodiment can deform when the bump is displaced, and therefore the stress can be alleviated, and a highly reliable inkjet recording head can be provided.

In the inkjet recording head according to the present embodiment, the core member 328 is inserted in the bump 330. Thus, there is a gap formed between the piezoelectric actuator 312 and the FPC board 311 after electric connection is made. Accordingly, the piezoelectric actuator 312 can be free to bend and deform independently of the FPC board. In this case, failures in the characteristic of the piezoelectric actuator 312 caused by the contact of the piezoelectric actuator 312 and the printed circuit board 311 can be prevented, and a highly reliable inkjet recording head can be provided. The gap between the piezoelectric actuator 312 and the FPC board 311 allows heat generated during driving the piezoelectric actuator 312 to be cooled by itself or by forced air. This can reduce changes in the characteristic of the piezoelectric actuator caused by temperature rises.

The above method of electric connection can provide secure electric connection to the piezoelectric actuators 312 in a highly dense, two-dimensional arrangement. More specifically, since the printed circuit board 311 is provided above the piezoelectric actuators 312, the space for disposing the signal lines can be maximized. The nozzle arrangement density can be increased as a result.

Figure 24A:
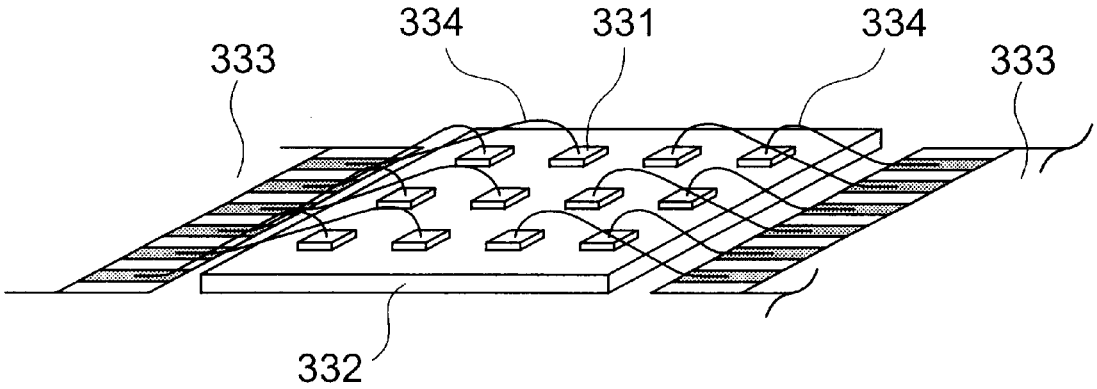
FIGS. 24A and 24B are perspective views for illustration of a conventional electric connection process for a matrix head.

When for example the piezoelectric actuators 312 having a size of 500×500 square micrometers are arranged in a matrix of ten rows and ten columns, an interconnection pattern at a pitch of 50 micrometers on the FPC board 311 can easily be formed, and accordingly the arrangement pitch of the piezoelectric actuators 312 can be reduced to 575 micrometers. The value could never be achieved in the matrix head as shown in FIGS. 24A and 24B by the conventional electric connection method, where the bonding wires 334 are used for connection between the piezoelectric actuators 331 and the printed circuit board 333, or the signal lines 335 run through the space between the piezoelectric actuators 331.

Figure 24B:
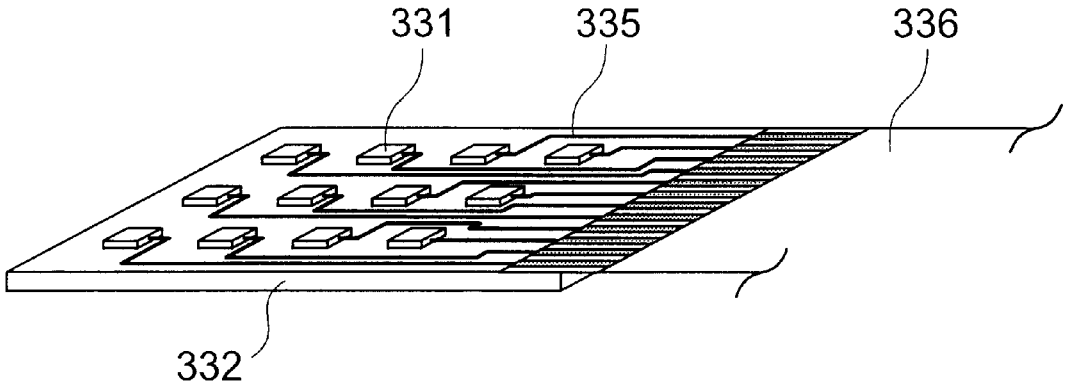

As shown in FIG. 24B using the conventional technique of electric connection by forming individual signal lines 335 in the same plane as the piezoelectric actuators 331, the minimum arraignment pitch of the piezoelectric actuators 331 is about 3.6 mm, since the minimum line pitch by screen printing is typically about 0.3 mm. The method of electric connection according to the present embodiment therefore effectively improves the nozzle density in the matrix head. In the drawings, the reference numbers 333 and 336 both represent a printed circuit board.

Third Embodiment

Figure 25A:
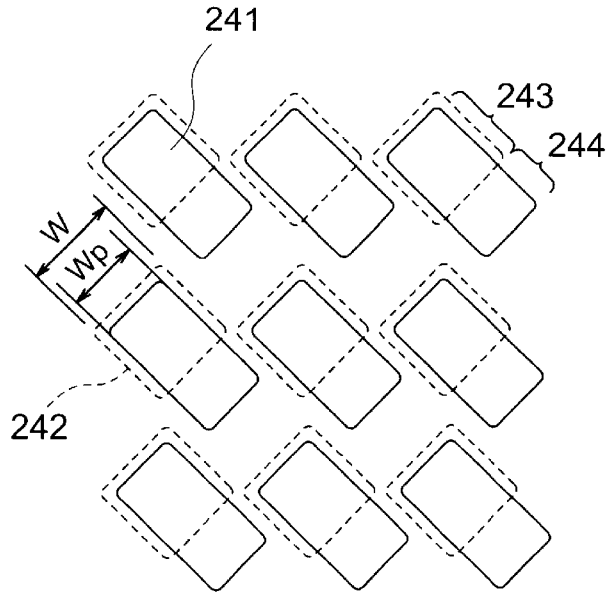
FIGS. 25A and 25B are top plan views of a piezoelectric actuator in an inkjet recording head according to a third embodiment.

FIG. 25A is a top plan view of a head structure according to a third embodiment of the present invention. The inkjet recording head according to the present embodiment has a basic structure substantially the same as that of the first embodiment, although the width $W_p$ of the piezoelectric actuator 241 in the present embodiment is smaller than the width W of the pressure chamber 242. In this manner, if there is a positional deviation caused at the time of coupling the piezoelectric actuator 241 onto the diaphragm, the acoustic capacitance $c_0$ of the vibrating member can be prevented from being greatly changed. Thus, changes in the droplet volume and the natural period can be minimized in the present embodiment.

Figure 26:
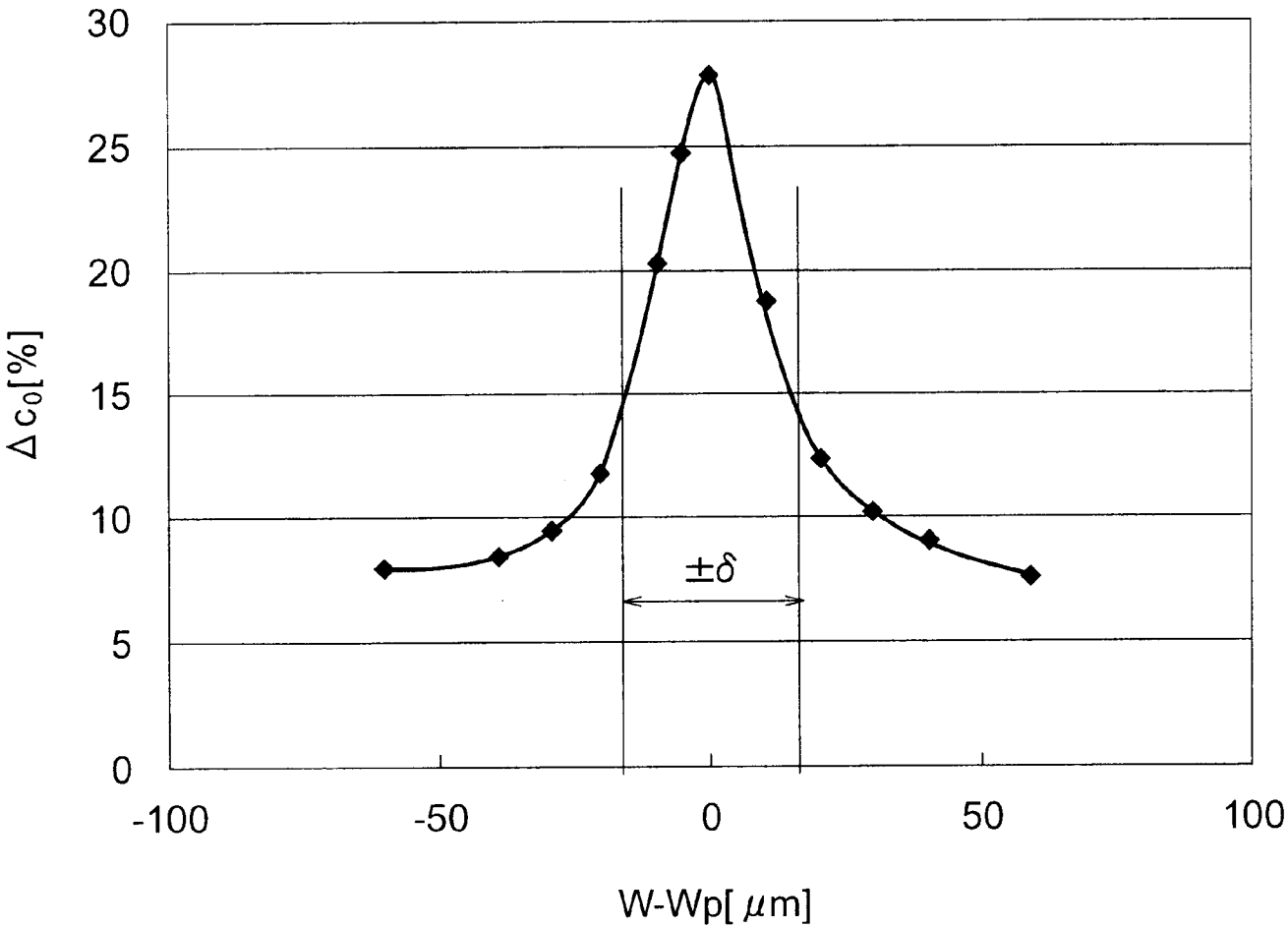
FIG. 26 is a graph showing changes in the acoustic capacitance $c_0$ depending upon the positional deviation of the piezoelectric actuator in the third embodiment.

FIG. 26 shows the result of examining the degree of change of the acoustic capacitance $c_0$ caused by a positional deviation δ (micrometers) between the centers of the pressure chamber 242 and the driving portion 243 (which actually deflects and deforms in operation) of the piezoelectric actuator 241 depending upon the width $W_p$ of the actuator. As can be clearly understood from the result, when $W_p$ is set to satisfy the following condition (defined by the expression (11)), changes in the droplet volume can be kept small.

$$W_p \leqq (W-2\delta) \text{ or } W_p \geqq (W+2\delta) \tag{11}$$

The robustness (insensitivity) of the piezoelectric actuator to the positional deviation improves in the above condition because the edge of the piezoelectric actuator is securely supported in a constant condition. As shown in FIG. 25A, if the width of the piezoelectric actuator is set to be smaller than the width of the pressure chamber so that $W_p \leqq (W-2\delta)$ is satisfied, a positional deviation of ±δ does not cause the driving portion 243 of the piezoelectric actuator to be placed on the walls of the pressure chamber 242. Therefore, the edge of the driving portion 243 resides on and is supported by the piezoelectric actuator 241 as a moving edge. The positional deviation does not change the degree of the deformation in the piezoelectric actuator, and thus the acoustic capacitance $c_0$ is kept substantially constant.

Figure 25B:
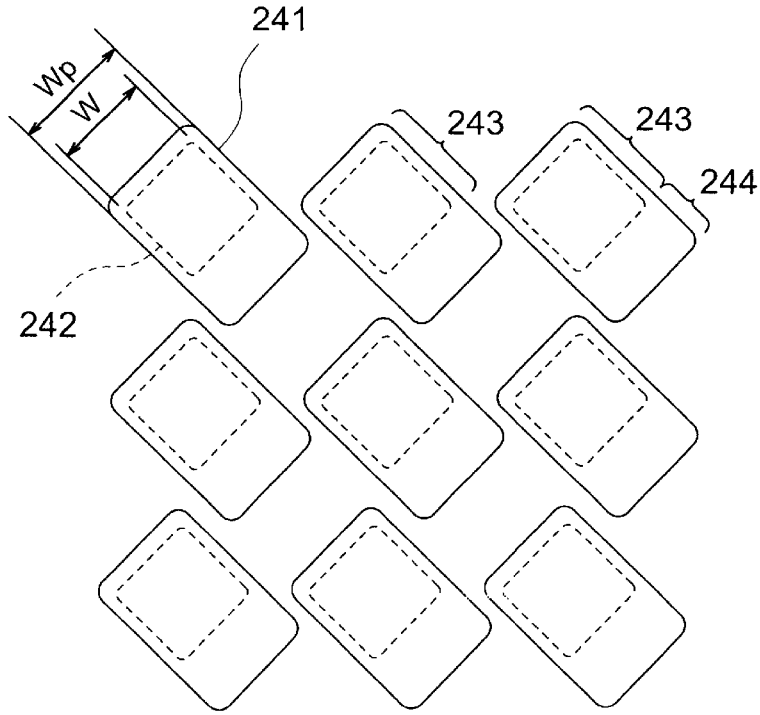

On the other hand, as shown in FIG. 25B, if the width of the piezoelectric actuator is larger than the width of the pressure chamber so that $W_p \geqq (W+2\delta)$ holds, and there is a positional deviation, the driving portion 243 is placed on the walls of the pressure chamber 242. Therefore, the edge of the driving portion 243 is supported while it is fixed, and positional deviation does not greatly change the acoustic capacitance $c_0$.

As in the foregoing, by setting the width $W_p$ of the piezoelectric actuator 241 to satisfy the expression (11) so that the edge of the driving portion 243 is supported in a fixed condition despite a positional deviation, changes in the acoustic capacitance $c_0$ caused by positional deviations can be minimized, whereby the robustness to positional deviations can be improved.

It should be noted, however, that when the edge of the driving portion is supported as it is fixed on the condition $W_p \geqq (W+2\delta)$, the deformation of the piezoelectric actuator 241 is restricted by the edge portion, and therefore $c_0$ is much smaller than the case of movably supported driving portion 243 shown in FIG. 25A. Also if $W_p \leqq (W-2\delta)$ holds and $W_p$ is excessively small, the ejection efficiency is lowered because the effective driving area is reduced.

Figure 27:
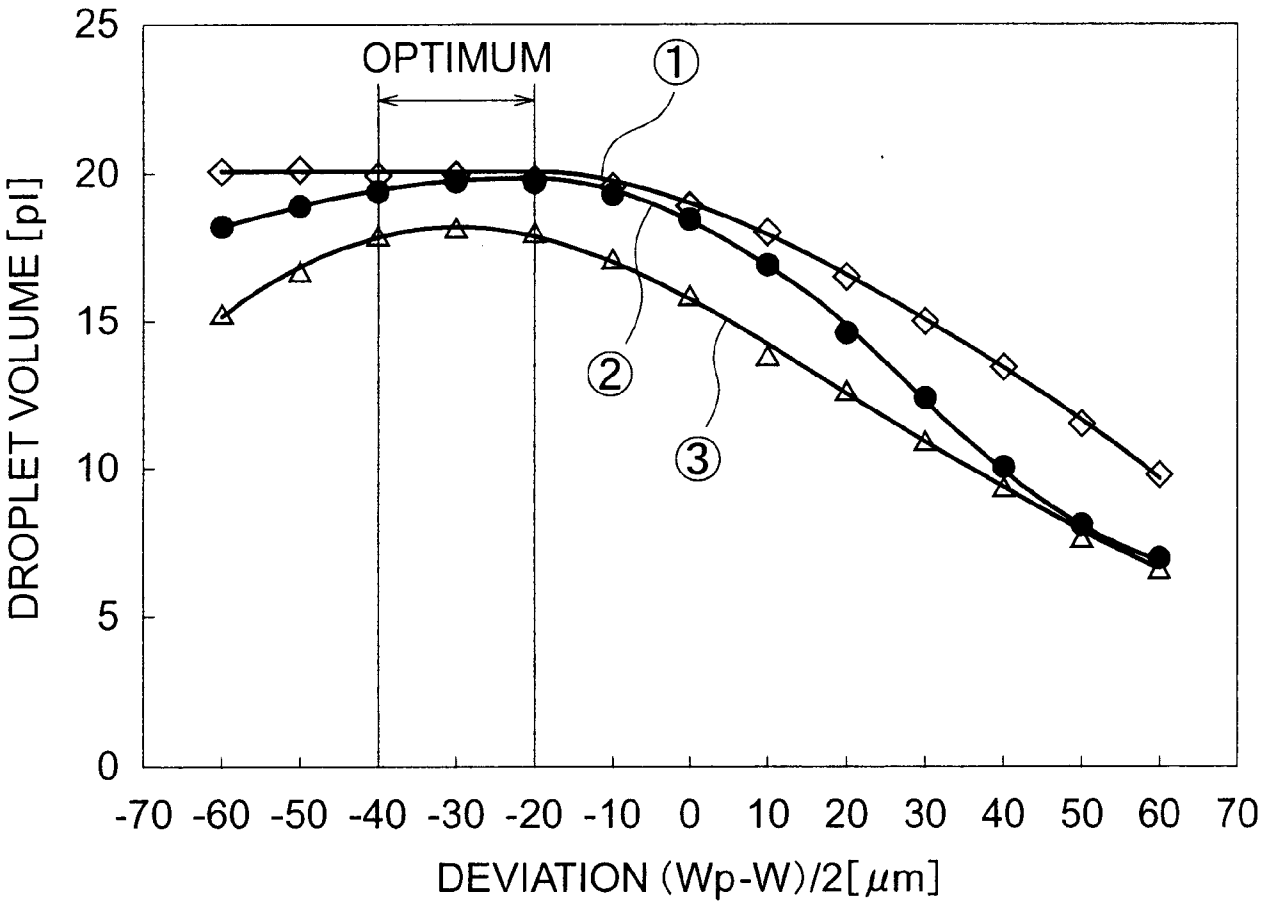
FIG. 27 is a graph showing changes in variances of the ejection efficiency and droplet volume caused by the positional deviation of the piezoelectric actuator in the third embodiment.

FIG. 27 shows the results of examining the relation between the ejection efficiency (droplet volume) and variances of deviation. In FIG. 27, numeral "1" denotes the maximum droplet volume due to a specific deviation, numeral "2" denotes the droplet volume without the deviation, and numeral "3" denotes the minimum droplet volume due to a specific deviation. As can be understood from the results, the following expression may be satisfied for the optimum deviation range to secure the robustness to positional deviations and achieve high ejection efficiency.

$$0.9(W-2\delta) \leqq W_p \leqq (W-2\delta) \tag{12}$$

According to the present embodiment, since the maximum positional deviation δ generated at the time of coupling the piezoelectric actuator is 20 micrometers, $W_p$ is set at 460 micrometers, with the pressure chamber width W being set at 500 micrometers. Thus, a positional deviation within ±20 micrometers does not greatly affect the ejection efficiency.

A plurality of recording heads were actually produced and examined for difference in the ejection efficiency, i.e., ink droplet volume. It was confirmed as a result that between heads with a positional deviation δ of 20 micrometers, the difference in the ejection efficiency was 5% or less. When a positional deviation of 30 micrometers or more was intentionally provided for evaluation, there was a difference of 10% in the ejection efficiency. Thus, it was confirmed that when the condition defined by the expression (12) was satisfied, the robustness to positional deviations could be improved.

It should be noted that the positional deviation δ for the piezoelectric actuator depends on the alignment method used at the time of coupling the piezoelectric actuator. When a typical alignment method with reference to alignment marks is employed, the deviation is about in the range from ±10 to ±30 micrometers. Consequently, the width of $W_p$ of the driving portion is optimally set to be smaller than the pressure chamber width W by about ±10 to ±30 micrometers.

As shown in FIG. 25B, the piezoelectric actuator having a pressure chamber width W of 500 micrometers and $W_p$ of 540 micrometers was also evaluated. In this case, even with a positional deviation of ±20 micrometers, since the boundary of the driving portion is fixed during the vibration, the acoustic capacitance $c_0$ can be suppressed from fluctuating. When the change in the droplet volume caused by the positional deviation was actually examined, the difference in the ejection efficiency was as small as 5% or less. It should be noted, however, that the boundary of the driving portion 243 is fixed, and therefore the ejection efficiency is at most ⅕ that of the structure shown in FIG. 25A, which is disadvantageous in ejecting large droplets.

In the inkjet recording head according to the present embodiment, the acoustic capacitance $c_0$ of the vibrating member is $3.5\times10^{-20}$ $m^5/N$, and the inertance $m_0$ is $1.0\times10^6$ $kg/M^4$. Thus, the inkjet recording head according to the present embodiment satisfies the conditions defined by the expressions (8) and (10), and in the manufactured sample of the present embodiment, a droplet volume of 19 pl (when $V_1$=30V) and a natural period of 9.8 microseconds were obtained.

Fourth Embodiment

Figure 28:
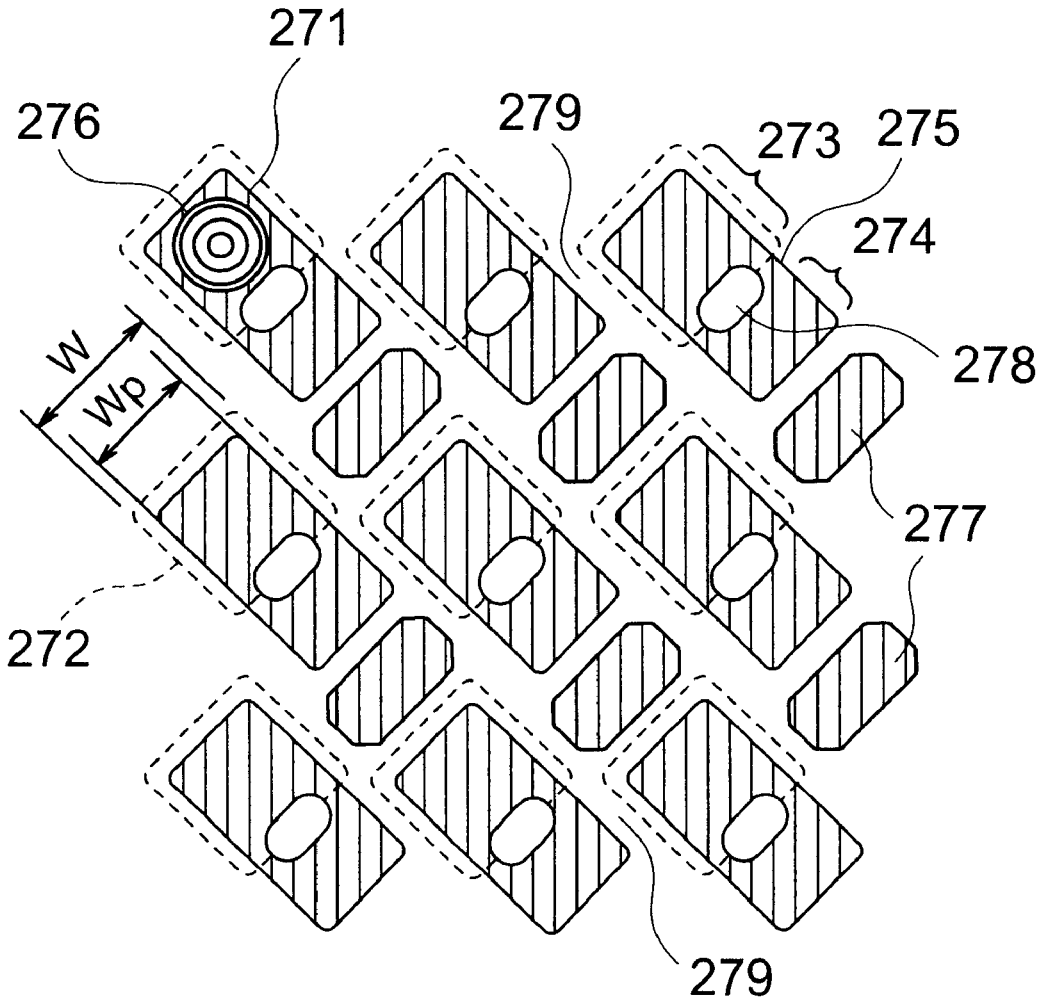
FIG. 28 is a top plan view of a piezoelectric actuator in an inkjet recording head according to a fourth embodiment of the present invention.

FIG. 28 is a top plan view of arrangement of the piezoelectric actuators in a head structure according to a fourth embodiment of the present invention. The inkjet recording head according to the present embodiment has a basic structure substantially the same as that of the third embodiment, except that the shape of the piezoelectric actuators 271 is defined by a driving portion 273, an electrode pad portion 274, and a bridge portion 275.

In other words, the piezoelectric actuator 271 is separated into the driving portion 273 and the electrode pad portion 274 by a through-hole 278. These portions are connected through the bridge portion 275 in a position of the driving portion 273 with little displacement. Thus, the restriction on the displacement of the piezoelectric actuator 271 by the electrode pad portion 274 is reduced, so that a highly efficient inkjet recording head can be provided.

As represented by the contour line 276 in FIG. 28, after the flexibly deforming piezoelectric actuator 271 is attached onto the pressure chamber 272 having an aspect ratio close to 1, the vibrating member deforms to assume a shape close to a sphere. Therefore, the displacement is smaller at a position more apart from the center of the driving portion. When a piezoelectric actuator 271 is formed as polygonal (such as a quadrangle and a hexagon), the part more apart from the center corresponds to the corner region of the driving portion 273. Therefore, according to the present embodiment, the bridge portion 275 is coupled to the corner portion of the driving portion 273 so that the restriction on the displacement of the piezoelectric actuator 271 is minimized, and thus a driving voltage can be effectively applied to the driving portion 273.

After the inkjet recording head according to the embodiment was evaluated for actual ejection, it was found that the ejection efficiency was increased by 20% as compared to the structure shown in FIG. 25A. More specifically, for $V_1$=30 V, a droplet volume of 23 pl was obtained. It should be noted that in the inkjet recording head according to the embodiment, the acoustic capacitance $c_0$ of the vibrating member is $3.7\times10^{-20}$ $m^5/N$, and the inertance $m_0$ is $1.0\times10^6$ $kg/m^4$, which satisfy the conditions defined by the expressions (8) and (10).

Figure 29:
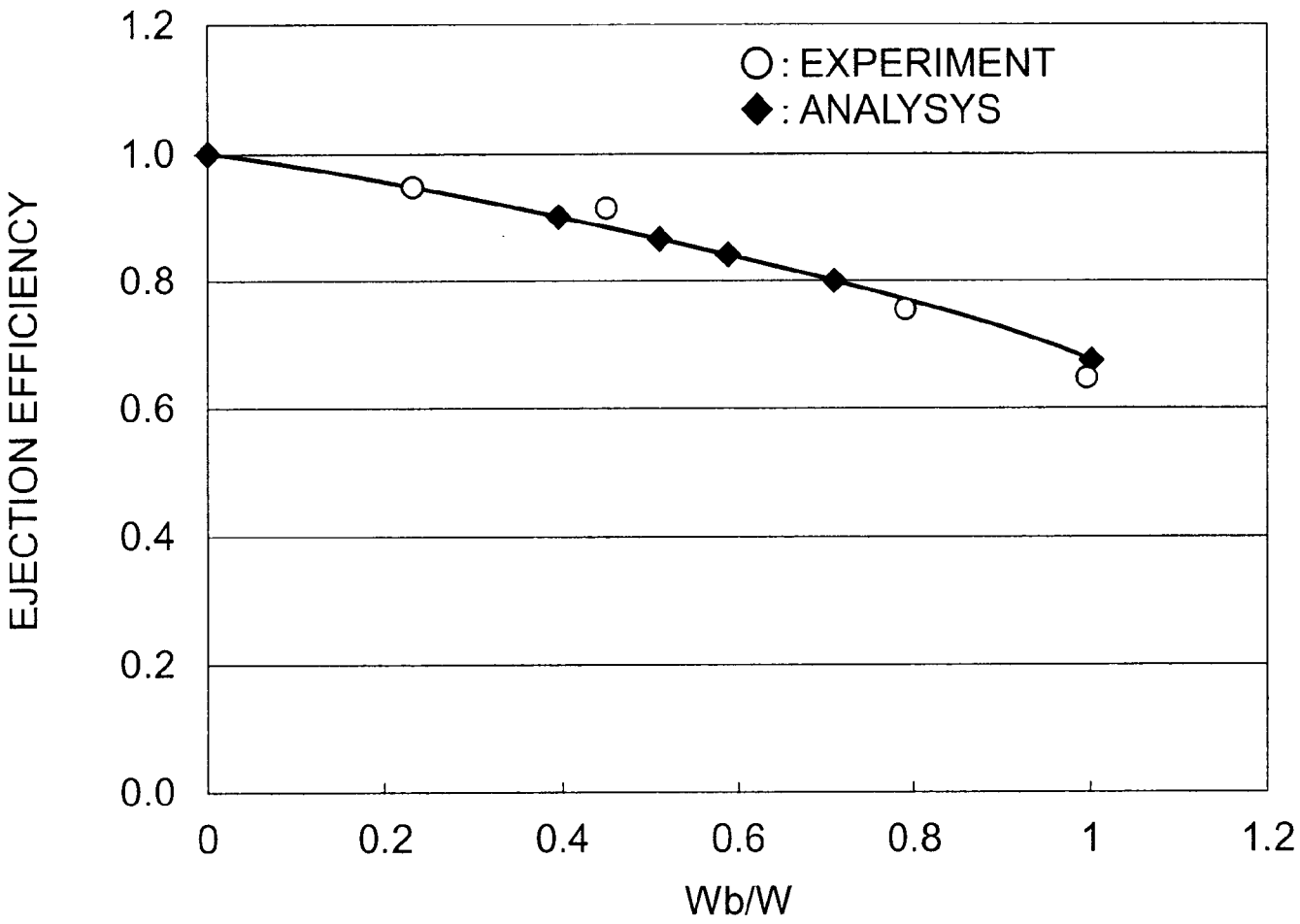
FIG. 29 is a graph showing the relation between the bridge width and the ejection efficiency in the fourth embodiment.
Figure 30A:
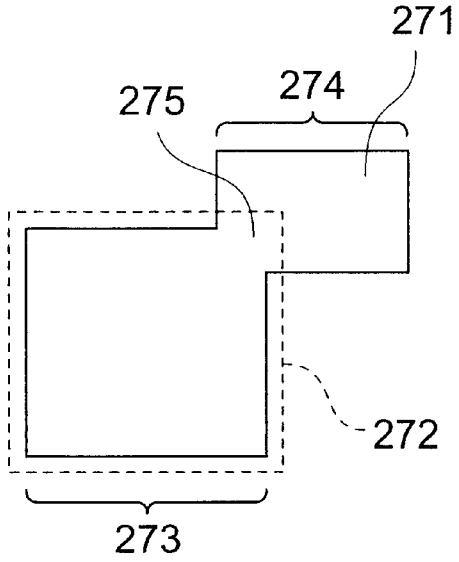
FIGS. 30A to 30D are top plan views each showing a piezoelectric actuator to which the fourth embodiment may be applied.
Figure 30C:
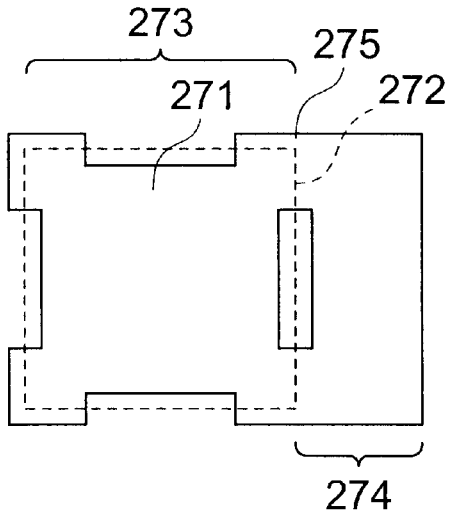
Figure 30B:
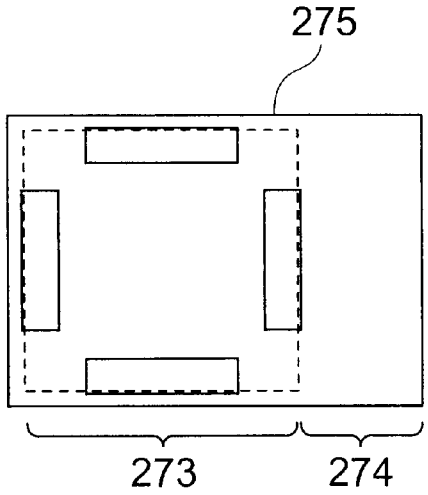
Figure 30D:
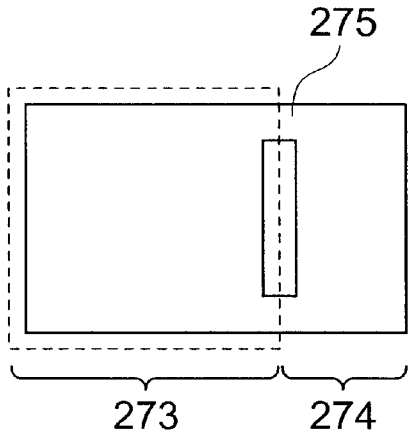

FIG. 29 shows the results of examining the relation between the width Wb of the bridge portion and the ejection efficiency by structural analysis and actual ejection evaluation. As can be seen from the results, if the width of the bridge portion is smaller, the displacement restriction is smaller and the ejection efficiency is larger. It should be noted however that if the width of the bridge portion is excessively small, cracks may be made at the bridge portion during manufacturing or use of the recording head, and thus normal ink ejection is difficult to achieve. As a result of the experiment, it is found that the width Wb of the bridge portion should be preferably set between ½ and ¼ of the width $W_p$ of the driving portion.

The shape of the piezoelectric actuator 271 is not limited to that shown in FIG. 28, and various shapes such as shown in FIGS. 30A to 30D may be used. In more detail, so long as the bridge portion 275 is coupled to a part apart from the center of the driving portion 273, the bridge portion 275 or the electrode pad portion 274 may assume any shape, and one or more bridge portions 275 may be provided.

According to the present embodiment, separating the driving portion 273 of the piezoelectric actuator 271 and the electrode pad portion 274 is advantageous in making electric connection for the piezoelectric actuator 271. In more detail, the shapes of the piezoelectric actuators 241 shown in FIGS. 25A and 25B do not allow the driving portion 243 and the electrode pad portion 244 to be separated from each other. Therefore, if the electric connection technique using the FPC board such as shown in FIGS. 22A and 22B and 23A and 23B is used, the adhesive or bond material 329 shown in FIGS. 23A and 23B may enter the region of the driving portion 243 and restrict the deformation of the piezoelectric actuator 241 shown in FIGS. 25A and 25B. Particularly, if the pressure chambers 242 are highly densely arranged, the distance between the driving portion 243 and the electrode pad portion 244 is short and the problem of the ingress of the bond material 329 in FIG. 23A is highly likely.

On the other hand, as in the present embodiment, by separating the driving portion 273 and the electrode pad portion 274, the bond material can effectively be kept from entering the driving portion 273. Therefore, a highly reliable inkjet recording head can be provided.

According to the present embodiment, the piezoelectric actuator 271 assumes a complicated shape as shown in FIGS. 28 and 30. Therefore, sandblast-processing was employed for processing the structure of the piezoelectric actuators. Thus, the structure of piezoelectric actuators having a complicated shape could be readily and precisely processed in a short time, and a high density inkjet recording head could be produced with less cost.

As shown in FIG. 28, in the inkjet recording head according to the present embodiment, a dummy pattern 277 is provided between each adjacent two of the piezoelectric actuators 271 in the area for the piezoelectric actuators. This is for the purpose of preventing the effect of side etching caused during the sandblast processing and securing high dimensional uniformity for the piezoelectric actuators 271.

During the step for the sandblast processing of the piezoelectric actuators 271, the processing (etching) proceeds in the width-wise direction of the piezoelectric actuators 271 as well as in the thickness-wise direction thereof due to the side etching. The side etching is caused because blasted particles impinge against the side surfaces of the piezoelectric plate during the sandblast processing. The processing rate of the side etching depends on the width of the grooves formed on the piezoelectric plate. If the width of the grooves formed on the sides of the piezoelectric actuators 271 is large, the side etching tends to proceed at a high rate. Conversely, if the width of the grooves is small, the side etching is not easily caused.

As will be understood from the foregoing, the rate of the side etching changes depending upon the groove width if the width of the groove surrounding each piezoelectric actuator 271 is not equal. If the rate of the side etching varies, larger variances are caused in the size of the actuators 271. The size of the piezoelectric actuator 271 greatly affects the ejection characteristic, and accordingly the unequal side etching should be prevented.

In the inkjet recording head according to the present embodiment, since the dummy pattern 277 is formed between adjacent piezoelectric actuators 271, the width of the groove 279 surrounding each piezoelectric actuator 271 is substantially fixed at about 80 micrometers, for example. In this case, all the piezoelectric actuators 271 can be processed in equal conditions, and the piezoelectric actuators 271 having high dimensional uniformity can be provided. In more detail, the precision of the width $W_p$ of the piezoelectric actuators 271 can be reduced to ±5 micrometers or less. When sandblast processing was performed without providing the dummy pattern 277, there were variances of ±20 micrometers or more in the width $W_p$ of the piezoelectric actuator 277. In comparison to this, the effect of providing the dummy pattern 277 is remarkably high.

Figure 31:
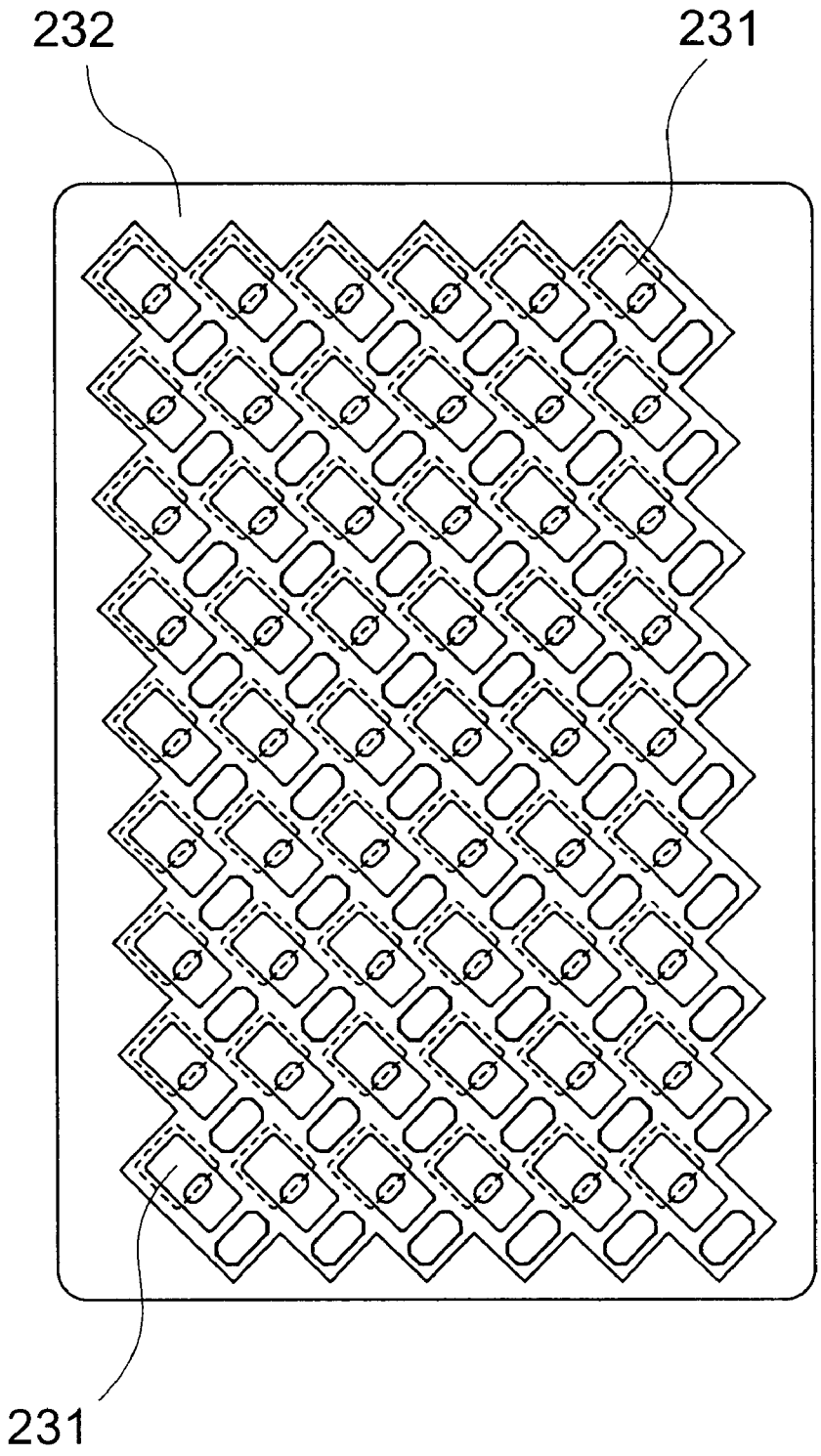
FIG. 31 is a top plan view showing a blast-processed pattern of the piezoelectric actuators in the inkjet recording head of the fourth embodiment.

As shown in FIG. 31, for a similar reason, a dummy pattern 232 is provided at the outer periphery of the area for a plurality of piezoelectric actuators 231. In more detail, among the large number of piezoelectric actuators 231 in general, those positioned at the outer periphery of the area are greatly side-etched, and the dimensional precision as the piezoelectric actuators is hardly provided in the conventional technique. Therefore, the dummy pattern 232 is provided to surround the area of the piezoelectric actuators thus arranged. As a result, high dimensional uniformity can be secured among the piezoelectric actuators 231 positioned at the outer periphery. It should be noted that in the inkjet recording head according to the present embodiment, the dummy pattern 232 is provided at the outer periphery as an integral structure, as shown in FIG. 31, whereas a dummy pattern including a plurality of small pattern pieces may be arranged.

The use of the dummy pattern allows variances in the ejection characteristic (droplet volume and velocity) to be reduced down to within ±5% or less in the 260 ejectors in the ink jet recording head according to the embodiment. After the performance characteristics of a number of recording heads were compared, it was found that the characteristic variances among the recording heads were within ±6% or less. It was thus confirmed that the piezoelectric actuator structure using the dummy pattern 232 was highly effective in equalizing the performance characteristics of the recording head.

Fifth Embodiment

Figure 42:
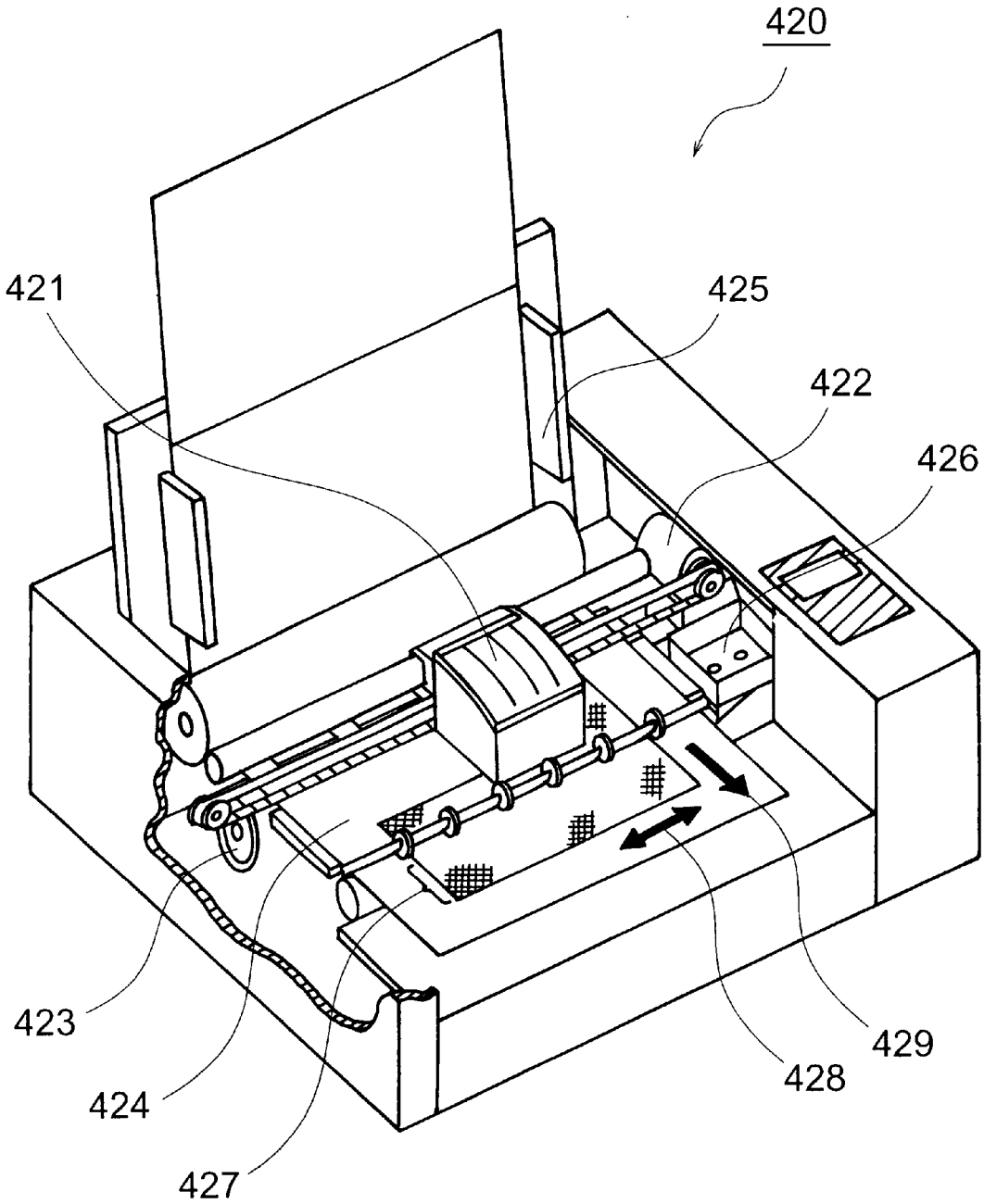
FIG. 42 is a perspective view of an inkjet recording apparatus according to a fifth embodiment of the present invention.

FIG. 42 is a perspective view of an inkjet recording apparatus according to a fifth embodiment of the present invention. The inkjet recording apparatus 420 includes a carriage 421 including an inkjet recording head, a main scanning mechanism 422 for scanning the carriage 421 in the main scanning direction shown by the arrow 428, and an auxiliary canning mechanism 423 for feeding a recording paper sheet 424 as a recording medium in the direction (sub-scanning direction) normal to the main scanning direction and shown by the arrow 429.

The inkjet recording head is mounted on the carriage 421 so that the surface of the inkjet recording head having the nozzles opposes the recording paper sheet 424. As the head is transported in the main scanning direction 428, ink droplets are ejected to the recording paper sheet 424, whereby images are recorded in a specified stripe area 427. The recording paper sheet 424 is fed in the sub-scanning direction 429, and then the carriage 421 is again shifted in the main scanning direction 428 for recording images in the next stripe area. This operation is iterated for a number of times and image recording for the entire surface of the recording paper sheet 424 is completed.

Images were actually recorded using the inkjet recording apparatus according to the present embodiment, and the recording speed as well as image quality was evaluated. The inkjet recording head used had the matrix head structure according to the fourth embodiment. The matrix head included a plurality of ejectors arranged on the carriage 421. Two hundred sixty ejectors in number are provided for each of four colors, i.e., yellow, magenta, cyan, and black. Dots in the four colors are placed on one another on the recording paper sheet 424 and full color image recording was executed.

The recording process was executed while the large droplet volume was set at 18 pl, and the small droplet volume at 2 pl, with the recording resolution being set at 600 dpi, and the ejection frequency at 18 kHz. As a result, it was confirmed that images for a sheet of A4 size (210 mm×297 mm) were printed within about five seconds, at a satisfactorily higher recording speed. Since the small droplet volume is as small as 2 pl, the granularity was excellently low at the highlight portion, whereby significantly high image quality recording was achieved.

As a comparison, by using a conventional head which had 64 nozzles per each color, an image output experiment was similarly executed. The upper limit for the large droplet volume was 10 pl and therefore the recording resolution was set at 1200 dpi. The small droplet volume was set at 6 pl and the ejection frequency at 18 kHz. As for the recording speed, it cost about 85 seconds to record images for an A4 size (210 mm×297 mm) sheet. Since the small droplet volume was as large as 6 pl, the granularity was noticeable at the highlight portion, and the image quality was lower compared to the image quality achieved by the present embodiment.

As described above, in the inkjet recording apparatus according to the present embodiment, $c_0 \geqq 2.0\times10^{-20}$ $m^5/N$ is established for the acoustic capacitance $c_0$ of the vibrating member, large droplets can be recorded which are advantageous for low resolution recording. In addition, since the square pressure chambers having high ejection efficiency are arranged in a matrix, the number of nozzles arranged in a specified area is larger. Therefore, when compared to the conventional inkjet recording apparatus, the recording speed can be significantly increased, by using a recording head having a specified area for the nozzles. Also in the inkjet recording apparatus according to the embodiment, since $c_0 \leqq 5.5\times10^{-19}$ $m^5/N$ is set for the acoustic capacitance $c_0$, small droplets can be successfully ejected by using the meniscus control technique, and high image quality can be provided. In short, by using the inkjet recording apparatus according to the present embodiment, both high speed recording and high image quality recording can be achieved at a time.

It is to be noted that according to the present embodiment, recording is executed while the head is transported by the carriage 421; however, the present invention is applicable to other types of apparatus. For example, a linear type head having nozzles for the entire width of the recording medium may be used. In this case, the head is fixed in the main scanning direction and only the recording medium is fed in the sub-scanning direction for recording.

The present invention is not limited to the structures of the embodiments described above. For example, although the common ink passage and the pressure chambers are made of a stainless steel plate in the above embodiments, any other material such as ceramic and glass may be used. In addition, the basic structure of the head, in other words, the structure and arrangement of the nozzles, supply passages and common ink passages are not limited to those shown in FIGS. 17 and 18, and any other structure may be employed.

According to the above embodiments, although the pressure chambers are all formed in a rectangular shape, other polygonal shapes (such as triangle, pentagon, and hexagon) or an approximately circular shape may be employed and still the same effects may be provided. The embodiments are all described in connection with a matrix head; however, the present invention may be applied similarly to other head structures such as a head having one-dimensionally arranged pressure chambers. Furthermore, in the embodiments described above, the piezoelectric actuators are processed (produced) by the sandblast processing; however, other processes such as dicing may be employed or a piezoelectric material may be printed on the diaphragm. Similarly, the diaphragm and the piezoelectric actuator may be made into an integral form. The diaphragm may be formed as a single sheet or a plurality of sheets.

The above embodiments are directed to inkjet recording apparatuses for ejecting color ink onto recording paper and for recording characters or images thereon. However, the use of the inkjet recording herein is not limited to such recording of characters and images on recording paper. In other words, the recording medium is not limited to paper, or the liquid to be ejected is not limited to the color ink. For example, ink may be ejected onto a polymer film or glass for producing a color filer for display, or solder in a molten state may be ejected onto a substrate to form bumps for packaging parts. In other words, the present invention may be applied to commercially available liquid droplet ejecting devices in general.

Other than a vibrating member having a square planar shape as in the embodiments, a vibrating member having a planar shape satisfying the following expression can be used:

$$1 \leqq A \leqq 2$$

wherein A represents the ratio ($d_1/d_2$) of the diameter ($d_1$) of the circumscribing circle in contact with the planar shape and the diameter ($d_2$) of the inscribing circle. More specifically, $A=\sqrt{2}$ ($\approx1.4$) for a square, while A=2 for a regular triangle, $A=2/\sqrt{3}$ ($\approx1.2$) for a regular hexagon, and A=1 for a circle. A vibrating member having any of these planar shapes has its minimum width portion to be largely bent with ease, and therefore the planar area may be reduced as much as possible and still a prescribed ejection volume can be maintained. This can reduce the size and cost of the head.

It is to be noted that the planar shape, material and thickness of the vibrating member are not limited to the samples manufactured according to the embodiments. Any other combinations satisfying the condition that $2.0\times10^{-20} \leqq c_0 \leqq 5.5\times10^{-9}$ $m^5/N$ (co: acoustic capacitance) may be employed, and the effects according to the present invention can be provided.

Although the present invention has been described with reference to the preferred embodiments thereof, the inkjet recording heads and the manufacturing methods thereof, the inkjet recording apparatus and the method of driving the inkjet recording heads are not limited to those described above. Various modifications and alterations may be made to those according to the embodiments described above without departing from the scope of the present invention.

What is claimed is:

1. An inkjet recording head comprising:

a plurality of nozzles;

a plurality of pressure chambers each disposed for a corresponding one of said nozzles in communication therewith;

at least one diaphragm defining a part of said wall surfaces of said pressure chambers; and a plurality of piezoelectric actuators each disposed for a corresponding one of said pressure chambers in contact with said diaphragm, at least a part of said diaphragm and each of said piezoelectric actuators constituting a vibrating member, said vibrating member generating a pressure wave in ink filled within said pressure chamber to eject an ink droplet from a corresponding one of said nozzles, said vibrating member having an acoustic capacitance ranging from $2.0\times10^{-20}$ $m^5/N$ to $5.5\times10^{-19}$ $m^5/N$.

2. The inkjet recording head according to claim 1, wherein a droplet volume of said ink droplet ejected from said nozzle changes among multiple values in response to control of a waveform of driving voltage applied to said vibrating member.

3. The inkjet recording head according to claim 1, wherein a maximum droplet volume of said ink droplet ejected from said nozzle is at least 15 pl.

4. The inkjet recording head according to claim 3, wherein said waveform of said driving voltage applied for ejection of said ink droplet of said maximum droplet volume includes a first voltage change process to apply voltage in a direction to compress a volume of said pressure chamber, and a second voltage change process to apply voltage in a direction to expand said volume of said pressure chamber.

5. The inkjet recording head according to claim 1, wherein a minimum droplet volume of said ink droplet ejected from said nozzle is at most 4 pl.

6. The inkjet recording head according to claim 5, wherein said waveform of said driving voltage applied for ejection of said ink droplet of said minimum droplet volume includes a first voltage change process to apply voltage in a direction to expand a volume of said pressure chamber, and a second voltage change process to apply a voltage in a direction to compress said volume of said pressure chamber, said second voltage change process forming a liquid column of ink having a diameter smaller than a diameter of said nozzles.

7. The inkjet recording head according to claim 1, wherein aspect ratios of said pressure chamber and each of said piezoelectric actuators as viewed in planar shapes are each set at about 1.

8. The inkjet recording head according to claim 7, wherein said pressure chamber has a planar area set in a range from 0.09 to 0.5 $mm^2$, and thicknesses of said diaphragm and each of said piezoelectric actuators are set in a range from 5 to 20 micrometers and 15 to 40 micrometers, respectively.

9. The inkjet recording head according to claim 7, wherein the following expression is satisfied:

$$W_p \leqq (W-2\delta)$$

or $$W_p \geqq (W+2\delta)$$

where W represents a width of each said pressure chamber, δ represents a positional deviation between a center of said each pressure chamber and a center of a driving portion of a corresponding one of said piezoelectric actuators, and $W_p$ represents a width of said corresponding one of said piezoelectric actuators.

10. The inkjet recording head according to claim 7, wherein the following expression is satisfied:

$$0.9(W-2\delta) \leqq W_p \leqq (W-2\delta)$$

where W represents a width of each said pressure chamber, δ represents a positional deviation between a center of said each pressure chamber and a center of a driving portion of a corresponding one of said piezoelectric actuators, and $W_p$ represents a width of said corresponding one of said piezoelectric actuators.

11. The inkjet recording head according to claim 1, wherein said vibrating member has a pianar shape defining substantially regular triangle, square, regular hexagon or circle.

12. The inkjet recording head according to claim 11, wherein each said vibrating member has a curved side at a boundary between the same and an adjacent vibrating member.

13. The inkjet recording head according to claim 1, wherein said acoustic capacitance of said vibrating member is set to be larger than an acoustic capacitance of said pressure chamber.

14. The inkjet recording head according to claim 2, wherein the following expression is satisfied:

$$m_0 < 2.5\times10^{-4} T_c^2/c_c (kg/m^4)$$

where $T_c$ represents a natural period of a pressure wave generated in each said pressure chamber, $c_c$ represents a composite acoustic capacitance of said vibrating member and said each pressure chamber, and $m_0$ represents an inertance of said vibrating member.

15. The inkjet recording head according to claim 1, wherein ink droplets ejected from said nozzles achieve a recording resolution of 600 dpi or lower.

16. The inkjet recording head according to claim 1, wherein a natural period of a pressure wave generated in said pressure chamber is set at 15 microseconds or shorter.

17. The inkjet recording head according to claim 1, wherein each said piezoelectric actuator includes a driving portion disposed in a region corresponding to said pressure chamber, an electrode pad portion disposed at least on a wall of said pressure chamber, and a bridge portion coupling together said driving portion and said electrode pad portion.

18. The inkjet recording head according to claim 17, wherein said bridge portion is coupled to said driving portion in a position apart from said center of said driving portion.

19. The inkjet recording head according to claim 1, wherein said nozzles are two-dimensionally arranged in a matrix.

20. The inkjet recording head according to claim 19, further comprising a printed circuit board having a plurality of signal lines, said printed circuit board being positioned to cover top of said piezoelectric actuators two-dimensionally arranged, said piezoelectric actuators and said printed circuit board being electrically connected through respective bumps.

21. The inkjet recording head according to claim 20, wherein each said bump is made of a conductive core material and a bond material coating an outer periphery of said core material.

22. The inkjet recording head according to claim 21, wherein said core material is formed into a semi-spherical shape.

23. The inkjet recording head according to claim 20, wherein said printed circuit board includes a resin material and a metal conductor.

24. The inkjet recording head according to claim 1, wherein said pressure chambers as well as said vibrating members are two-dimensionally arranged in a matrix.

25. The inkjet recording head according to claim 24, wherein a dummy pattern is disposed to surround an outer periphery of an area for a plurality of said piezoelectric actuators.

26. The inkjet recording head according to claim 24, wherein a dummy pattern is provided between adjacent two of said piezoelectric actuators.

27. The inkjet recording head according to claim 24, further comprising a groove to surround each said piezoelectric actuator, said groove having a width set to be substantially uniform for all said piezoelectric actuators.

28. The inkjet recording head according to claim 1, wherein each said nozzle is made of a resin film.

29. A method of manufacturing an inkjet recording head according to claim 1, comprising the step of forming a pattern for said piezoelectric actuators by sand blast processing.

30. An inkjet recording apparatus comprising an inkjet recording head according to claim 1.

31. A method of driving an inkjet recording head, said inkjet recording head including a plurality of nozzles, a plurality of pressure chambers each disposed for a corresponding one of said nozzles in communication therewith, at least one diaphragm constituting a part of walls of said pressure chambers, and a plurality of piezoelectric actuators each disposed for a corresponding one of said pressure chambers in contact with said diaphragm, at least a part of said diaphragm and each said piezoelectric actuator constituting a vibrating member, said vibrating member ejecting ink filled within said pressure chamber from each said nozzle, said method comprising the steps of:

setting an acoustic capacitance of each said vibrating member at $2.0\times10m^5/N$ or higher, applying a driving voltage to said vibrating member, said driving voltage having a waveform including a first voltage change process to compress a volume of said pressure chamber for ejection of an ink droplet, and a second voltage change process to expand said volume of said pressure chamber, said ink droplet having a volume of at least 15 pl.

32. A method of driving an inkjet recording head, said inkjet recording head including a plurality of nozzles, a plurality of pressure chambers each disposed for a corresponding one of said nozzles in communication therewith, at least one diaphragm constituting a part of walls of said pressure chambers, and a plurality of piezoelectric actuators each disposed for a corresponding one of said pressure chambers in contact with said diaphragm, at least a part of said diaphragm and each said piezoelectric actuator constituting a vibrating member, said vibrating member ejecting ink filled within said pressure chamber from each said nozzle, said method comprising the steps of:

setting an acoustic capacitance of said vibrating member in a range from $2.0\times10$ $m^5/N$ to $5.5\times10^{-19}$ $m^5/N$, and applying a driving voltage having a waveform including a first voltage change process to expand a volume of said pressure chamber and a second voltage change process to compress said volume of said pressure chamber, said driving voltage allowing said vibrating member to form a ink column having a diameter smaller than a diameter of said nozzle and to eject an ink droplet having a diameter of 4 pl or less from said nozzle.

* * * * *